US008857311B2

(12) United States Patent
Warren

(10) Patent No.: US 8,857,311 B2
(45) Date of Patent: Oct. 14, 2014

(54) APPARATUS FOR PROVIDING PROTECTION FROM BALLISTIC ROUNDS, PROJECTILES, FRAGMENTS AND EXPLOSIVES

(75) Inventor: David H. Warren, Stone Ridge, NY (US)

(73) Assignee: Armordynamics, Inc., Kingston, NY (US)

( * ) Notice: Subject to any disclaimer, the term of this patent is extended or adjusted under 35 U.S.C. 154(b) by 139 days.

(21) Appl. No.: 13/273,689

(22) Filed: Oct. 14, 2011

(65) Prior Publication Data

US 2012/0266745 A1 Oct. 25, 2012

Related U.S. Application Data

(63) Continuation of application No. 11/978,663, filed on Oct. 30, 2007, now Pat. No. 8,074,553, which is a continuation-in-part of application No. 11/296,402, filed on Dec. 8, 2005, now Pat. No. 7,383,761.

(60) Provisional application No. 60/634,120, filed on Dec. 8, 2004, provisional application No. 60/689,531, filed on Jun. 13, 2005.

(51) Int. Cl.

| | |
|---|---|
| ***F41H 5/007*** | (2006.01) |
| ***F41H 7/04*** | (2006.01) |
| ***F41H 7/02*** | (2006.01) |

(52) U.S. Cl.

CPC ..... *F41H 5/007* (2013.01); *F41H 7/044* (2013.01); *F41H 7/02* (2013.01)

USPC ..... 89/36.17; 89/902; 89/930; 89/36.03

(58) Field of Classification Search

CPC ..... F41H 7/004; F41H 7/02; F41H 5/007

USPC ..... 89/36.17, 901, 930, 36.08, 902; 109/36, 109/37

See application file for complete search history.

(56) References Cited

U.S. PATENT DOCUMENTS

| | | | | |
|---|---|---|---|---|
| 2,806,509 | A | 9/1957 | Bozzacco et al. | |
| 3,431,818 | A | 3/1969 | King | |
| 4,111,097 | A | 9/1978 | Lasker | |
| 4,665,794 | A * | 5/1987 | Gerber et al. | 89/36.02 |
| 4,821,620 | A | 4/1989 | Cartee et al. | |
| 4,953,442 | A | 9/1990 | Bartuski | |
| 5,266,379 | A | 11/1993 | Schaeffer et al. | |

(Continued)

*Primary Examiner* — Stephen M Johnson

(74) *Attorney, Agent, or Firm* — Andrews Kurth LLP; Sean S. Wooden; Matthew J. Esserman

(57) ABSTRACT

An apparatus for providing protection from ballistic rounds, projectiles, fragments and explosives. The apparatus includes a core, grinding layer and bonding layer. The core is shaped and configured as a structural truss of the apparatus, in which the core includes a plurality of parallel, adjacent rows and the core distributes and dissipates force impacting on the apparatus. The grinding layer is positioned on at least one side of the core facing towards potential threats, in which the grinding layer grinds rounds, projectiles, fragments or other materials impacting the apparatus, helping to dissipate the impacting material and its momentum. The bonding layer bonds the grinding layer together and the grinding layer to the core and provides an outer coating to the apparatus on a side of the apparatus facing potential threats and through which rounds, projectiles, fragments or other materials impact and penetrate the apparatus.

16 Claims, 44 Drawing Sheets

(56) References Cited

U.S. PATENT DOCUMENTS

| | | | | |
|---|---|---|---|---|
| 5,376,443 | A | 12/1994 | Sijan et al. | |
| 5,517,894 | A | 5/1996 | Bohne et al. | |
| 5,723,807 | A | 3/1998 | Kuhn, II | |
| 6,112,635 | A | 9/2000 | Cohen | |
| 6,370,690 | B1 | 4/2002 | Neal | |
| 6,408,734 | B1 | 6/2002 | Cohen | |
| 6,575,075 | B2 | 6/2003 | Cohen | |
| 6,635,357 | B2 | 10/2003 | Moxson et al. | |
| 6,642,159 | B1 | 11/2003 | Bhatnagar et al. | |
| 6,713,008 | B1 | 3/2004 | Teeter | |
| 7,216,576 | B2 | 5/2007 | Henry et al. | |
| 7,866,248 | B2 * | 1/2011 | Moore et al. | 89/36.02 |

* cited by examiner

APPARATUS FOR PROVIDING PROTECTION FROM BALLISTIC ROUNDS, PROJECTILES, FRAGMENTS AND EXPLOSIVES

CROSS-REFERENCE TO RELATED APPLICATIONS

This application is a continuation of U.S. patent application Ser. No. 11/978,663, filed Oct. 30, 2007 now U.S. Pat. No. 8,074,553, entitled "APPARATUS FOR PROVIDING PROTECTION FROM BALLISTIC ROUNDS, PROJECTILES, FRAGMENTS AND EXPLOSIVES" which is a continuation-in-part of U.S. patent application, Ser. No. 11/296,402, filed Dec. 8, 2005 now U.S. Pat. No. 7,383,761, entitled "METHODS AND APPARATUS FOR PROVIDING BALLISTIC PROTECTION," which claimed the priority of U.S. Provisional Application Ser. No. 60/634,120, filed Dec. 8, 2004, entitled "METHOD AND APPARATUS FOR PROVIDING A BALLISTIC SHIELD AND METHOD OF MAKING SAME," and U.S. Provisional Application Ser. No. 60/689,531, filed Jun. 13, 2005, entitled "METHOD AND APPARATUS FOR PROVIDING BALLISTIC PROTECTIVE MATERIAL AND METHOD OF MAKING SAME," all of which are hereby incorporated by reference in their entirety.

BACKGROUND

Given the current situation in Iraq and other hotspots around the world, a real need for ballistic protective material that is lightweight, cost effective, field ready, and rapidly deployable would be advantageous. While some combat vehicles are protected, many are not and the current situation in Iraq is that roadside bombs and high velocity projectiles are leaving many soldiers wounded.

Many ask the question 'Why aren't military vehicles in Iraq and other places more protected?' The answer seems to be that war is changing. It use to be that tanks came under heavy fire but now wheeled vehicles such as, e.g., HMMVs, FMTV's, 5-Ton and 2½-Ton Trucks come tinder heavy fire. These types of vehicles are often targets for insurgents in Iraq, and elsewhere, interested in creating instability. These forces work behind the scenes and instead of launching a clear attack, seem satisfied to cause havoc by using roadside bombs and independent strikes.

There are stories pouring out of Iraq that military personnel are buying armor over the internet or attempting to create their own makeshift armor in an effort to survive. It is widely agreed upon that the military is not prepared for this new type of fighting and that military personnel are trying their best to survive. A better solution is needed. Conventional armor (steel) is too time consuming, expensive and heavy (reduces the vehicle's efficiency and makes it difficult to transport the vehicle) to adequately solve the problem. While ballistic products are readily available in the United States, many are quite expensive and others are not field ready.

SUMMARY

Embodiments herein overcome disadvantages described above. Embodiments provide lightweight, cost effective, field-ready, and rapidly deployable protective material effective against ballistic rounds, projectiles, fragments, explosives, etc. Embodiments of also have the advantage of being easy to manufacture and are made of readily-available materials.

These and other advantages are provided by, for example, an apparatus for providing protection from ballistic rounds, projectiles, fragments and explosives. The apparatus includes a core, grinding layer and bonding layer. The core is shaped and configured as a structural truss of the apparatus, in which the core includes a plurality of parallel, adjacent rows and the core distributes and dissipates force impacting on the apparatus. The grinding layer is positioned on at least one side of the core facing towards potential threats, in which the grinding layer grinds rounds, projectiles, fragments or other materials impacting the apparatus, helping to dissipate the impacting material and its momentum. The bonding layer bonds the grinding layer together and the grinding layer to the core and provides an outer coating to the apparatus on a side of the apparatus facing potential threats and through which rounds, projectiles, fragments or other materials impact and penetrate the apparatus.

These and other advantages are provided by, for example, an apparatus for providing protection from ballistic rounds, projectiles, fragments and explosives. The apparatus includes a grinding layer, core, bonding layer and backing. The grinding layer faces towards potential threats, in which the grinding layer grinds rounds, projectiles, fragments or other materials impacting the apparatus, helping to dissipate the impacting material and its momentum. The three-dimensional, structural truss core distributes and dissipates force impacting on the apparatus, wherein the grinding layer is positioned on at least one side of the core on a side of the apparatus facing towards potential threats and the core is configured to orient the grinding layer at an angle away from perpendicular to side of the apparatus facing towards potential threats. The bonding layer bonds the grinding layer together and the grinding layer to the core and provides an outer coating to the apparatus on a side of the apparatus facing potential threats and through which rounds, projectiles, fragments or other materials impact and penetrate the apparatus. The backing is attached to the apparatus on a side facing away from potential threats, in which the backing acts to further absorb and dissipate force impacting on the apparatus.

BRIEF DESCRIPTION OF DRAWINGS

The detailed description will refer to the following drawings, wherein like numerals refer to like elements, and wherein.

DETAILED DESCRIPTION

Methods and apparatus for providing ballistic protection and stopping high-velocity rounds or explosives are described herein. Systems incorporating such apparatus are also described herein. Embodiments of the methods and apparatus provide a light-weight ballistic panel that is an effective barrier or shield against high-velocity rounds or explosives. Various embodiments of ballistic panel are self-healing, able to withstand multiple attacks, portable, easy to install, absorb instead of deflecting rounds, relatively light-weight, and inexpensive.

Figure 1A:
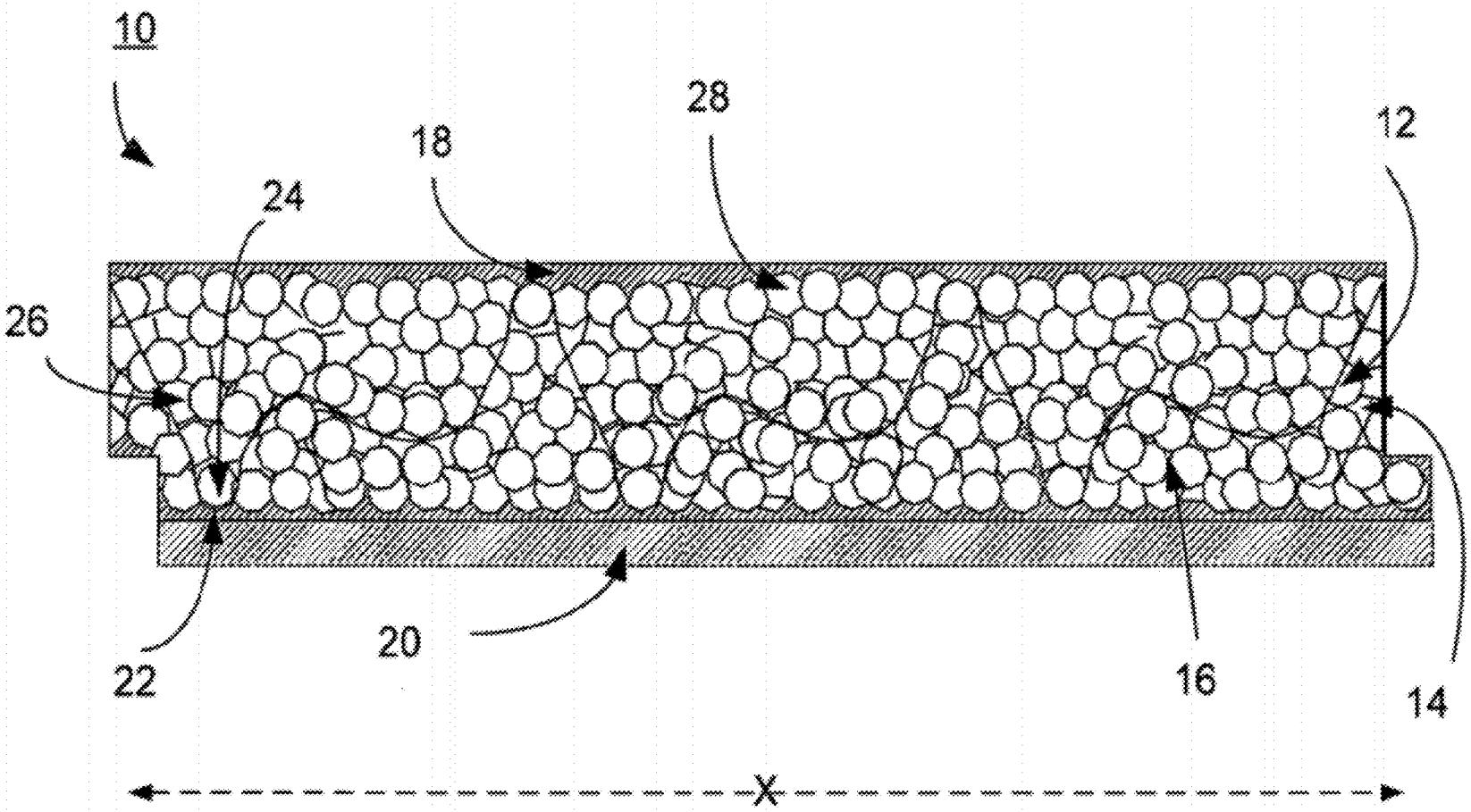
FIGS. 1A-1D are diagrams a side, cross-sectional view of an embodiment of ballistic panel.

With reference now to FIG. 1A, a cross-sectional view of an embodiment of ballistic panel 10 is shown. Ballistic panel 10 comprises: (1) core 12, (2) ceramic layer 14 (e.g., ceramic spheres, beads or balls) as a medium or filler (3) bonding media 16 (e.g., casting urethane) that bonds ceramic layer and (4) outer coating 18 (e.g., a self-healing polymer). The materials combine to create an excellent shield for stopping multiple high-velocity rounds. Embodiments of ballistic panel 10 used in applications in which ballistic panel 10 is not mounted on a material with sufficient force-absorbing or force-resistant principles, e.g., wood, aluminum, hardened plastic, concrete, brick, aluminum or other metal, or composite materials, may also comprise (5) backing 20 made from such materials.

Ballistic panel 10 can be made in almost any size or shape. For example, ballistic panels 10 were made that are 10"×10" with a 1-2" thickness, weighing approx. 10-13 lbs. Ballistic panel 10 can be made in varying thickness depending on the protection needed. See below for description of exemplary additional size and shape ballistic panels 10.

With continuing reference to FIG. 1A, core 12 is generally located at the center of ballistic panel 10, surrounded by ceramic layer 14. Core 12 is a three-dimensional rigid matrix designed for structural integrity and strength. In an embodiment, core 12 is an approximation of an octet truss made from plastic. Other materials for core 12 may be used. As shown, core 12 has two sides and includes opposing protrusions 22. On the opposite side of each protrusion 22 is node (or tip) 24. Each node 24 forms the end of protrusion 22 on the opposite side of core 12. The size of protrusions 22 may be varied depending on the desired thickness of ballistic panel 10 and the desired thickness of ceramic layer 14. Node 24 and protrusion 22 sizes may be chosen to accommodate different ceramic layers, as discussed below.

The embodiment of core 12 shown includes parallel, alternating rows of protrusions 22 and nodes 24 on each side of core 10, perpendicular to the X-axis in FIG. 1A. In other words, this embodiment of core 12 has, in order, a row of protrusions 22, a row of nodes 24, a row of protrusions 22, a row of nodes 24, and so on, repeating across core 12 perpendicular to the X-axis, where each row is parallel to the other rows. Protrusions 22 in each protrusion row are preferably approximately equidistant from the neighboring protrusions 22 in the same row. Likewise, nodes 24 in each node row are preferably approximately equidistant from the neighboring nodes 24 in the same row. The protrusion rows are preferably offset from one another so that where there is gap between protrusions 22 in one row, there is protrusion 22 in the next row. The node rows are preferably also similarly offset from one another so that where there is gap between nodes 24 in one row, there is node 24 in the next row. Consequently, in this embodiment, nodes 24 in each node row are aligned with protrusions 22 in one neighboring protrusion row and the gaps between protrusions 22 in the other neighboring protrusion row. As a result of this configuration, each node 24 (accept for nodes 24 on the ends of rows) is surrounded by three protrusions 22 on the same side of core 12. The triangular area around node 24 defined by the surrounding protrusions 22 (with the node 22 at the center point) is node cell 26. Node cells 26 are described in greater detail below.

Figure 1B:
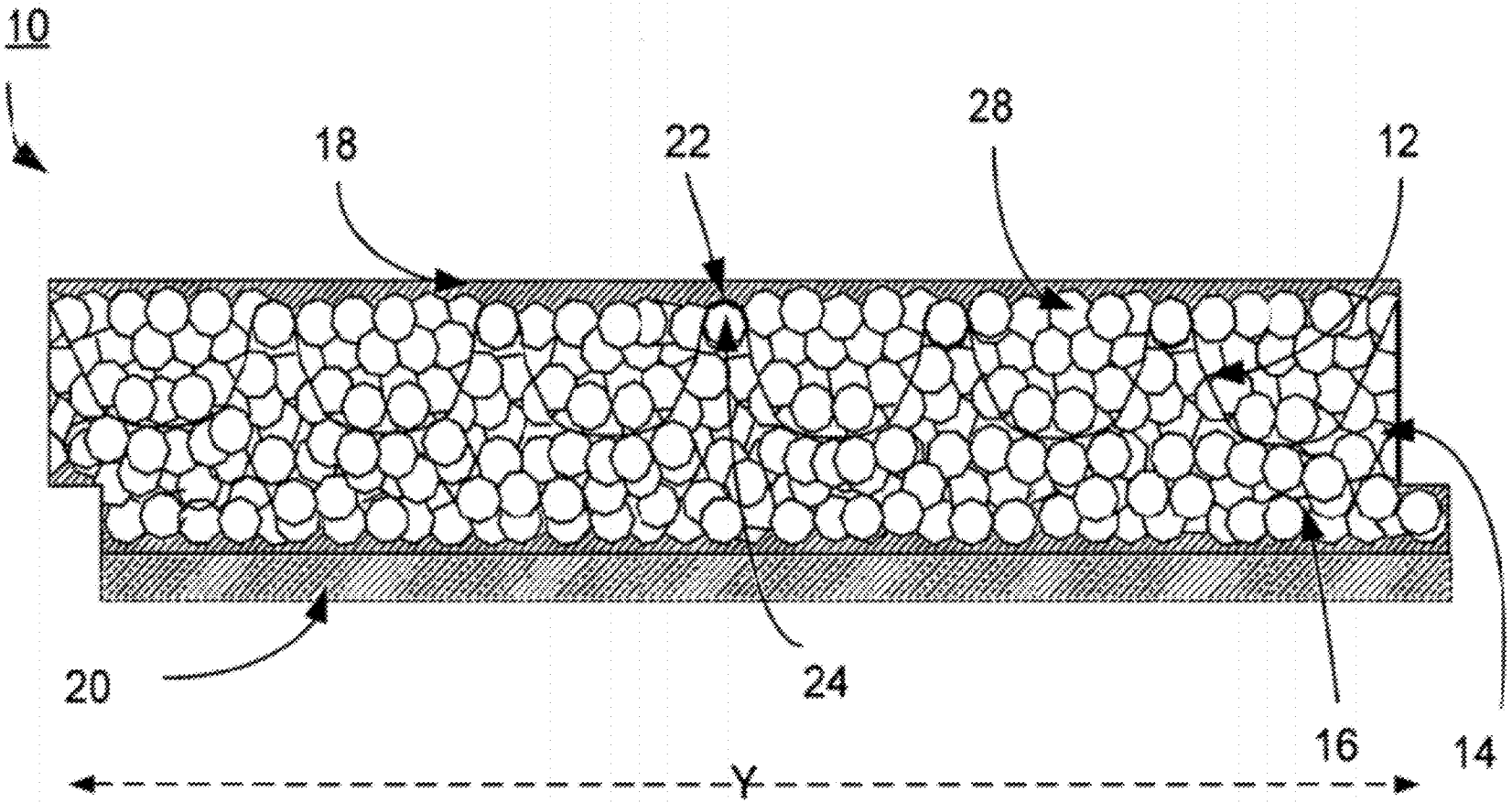

The above-described configuration with parallel rows of equidistant protrusions 22 is not readily apparent in FIG. 1A, since the cross-sectional view of ballistic panel 10 is parallel to the X-axis shown. With reference now to FIG. 1B, shown is a cross-sectional view of ballistic panel 10 that is perpendicular to the X-axis (and parallel to the Y-axis shown). Core 12 shown has been cross-sectioned down the mid-line of a row of protrusions 22 that is parallel to the Y-axis. Consequently, only protrusions 22, and the gaps between protrusions 22, on one-side of core 12 are visible in FIG. 1B.

Figure 1C:
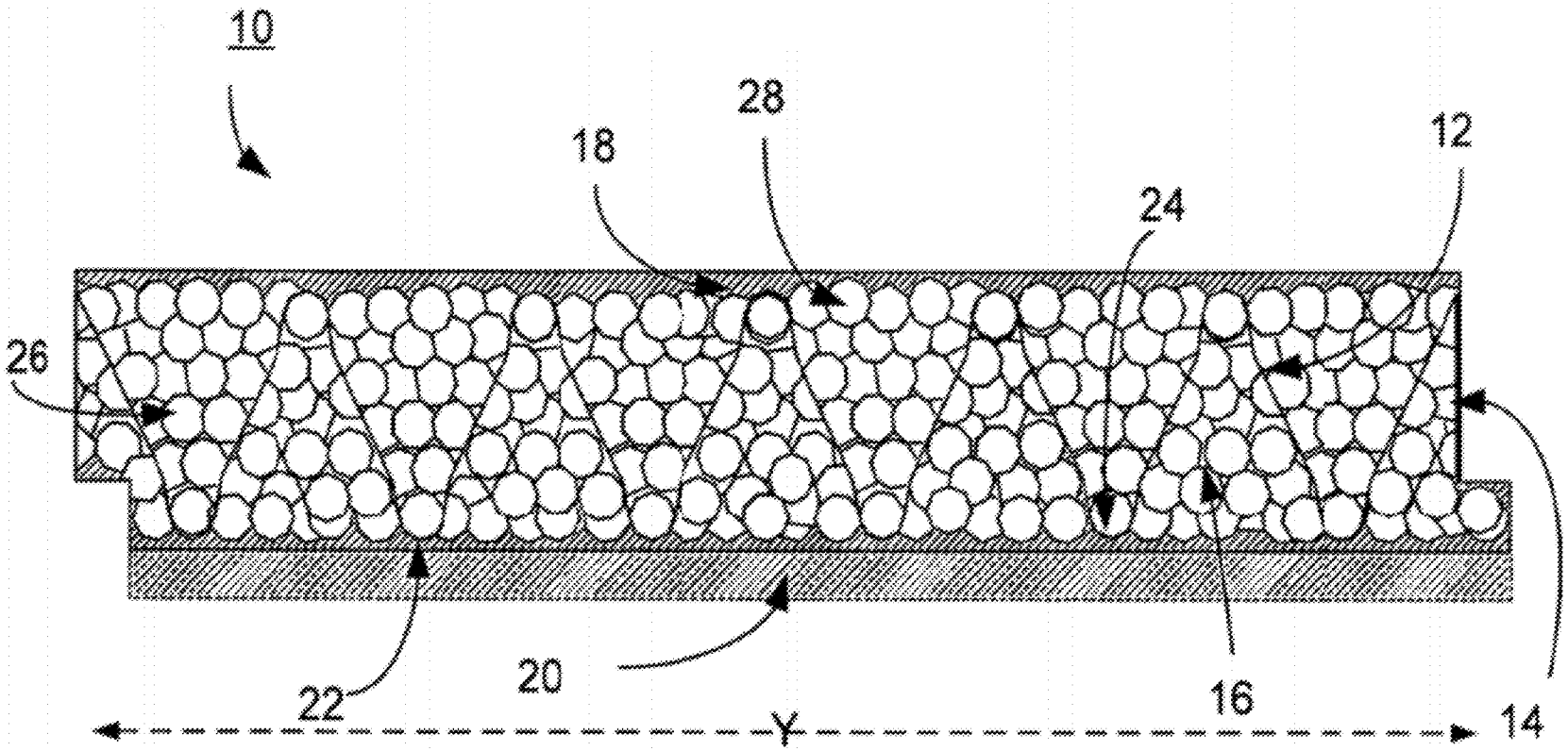

Alternative configurations of core 12 may also be used. With reference now to FIG. 1C, shown is an embodiment of ballistic panel 10 with a core 12 comprising parallel rows that include alternating, opposing, approximately equidistant protrusions 22 and nodes 24. In this embodiment, the parallel rows are preferably offset so that where one row has protrusion 22, the neighboring, surrounding rows have node 24. As a result of this configuration, each node 24 (except for nodes 24 on the ends of rows) is surrounded by four protrusions 22 on the same side of core 12. The diamond-shaped area (i.e., two triangular areas joined along their base) around node 24 defined by the surrounding protrusions 22 (with the node 22 at the center point) is also node cell 26.

With continuing reference to FIGS. 1A-1C, as shown, ceramic layer 14 surrounds core 12. In an embodiment, ceramic layer 14 fills in nodes 24 and node cells 26 on both sides of core 12. Ceramic layer 14 may completely surround core 12, filling core 12 to above protrusions 22. Alternatively, portions of protrusions 22 may be left uncovered (e.g., the ends of protrusions 22 may be uncovered). In the embodiments shown in FIGS. 1A-1C, ceramic layer 14 is equally thick on both sides of core 12. This configuration may be particularly useful for applications in which threats may come from either side of ballistic panel 10. In alternative embodiments, ceramic layer 14 is thicker on one side of core 12 (e.g., the side of ballistic panel 10, and hence core 12, facing the threat (the "threat-side")) than the other.

Figure 1D:
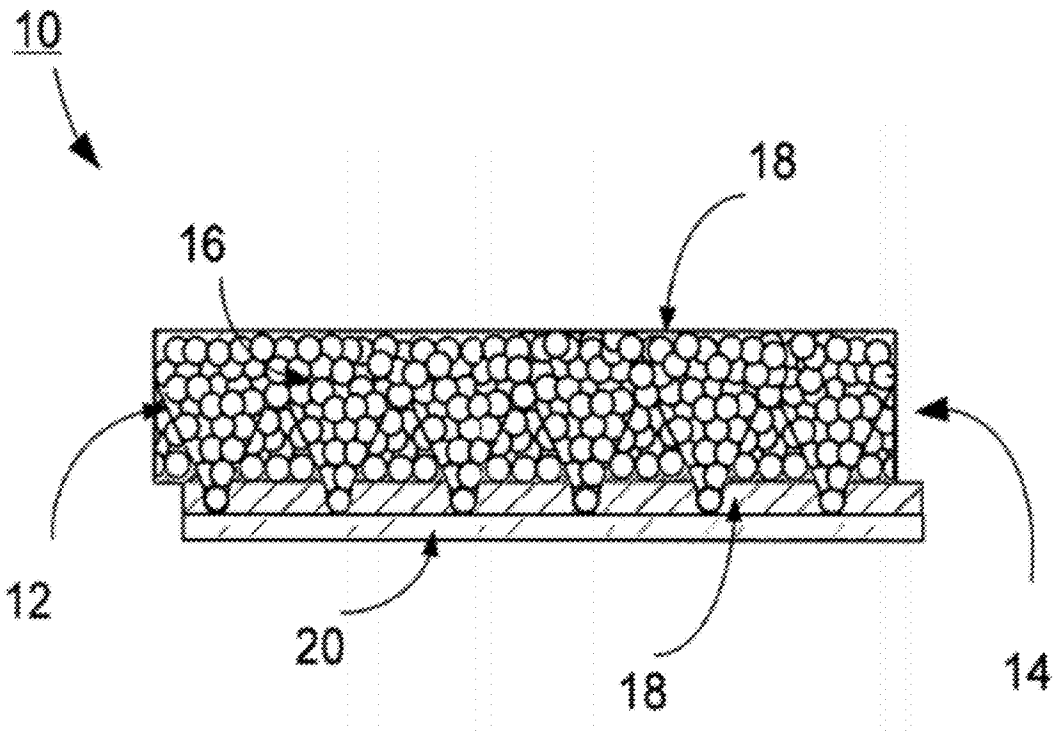

For example, FIG. 1D illustrates an embodiment of ballistic panel 10 in which ceramic layer 14 is thicker on the threat-side. A thicker ceramic layer 14 on one side of core 12 may be chosen, for example, to allow projectiles to pass through ballistic panel 10 in one direction (e.g., towards a threat) while still stopping projectiles from the opposite direction (e.g., from the threat), therefore allowing a person protected by ballistic panel 10 to shoot at the threat. This may be particularly useful when ballistic panel 10 is used in vehicle or building doors and windows, or is itself fabricated with transparent and semi-transparent material. For example, a 60-40 or 70-30 (or other ratio) ratio of ceramic layer 14 on either side of core 12 could be chosen. Similarly, a larger ratio on the "non-threat" side could also be maintained in order to enable ballistic panel 10 to intercept and absorb fragments and ricocheting projectiles on the non-threat side. For example, if ballistic panel 10 were only installed in part of a vehicle or structure, bomb fragments or projectiles could enter the vehicle or structure from another location. Ballistic panel 10, with sufficient ceramic layer 14, could intercept and absorb fragments and ricocheting projectiles within the vehicle or structure.

As shown in FIGS. 1A-1D, ceramic layer 14 may comprise ceramic spheres 28. Alternatively, ceramic layer 14 may comprise different ceramic shapes. Ceramic spheres 28 may be different sizes. Ceramic layer 14 may comprise ceramic spheres 28 all of the same size or varying sizes. In an embodiment, ceramic spheres 28 are chosen so that the diameter of ceramic spheres 28 is nearly the same as the diameter or width of nodes 24 and ceramic spheres 28 fit tightly within nodes 24. Nodes 24 may be rounded to accommodate ceramic spheres 28 or differently shaped for different ceramic shapes. Ceramic sphere 28 size may be varied depending on the ballistic projectiles that need to be stopped. If ceramic sphere 28 size is varied, node 24 and protrusion 22 size may be varied as well.

In certain embodiments, ceramic spheres 28 range in size from 0.5 to 30 mm and are typically referred to as grinding media or mill lining products. For example, 2 mm, 5 mm and 10 mm diameter ceramic spheres 28 may be used. An embodiment of ceramic spheres 28 are made primarily out of aluminum oxide with a small amount of zirconium silicate or other additives. Such ceramic spheres 28 have been used for deagglomeration, grinding, mixing and particle size reduction for such products as minerals, floor and wall tile, porcelain enamel coatings for cookware etc. Other shapes, sizes, and materials for ceramic layer 14 may be used if they provide the same or similar performance characteristics as ceramic spheres 28. For example, Zirconium may be used or non-spherical shapes may be used.

With continuing reference to FIGS. 1A-1D, bonding media 16 bonds ceramic spheres 28 together restricting their movement. In this manner the ceramic spheres form a solid, dense ceramic layer 14. By bonding ceramic spheres 28 together and forming a high density ceramic layer 14, bonding media 16 keeps ceramic spheres 28 from being easily deflected by an incoming projectile out of the incoming projectile's path. In an embodiment, bonding media 16 is a casting urethane. Other compounds besides casting urethane may be used for bonding media 16 if the other compounds provide the same or similar performance characteristics as the casting urethane.

Outer coating 18 is designed to enclose and hold ballistic panel 10 together and provide self-healing characteristics. In an embodiment, outer coating 18 comprises a polymer layer applied to the entire, bonded ceramic layer 16. Alternatively, outer coating may only be applied to one side of ballistic panel 10. In an embodiment, outer coating 18 is an elastomeric, expandable, polyurethane, solvent free 100% solids polymer layer (e.g., a Rhinocast™ truck bed liner product). This polymer layer can be successfully sprayed on in an even layer and provides ideal results. Other materials for outer coating 18 may be used that provide the same or similar performance, such as other two component chemical processing systems that include pouring a polyurethane into a mold that becomes tack free in seconds.

After a round penetrates ballistic panel 10, the entry point is minimized based on the elastic properties of outer coating 18 polymer layer. In other words, outer coating 18 "self-heals," reducing the size of the entry point. In addition, the self-healing action hides the point of entry, which prevents an assailant from easily targeting the same hole. Outer coating 18 also helps to contain broken ceramic spheres 28 of ceramic layer 14 thereby providing multiple hit protection and enabling the broken ceramic spheres 28 to act on additional projectiles.

With continuing reference to FIGS. 1A-1D, embodiments of ballistic panel 10 are mounted on a structure, such as a door or other part of a vehicle, boat, plane or building. If the structure is made of wood, metal, concrete or other material of sufficient thickness, density and/or force-absorbing/resistant properties, ballistic panel 10 will operate as intended, substantially stopping ballistic projectiles. Embodiments of ballistic panel 10 that are not so mounted include backing 20. Backing 20 is bonded to ballistic panel 10 on the non-threat or non-impact side of ballistic panel 10. Backing 20 may be made from the same or similar materials as described above, including wood, ceramics, steel, titanium, or other metals, composites, etc. Embodiments of backing 20 are made relatively thin, e.g., 1/10 to 1/4 the thickness of ballistic panel 10, and with light-weight materials so that backing 20 does not substantially increase the weight of ballistic panel. Although backing 20 is shown on one side of ballistic panel 10, a second backing 20 may be included on the other side of ballistic panel 10. Second backing 20 would be useful for ballistic panels 10 that receive threats from both sides.

Alternative embodiments of ballistic panel 10 may replace ceramic layer 14 with some other filler (e.g., sand, fine clay, etc). Also, as sand is a ceramic media, ceramic layer 14 may simply comprise sand. Such embodiments may eliminate bonding media 16. Likewise, outer coating 18 may be not be necessary for some applications. Indeed, alternative embodiments of ballistic panel 10 may comprise only core 12 and a filler.

Figure 2A:
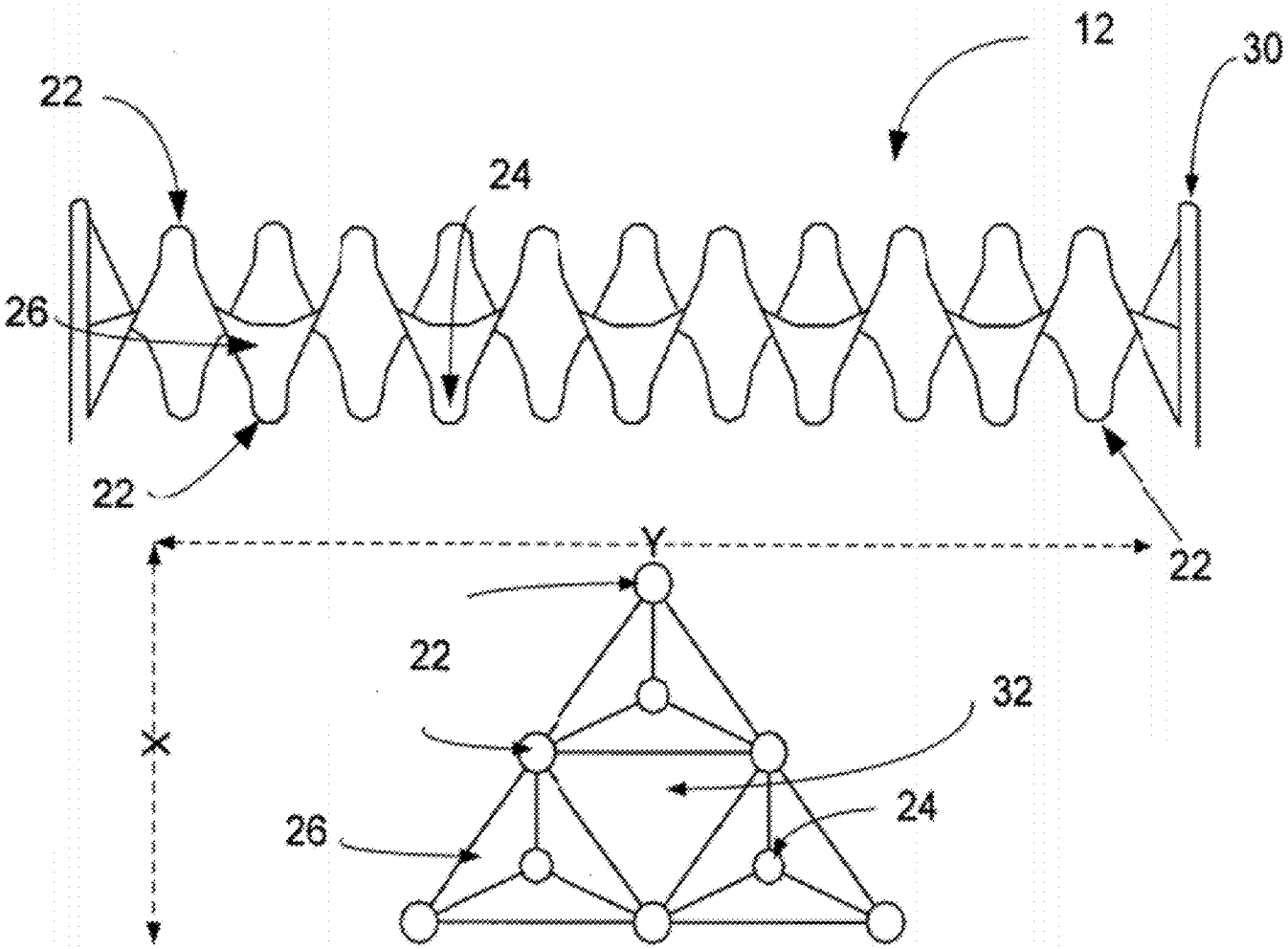
FIGS. 2A-2B are diagrams illustrating a side, cross-sectional view of an embodiment of core used in an embodiment of ballistic panel.

With reference now to FIG. 2A, shown is a cross-sectional view of an embodiment of core 12. As indicated in FIG. 2A, the cross-section is along the Y-axis of core 12 (see FIG. 1B above). The embodiment shown is a Tetrahedron- and Octahedron-like shape formed from a plastic sheet. The original design for the shape of core 12 is inspired by an octet truss shape from a renowned designer, Buckminster Fuller, used for structure and strength in many well-known buildings. An exemplary core 12 is seen in U.S. Pat. No. 5,266,379 issued to Schaeffer et al., which is hereby incorporated by reference (e.g., see element 14 in FIGS. 2 and 3 of Schaeffer et al.). Core 12 shown in FIG. 2A approximates the octet truss shape. Consequently, core 12 filled with ceramic layer 14 (e.g., bonded ceramic spheres 28) is able to withstand high foot pound pressure provided by explosions. As is discussed herein, core 12 also acts to absorb, translate and dissipate the force from a ballistic projectile impacting on ballistic panel 10. Some of the force of the ballistic projectile may be transferred from the projectile to ceramic layer 14 to core 12 and translated from the direction of impact outwards in node cell 26 of impact and along the alternating protrusions 22 and nodes 24 of core 12. For example, if the direction of impact generally is along the Z-axis perpendicular to ballistic panel 10, in a three-dimensional grid of X-Y-Z, some of the force may be translated in the plane formed by core 12 along the X- and Y-axes. This translated force may be dissipated into ceramic layer 14 on the non-impact side of core 12 and into the material on which ballistic panel 10 is mounted or into backing 20. Other shapes and materials for core 12 may be used if they provide the same or similar performance characteristics as core 12 illustrated here. For example, core may be made out of ceramics, titanium or other metals, composite materials, etc.

With continued reference to FIG. 2A, core 12 includes parallel rows of protrusions 22 and nodes 24. In the embodiment illustrated here, each row of protrusions 22 is offset from the next row of protrusions 22 so that where there is protrusion 22 in one row there is a gap between protrusions 22 in the next row. The rows of nodes 24 are similarly offset. The shape and size of nodes 24 may match ceramic spheres 28 (or other shape) used in ceramic layer 14.

Embodiments of core 12 may also include casting walls 30 around the outside of core 12. Casting walls 30 allow core 12 to contain ceramic layer 14 (e.g., ceramic spheres 28) and bonding media 16 (e.g., casting urethane) during casting of ceramic layer 14. In this manner, core 12 provides a self-contained casting unit for ballistic panel 10. As shown in FIG. 2A, casting walls 30 extend beyond the ends of protrusions 22 on both sides of core 12. Consequently, casting walls 30 enable the fabrication of ceramic layer 14 on both sides of ballistic panel 10.

Casting walls 30 may define the shape of ballistic panel 10. For example, if a square ballistic panel 10 is desired, casting walls 30 will be fabricated so as to form a square. If a triangular or circular ballistic panel 10 is desired, casting walls 30 will be fabricated to form triangle or circle. Casting walls 30 may be fabricated in any manner of two-dimensional shape desired (e.g., square, circle, triangle, rectangle, parallelogram, diamond, irregular shapes, non-symmetrical shapes, etc.). Consequently, ballistic panel 10 can be almost any manner of two-dimensional shape.

With continued reference to FIG. 2A, also shown is two-dimensional diagram providing a geometric representation of the spatial and geometric relationship between protrusions 22 and nodes 24 seen from one side of the embodiment of core 12 shown. As discussed above, in an embodiment of core 12, each node 24 is surrounded by three protrusions 22 when viewed from one side of core 12. In an embodiment, the three surrounding protrusions 22 form an equilateral triangle with the surrounded node 24 at the center point of the triangle (the lines connecting the surrounded node 24 with the each of the surrounding protrusions 22 in the diagram are equal in length). Therefore, the surrounded node 24 is equidistant from each surrounding protrusion. The triangle formed by the surrounding protrusions 22 also forms the area referred to above as node cell 26. As shown, the diagram in FIG. 2A only represents a portion of protrusions 22 and nodes 24 in core 12. Specifically, the diagram illustrates three triangles formed by protrusions 22 surrounding three nodes 24 in neighboring rows of nodes 24 and protrusions 22. Protrusions 22 at the "top" of the lower two triangles are the "base" protrusions 22 in the "top" triangle. Consequently, the three triangles themselves form one larger, equilateral triangle. The area between these two protrusions 22 and the "bottom" middle protrusion 22 of the larger triangle is also an equilateral triangle, inverted with respect to the other triangles. The area formed by this inverted triangle is node-less cell 32, since it does not include node 24. Ceramic layer 14 (e.g., ceramic spheres 28) will also fill this node-less cell 32. So filled, node-less cells 32 in core 12 will also act in stopping projectiles and translating force of projectiles impacting within each node-less cells 32.

Figure 2B:
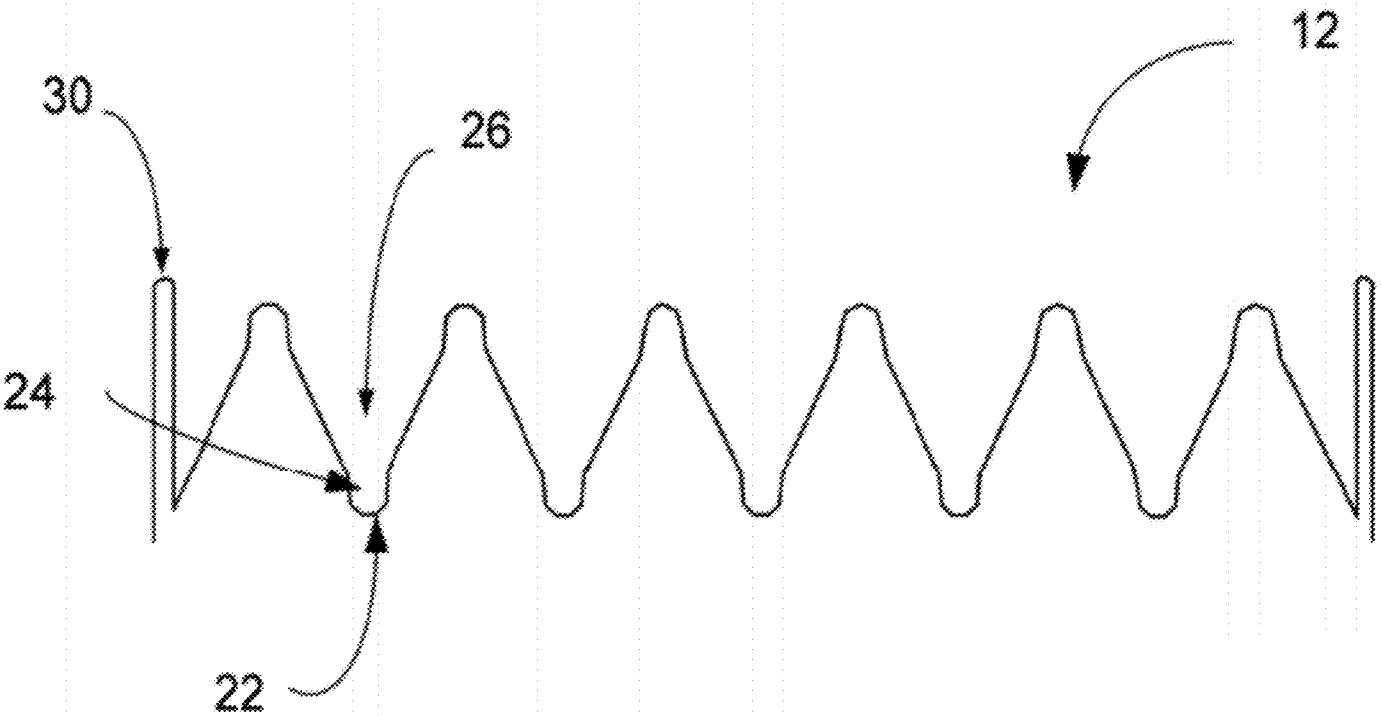

FIG. 2B illustrates a cross-sectional view of an embodiment of core 12 with opposing, alternating protrusions 22 and nodes 24. Core 12 shown here also includes casting walls 30, which are discussed above.

Figure 2C:
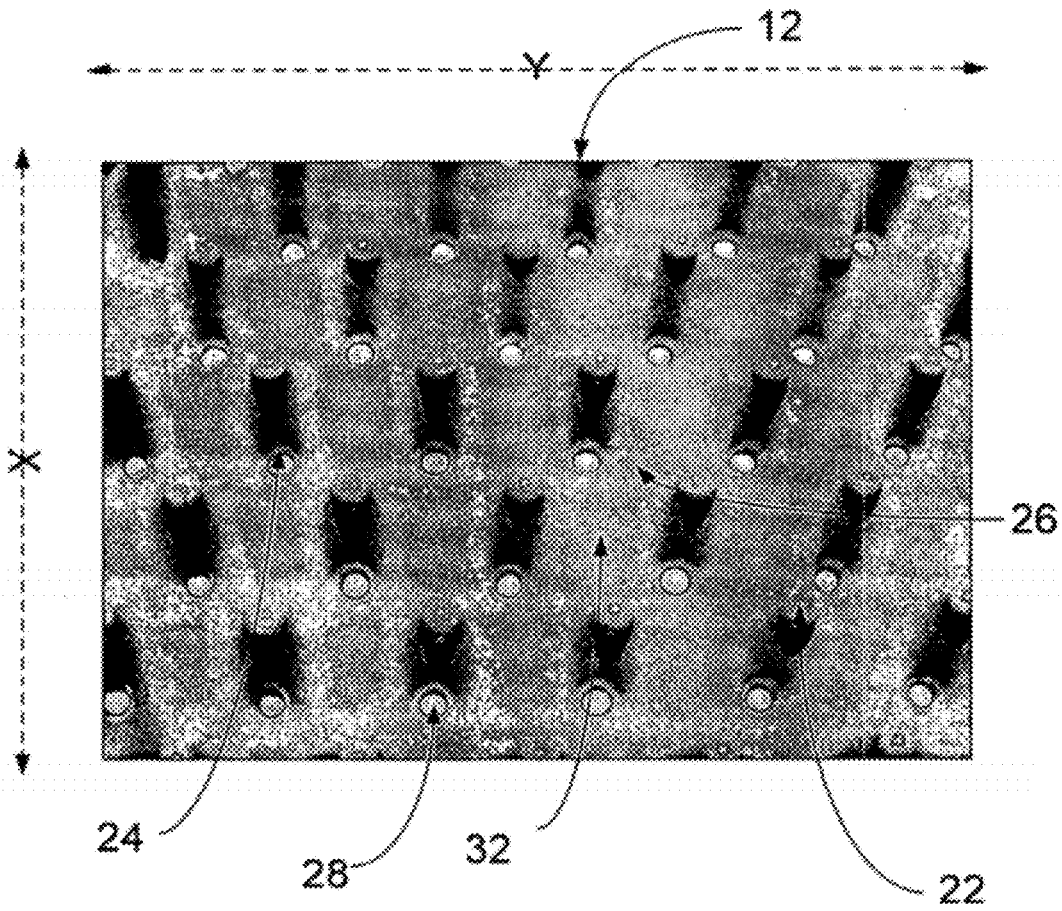
FIG. 2C is a partial top view of an embodiment of core used in an embodiment of ballistic panel.

With reference now to FIG. 2C, shown is a partial top view of an embodiment of core 12. The embodiment of core 12 shown in FIG. 2C is substantially the same as the embodiment illustrated by FIG. 2A. As seen, the embodiment includes parallel, offset rows of protrusions 22 and nodes 24, with each node 24 surrounded by three protrusions 22 that create node cell 26, as discussed above. Core 12 also include node-less cells 32. In the view shown in FIG. 2C, ceramic spheres 28 have been placed into nodes 24, illustrating the matching size of ceramic spheres 28 and nodes 24. The X-axis and Y-axis indicate the orientation of the view with respect to same X-axis and Y-axis described above.

Figure 2D:
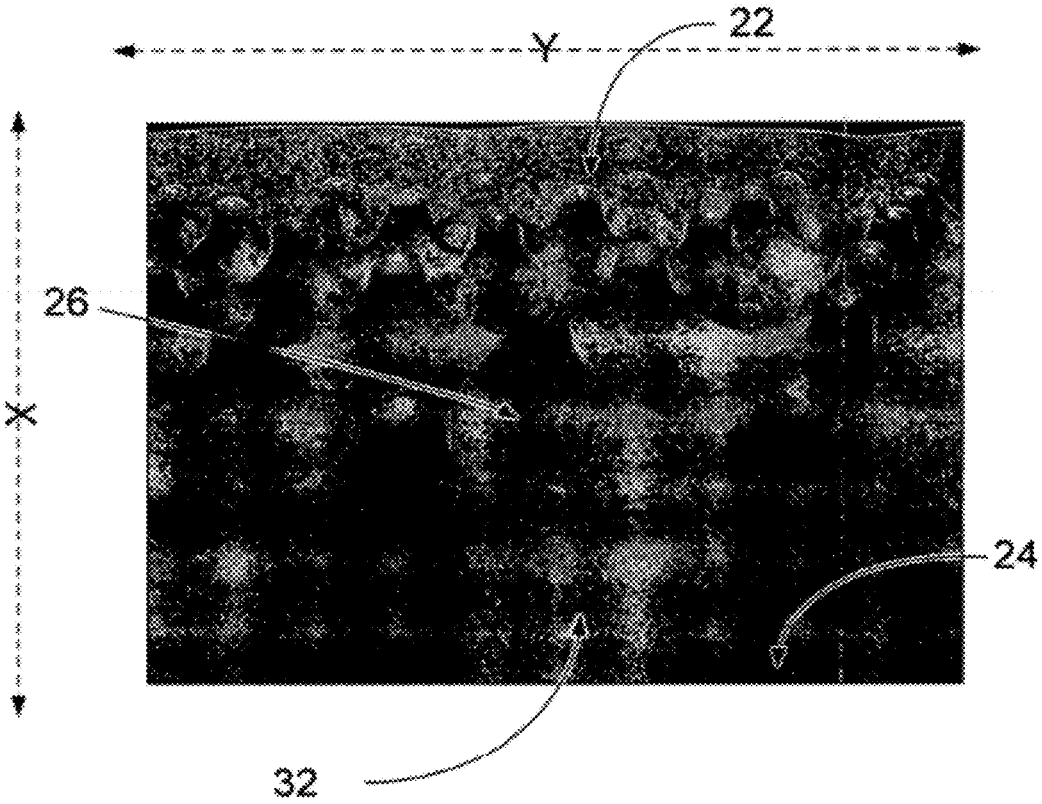
FIG. 2D is a partial top perspective view of an embodiment of core used in an embodiment of ballistic panel.

With reference now to FIG. 2D, shown is a partial top perspective view of an embodiment of core 12. The embodiment of core 12 shown in FIG. 2D is substantially the same as the embodiment illustrated by FIGS. 2A and 2C. As shown, core 12 includes protrusions 22, nodes 24, node cells 26, and node-less cells 32. Protrusions 22 and nodes 24 are configured in parallel, offset rows, as discussed above. The X-axis and Y-axis indicate the orientation of the view with respect to same X-axis and Y-axis described above.

It is important to note that core 12, e.g., as illustrated in FIGS. 1A-2D may be utilized without ceramic layer 14 and outer layer 18. Different media, such as sand, soil, water, etc., may be combined with core 12 in a variety of protective and structural applications. See below for further description of such applications.

While the concept behind most traditional armor is to laminate fibers and use steel or ceramic plates to slow down or deflect high velocity rounds, embodiments of ballistic panel 10 use a dual approach of first reducing the mass of the round by a chain reaction of ceramic spheres 28 within node cell 26 and then absorbing and translating the resulting shock with core 12.

This unique combination of materials and layers in ballistic panel 10 appears to work through a grinding action that grinds down the projectile, and the translation of the force of the projectile into multiple directions, creating a destructive circumstance. The ceramic layer 14 performs the grinding action, breaking apart the projectile and translating some of the force of the projectile into multiple directions. The grinding action appears to grind away the outer jacket of a round, exposing the lead within. The round is subjected to high friction and other forces and resulting high temperatures that turn lead into molten. Some of ceramic spheres 28 may break apart during impact and grinding of the projectile.

Core 12 may absorb and translate some of the force of the projectile and may contain the affects of the projectile's impact within node cell 26 (or node-less cell 32) of ceramic spheres defined by core 12. As discussed above, core 12 may transfer some of the force of the projectile to backing 20 and/or to the material on which ballistic panel 10 is mounted. Outer coating 18 seals ballistic panel 10 so that ceramic particles do not leak out. Outer coating 18 provide self-healing characteristics so that ballistic panel 10 that has been hit previously still provides superior protection. The giving, yet self-healing characteristics of outer coating 18 may also help prevent deflection of the projectile out of ballistic panel 10.

Embodiments of ballistic panel 10 may be used as a portable fighting wall, a ballistic shield for vehicles or aircrafts, perimeter guard post or when setting up a temporary base camp. Multiple layers of core 12 may be added for different threat levels. Likewise, multiple ballistic panels 10 may be stacked to increase protection. Furthermore, additional protective materials, such as steel or ceramic plate, may be combined with ballistic panels 10.

Ballistic panel 10 is ideal for vehicle protection, and can be easily attached to doors, passenger and driver compartments, cabs, roofs, etc., to provide protection. Ballistic panel 10 may be manufactured and molded in a variety of shapes, enabling it to be used, e.g., as flooring, walls, doors, vehicle seats, cargo area panels building blocks or bricks. Consequently, ballistic panel 10 may be molded in the shape of a vehicle (e.g., HMMV, truck, FMTV, etc.) door and be used to replace standard doors on the vehicle, providing greatly increased protection without significant added weight or cost. Likewise, ballistic panel 10 may be molded in the shape of vehicle seats, replacing standard vehicle seats and providing greatly increased protection without significant added weight or cost. Furthermore, ballistic panel 10 building blocks or bricks may be used to create armored buildings, bunkers, and structures that would be significantly more resistant to explosions (e.g., from suicide bombers), ballistic rounds, mortars, etc. Ballistic panel 10 may be manufactured as interlocking panels that can be joined together to form a seamless wall of protection. Other applications include security check points, modular walls and doors built from ballistic panel building blocks to secure sensitive areas in airports, nuclear facilities, fuel depots, government facilities, etc. First response vehicles, police vehicles, HAZMAT vehicles, and mobile command centers could be protected by ballistic panels 10.

Multiple ballistic panels 10 may be combined to form specific use structures. For example, ballistic panels 10 could be combined to form a "bomb-box" which is used to contain the blast from a suspected or known explosive device. The bomb-box would be a box (e.g., a hollow cube) formed by ballistic panels 10. The walls of the bomb box may be formed by ballistic panels 10. A bomb squad could drop the bomb-box on the explosive device and then wait for the explosive device to go off or trigger the explosive device, containing the explosion within the bomb-box. The bomb-box could include devices (straps, bolts, anchors, etc.) for securing the bomb-box to the ground.

It should also be noted that embodiments of ballistic panel 10 has sound-absorbing properties. The combination of materials, layers and structure in embodiments of ballistic panel act also to absorb sound. This is particularly useful to reduce the "clang" or "ringing" effect of explosions and projectiles, particularly within enclosed areas such as vehicles. These sonic effects can be very disorienting to soldiers, and therefore, are themselves battlefield hazards ballistic panel 10 can help to reduce.

Figure 3:
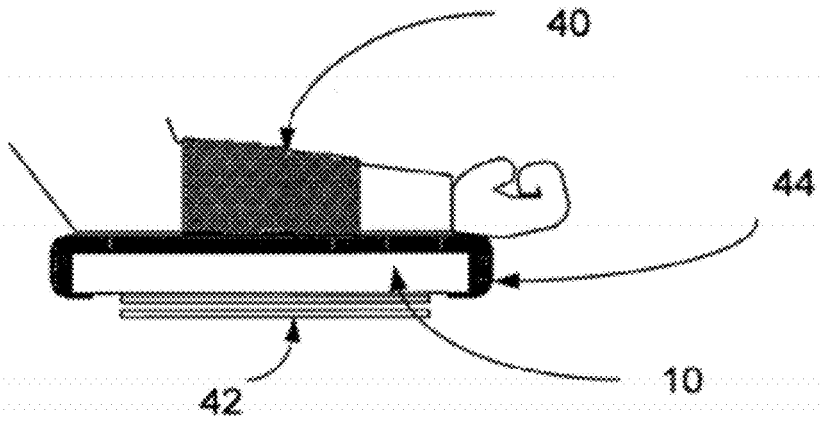
FIG. 3 is a diagram illustrating an exemplary seat/personal shield embodiment of ballistic panel.

With reference now to FIG. 3, shown is yet another implementation of ballistic panel 10. Ballistic panel 10 may include one or more straps or strapping 40 that enables a user to strap ballistic panel 10 to the user's arm, torso, leg, etc. In this manner, ballistic panel 10 may be used as a personnel shield. The embodiment of ballistic panel 10 shown here is intended for use as a seat, e.g., in a vehicle or airplane. Ballistic panel 10 seat may be attached to a seat frame with Velcro or some other attaching mechanism 42, as indicated in FIG. 3. The Velcro attachment 42 enables the user to easily and quickly remove ballistic panel 10 seat in order to use it as a personnel shield. This enables the user, e.g., to escape from a disabled vehicle with some amount of protection. Ballistic panel 10 seat also may include padding or padded cover 44 to increase comfort and usability as a seat.

Figure 4A:
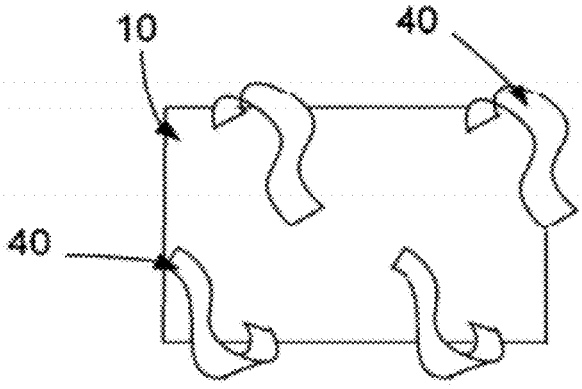
FIGS. 4A-4B and 5A-5B are diagrams illustrating an embodiment of ballistic panel with strapping.
Figure 4B:
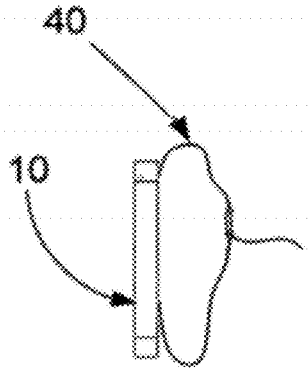

With reference now to FIGS. 4A-4B, shown is another implementation of ballistic panel 10. As discussed above, ballistic panel 10 may include one or more straps or strapping 40 that enables a user to strap ballistic panel 10 to the user's arm, torso, leg, etc. Strapping 40 may also be utilized to attach ballistic panel 10 to other things as well, such as vehicle parts, building parts, etc. FIG. 4A depicts a rear view of ballistic panel 10 showing two sets of un-connected straps 40. FIG. 4B depicts a side view showing one set of connected straps 40. Straps 40 may be connected in any known manner, including buckles, snaps, cinches, etc.

Figure 5A:
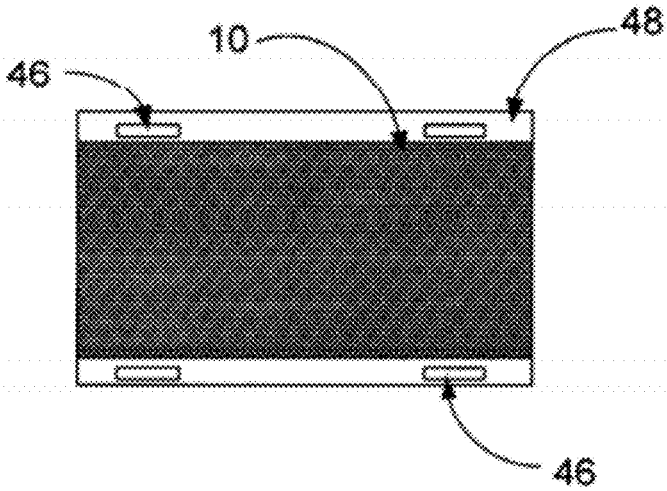
Figure 5B:
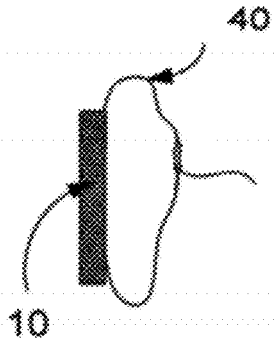

With reference now to FIGS. 5A-5B, shown is another implementation of ballistic panel 10 with strapping 40. In the implementation shown here, ballistic panel 10 includes slots 46 for affixing strapping 40 to ballistic panel 10. For example, slots 46 may be formed in ballistic panel 10 or ballistic panel 10 may be formed with extensions 48, e.g., strips of material (e.g., metal) extending from the sides of ballistic panel 10, with slots 46 formed in the extensions 48. FIG. 5A depicts a top view of ballistic panel 10 with extensions 48 and slots 46. FIG. 5B depicts a side view showing one set of connected straps 40 that are affixed to ballistic panel 10 through slots 46.

Figure 6:
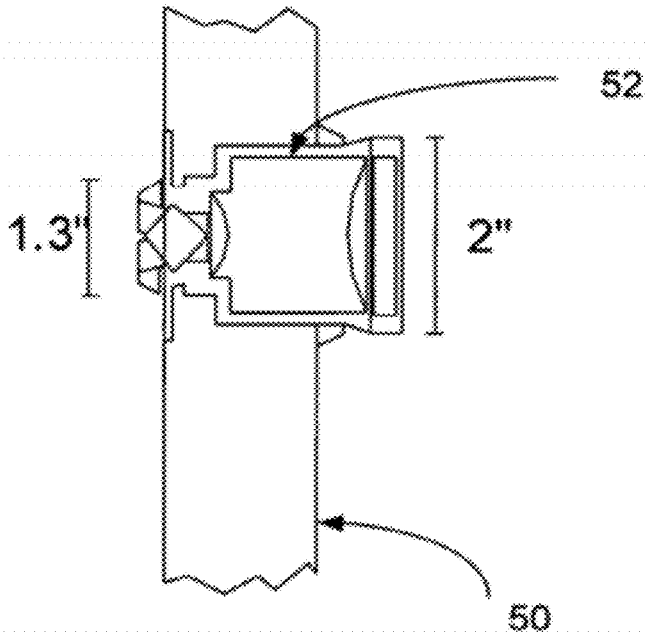
FIG. 6 is a diagram illustrating a door panel embodiment of ballistic panel with a viewer.

As discussed above, ballistic panel 10 may be used as a door or door panel. Similarly, ballistic panel 10 may be used as a wall or portion of wall. Often it will be necessary or desirous to be able to have some ability to see through a door or wall formed with ballistic panels 10. With reference now to FIG. 6, shown door panel 50 formed with ballistic panel 10. Formed within door panel 50 is viewer 52 that enables a user to look through door panel 50, e.g., to identify threats on the other side of door panel 50. In the embodiment shown, viewer 52 provides viewing up to 7' away with a 132 degree viewing angle. Viewer 52 is preferably made from material capable of withstanding impacts from projectiles and explosions. As shown, the viewer also preferably only presents a minimal area to the exterior of the door panel. In FIG. 6, this area is only ⅓" in diameter. The reciprocal eye piece shown is 2" in diameter. Viewers with different specifications may be used.

Ballistic panel 10 may also be manufactured from clear and/or semi-clear materials, such as clear plastic, ceramics and polymers that enable light to pass through ballistic panel 10. Such a construction may enable ballistic panel 10 to be used as windows or for providing natural light sources. This construction would enable, e.g., buildings constructed from ballistic panel 10 building blocks to have protected windows made from ballistic panel 10. Likewise, clear ballistic panels 10 may be combined with opaque ballistic panels 10 to form an entire wall with a window from ballistic panels 10.

Embodiments of ballistic panel 10 are remarkably successful in stopping high-velocity rounds. Testing has shown embodiments of ballistic panel 10 capable of stopping high-velocity full metal jacket rounds as well as armor-piercing rounds. So not only does ballistic panel 10 work extremely well in testing but it remains relatively lightweight, easy to assemble and the cost is well below anything else on the market.

Ballistic panel 10 can stop high velocity and withstand lower velocity fragmentation, shrapnel, and related explosive force, like in a case of RPG (Rocket Propel Grenade) low velocity high fragment. For blunt force impacts, core 12 appears to helps dissipate the load. By allowing ceramic layer 14 (e.g., ceramic spheres 28) to move independently within nodes 24 defined by core 12, core 12 helps to minimize damage to ballistic panel 10. Consequently, ballistic panel 10 can withstand multiple strikes in a small area.

Observation shows that embodiments of ballistic panel 10 appear to work in the following manner. A high-velocity round enters outer layer 18. Outer layer 18 absorbs some of the force of the round and applies some friction to the round, which helps to heat it up and slow it down. The elastic nature of outer layer 18 allows it to "self-heal" so that the hole left by the entry of the round is much smaller than the diameter of the round. This increases the durability and re-usability of ballistic panel 10.

After passing through outer layer 18, the round encounters bonded ceramic layer 14 (e.g., ceramic spheres 28). Bonded ceramic layer 14 absorbs and translates even more of the force of the round. In embodiments comprising ceramic spheres 28, which are often used for grinding and de-agglomeration, ceramic spheres 28 appear to grind the round. This grinding may grind off the outer layer or jacket (e.g., the full-metal jacket) of the round, creating great friction and resulting heat and exposing the inner portion (e.g., lead) of the round. The grinding appears to break up the round. The friction and heat appear to act to further slow down the round, disintegrating and possibly melting the round, particularly the generally softer inner portion. Melting the inner portion may cause the round to dissipate some, reducing its effective mass and enabling ceramic layer 14 and core 12 to further absorb the round's force, slow the round down, and eventually stop the round. The grinding and/or melting of the round may result in multiple pieces of the round, which are then re-directed upon impact with ceramic spheres 28. After being struck by a round, many of ceramic spheres 28 are broken, often crushed into a powder. Bonding media 16 helps to contain the broken and affected ceramic spheres 28, enabling broken ceramic spheres 28 to still be affective in stopping additional rounds and impacts and maintaining the integrity of ballistic panel 10.

Core 12 of ballistic panel 10 acts as a further force absorber and translator. Core 12 appears to act to help contain the force and effects of the penetrating round within an affected node cell 26 (or node-less cell 32) defined by a set of protrusions 22 of the Tetrahedron- and Octahedron-shape (e.g., the octet truss shape). When a round strikes ballistic panel 10, core 12 appears to help contain its affects to bonded ceramic spheres 28 in the area of node cell 26 (or node-less cell 32) struck by the round. Further, core 12 itself also appears to absorb at least some of the remaining, dissipated force of the round. Whatever remaining force of the round that makes it through core 12, if any, appears to be absorbed by bonded ceramic spheres 28 on the opposite side of core 12 and by backing 20 or the material on which ballistic panel 10 is mounted in much the same manner as described above.

As mentioned above, core 12 of ballistic panel 10 appears to play a significant role in absorbing and translating the force of lower velocity, fragmentary, shrapnel and explosive impacts, such as RPGs and roadside bombs. The size of ceramic spheres 28 appears to be directly related to the caliber of the round capable of being stopped by ballistic panel 10. In an embodiment of ballistic panel 10, the size and shape of core 12 of ballistic panel 10, particularly nodes 24 of core 12, are chosen so that ceramic spheres 28 fit tightly and well within nodes 24 of core 12—see, e.g., FIG. 2C. An embodiment of ballistic panel 10 may combine ceramic spheres 28 of varying sizes to enable ballistic panel 10 to effectively stop a variety of caliber rounds and projectiles of varying size and mass.

Issues and Some of the Variables that can be Modified for Different Applications:

- Self-healing outer layer 18—e.g., of any material with those characteristics
- Ceramic grinding media—e.g., of any material providing the similar characteristics for the application. E.g., Zirconium is denser but may be better for heavy armored applications. Note: These could be Buckey-balls or other geometries.
- Bonding material 16—e.g., of any material with the same characteristics
- Core 12—e.g., of any material providing the same characteristics as the plastic
- Shape—e.g., of any that fits the application and has the same dynamic and static characteristics
- Thickness—e.g., thin, medium, thick
- Density for different applications—e.g., Light, medium, heavy
- Proportional thickness of each layer—e.g., relative thickness of core 12, ceramic layer 14, and outer layer 18, and relative thickness of ceramic layer 14 on "threat" and "non-threat" side of core 12.

Figure 7:
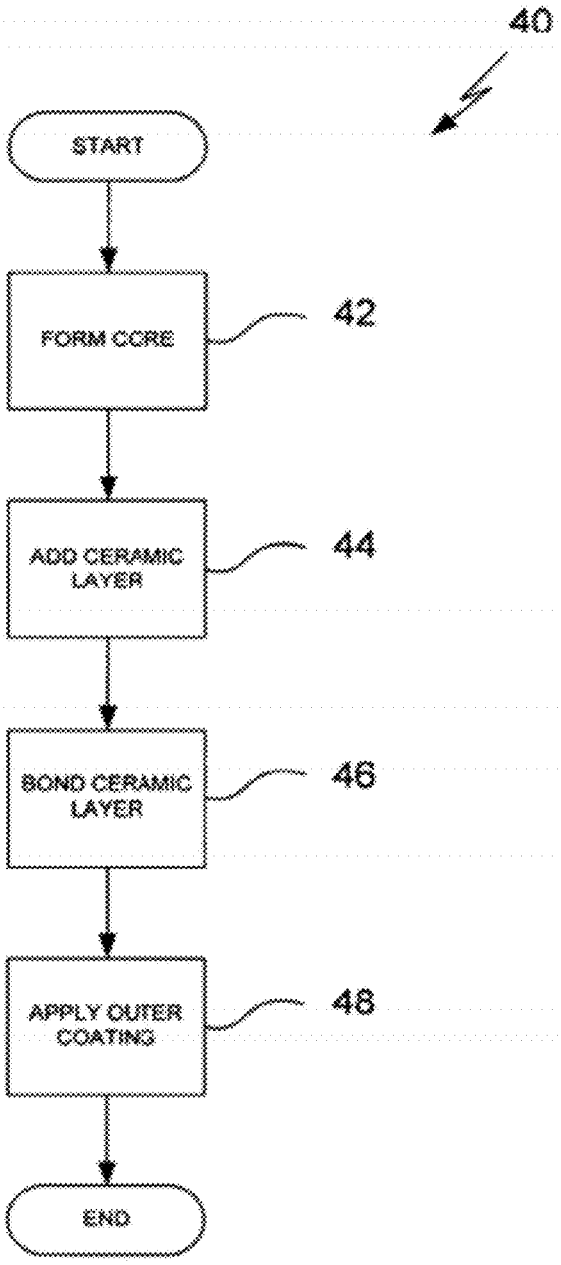
FIG. 7 is a flowchart of an embodiment of method of making ballistic panel.

With reference now to FIG. 7, shown is an embodiment of method 40 of making a ballistic panel. Embodiments of method 40 involve a fine balance of the all materials used, orientation of materials and the proper reaction timing. As shown, method 40 includes forming a core 12, block 42, adding ceramic layer 14, block 44, bonding ceramic layer 14, block 46, and applying outer coating 18, block 48.

Figure 8:
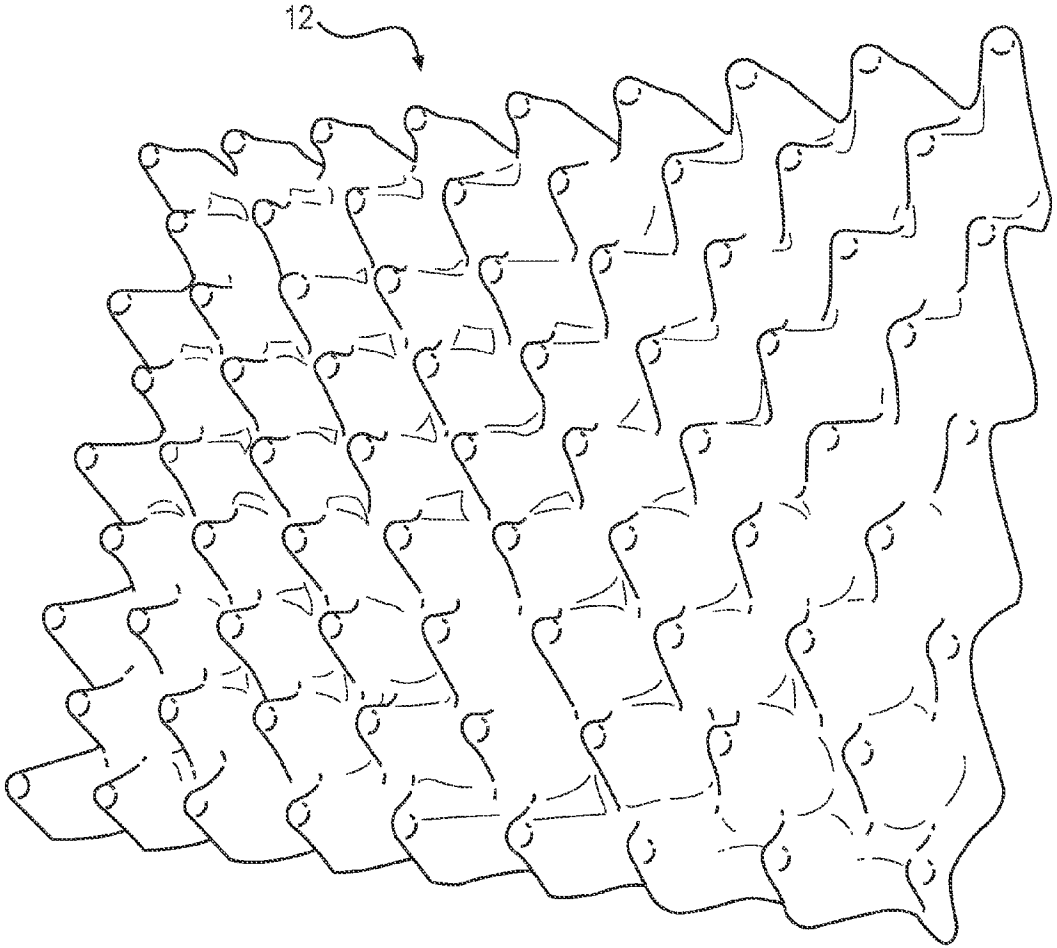
FIG. 8 is a perspective top view of an embodiment of core of ballistic panel.

Core 12 may be formed 42, for example, from a plastic sheet using known processes. For example, core 12 may be formed using mechanical thermoforming. For example, polycarbonate may be heated and then pressed between two plywood forms with pegs (other structures) placed, sized and shaped on the plywood form in order to form protrusions 22 on each side of core 12. The plywood forms may also include structures that form bonding walls 30. Other material for the forms may be used. Likewise, other material for core 12 may be used. Core 12 may also be formed by pouring core material into a pre-formed mold. Other processes for forming 42 core 12 processes such as injection molding, reaction injection molding, rotational molding, blow molding, vacuum forming, twin sheet forming, and stamping. Core 12 may be formed in whatever shape is desired for end application of ballistic panel 10. Numerous examples of such applications are provided herein. With reference now to FIG. 8, shown is a perspective view of an exemplary core 12 formed according to forming 42.

Figure 9:
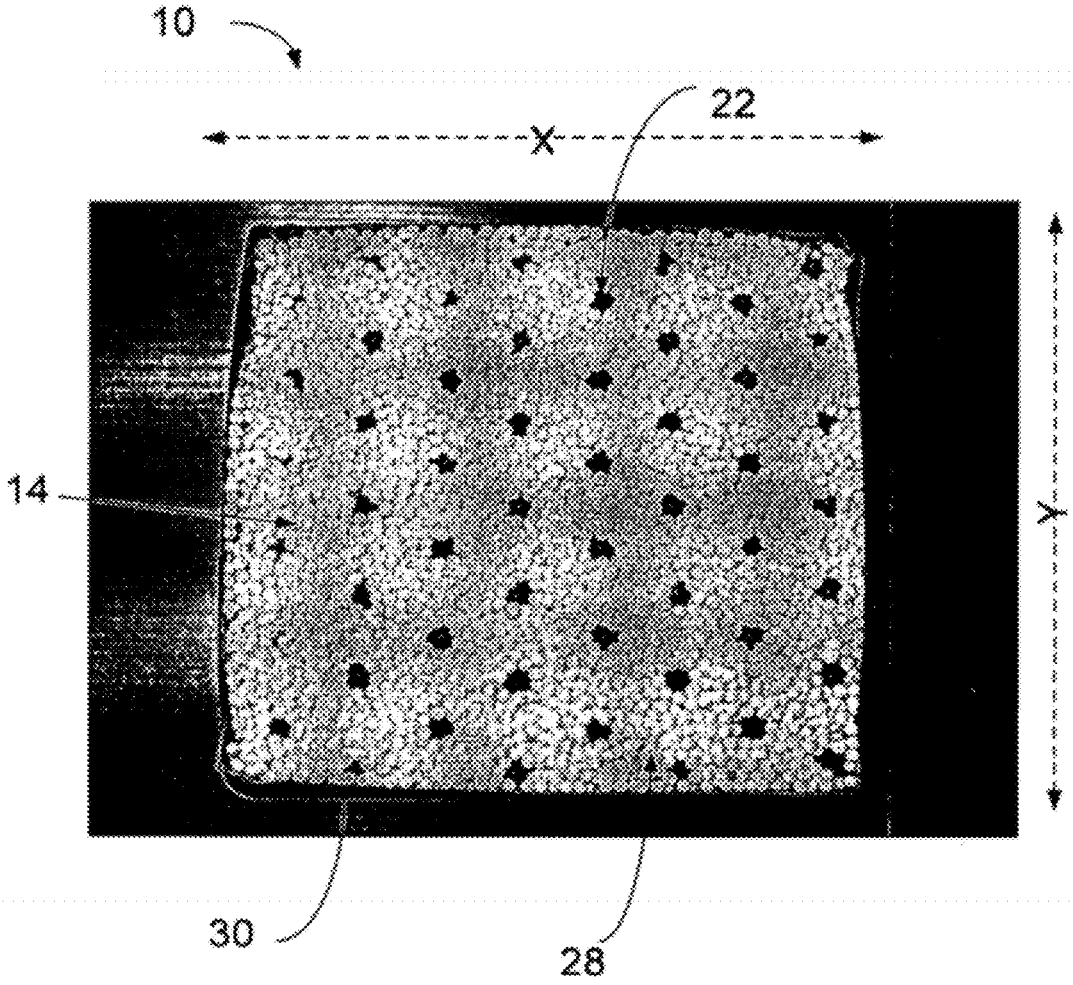
FIG. 9 is an illustration of a top view of an embodiment of core of ballistic panel filled in with an embodiment of ceramic layer.

Adding 44 ceramic layer 14 may include, for example, filing core 12 on both sides with ceramic spheres 28 so that ceramic spheres 28 fill in nodes 24, node cells 26, and node-less cells 32 in core 12. This may be done, for example, by pouring ceramic spheres 28 into and onto one side of core 12, applying a press or some other mechanism for keeping the poured ceramic spheres 28 in place, flipping core 12 over and repeating the process for the other side of core 12. In an embodiment, ceramic layer 14 snugly fills core 12 and covers all but the ends or tops of protrusions 22 on either side of core 12. With reference now to FIG. 9, shown is an embodiment of core 12 filled with ceramic layer 14 as a result of the adding 44. Other processes for adding ceramic layer 14 that achieve the same or similar results may be used.

Figure 10:
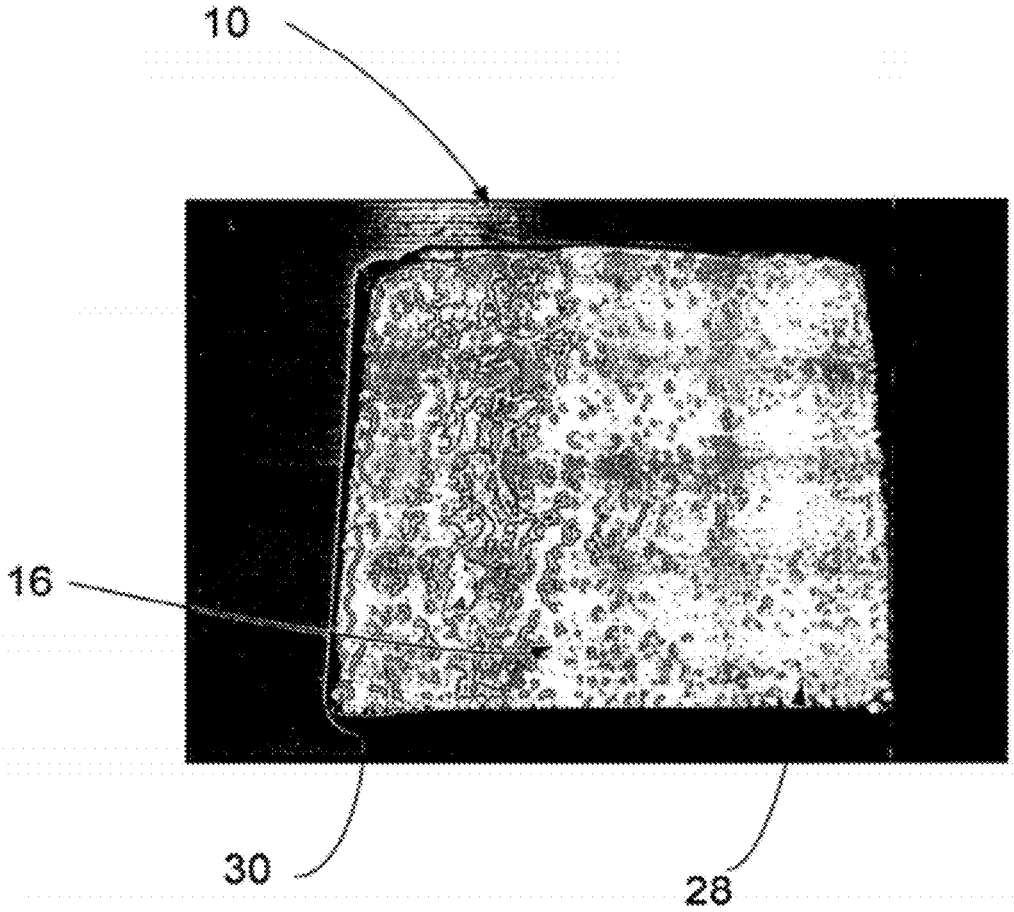
FIG. 10 is an illustration of a top view of an embodiment of core of ballistic panel filled in with an embodiment of ceramic layer and bonding media.

Bonding 46 ceramic layer 14 may include applying bonding media 16 to ceramic layer 14. This may be done, for example, by pouring a casting urethane into ceramic layer 14. Typical casting urethanes cure at room temperature, although heat may be introduced to speed up the curing process. The casting, bonding or encapsulated material that may be used for bonding media 16 provides a wide variety of hardness and performance. For example, PolyTeK EasyFlo™ 120 may be used. With reference now to FIG. 10, shown is an embodiment of ceramic layer 14 being bonded with a bonding media 16 during bonding 46.

Figure 11:
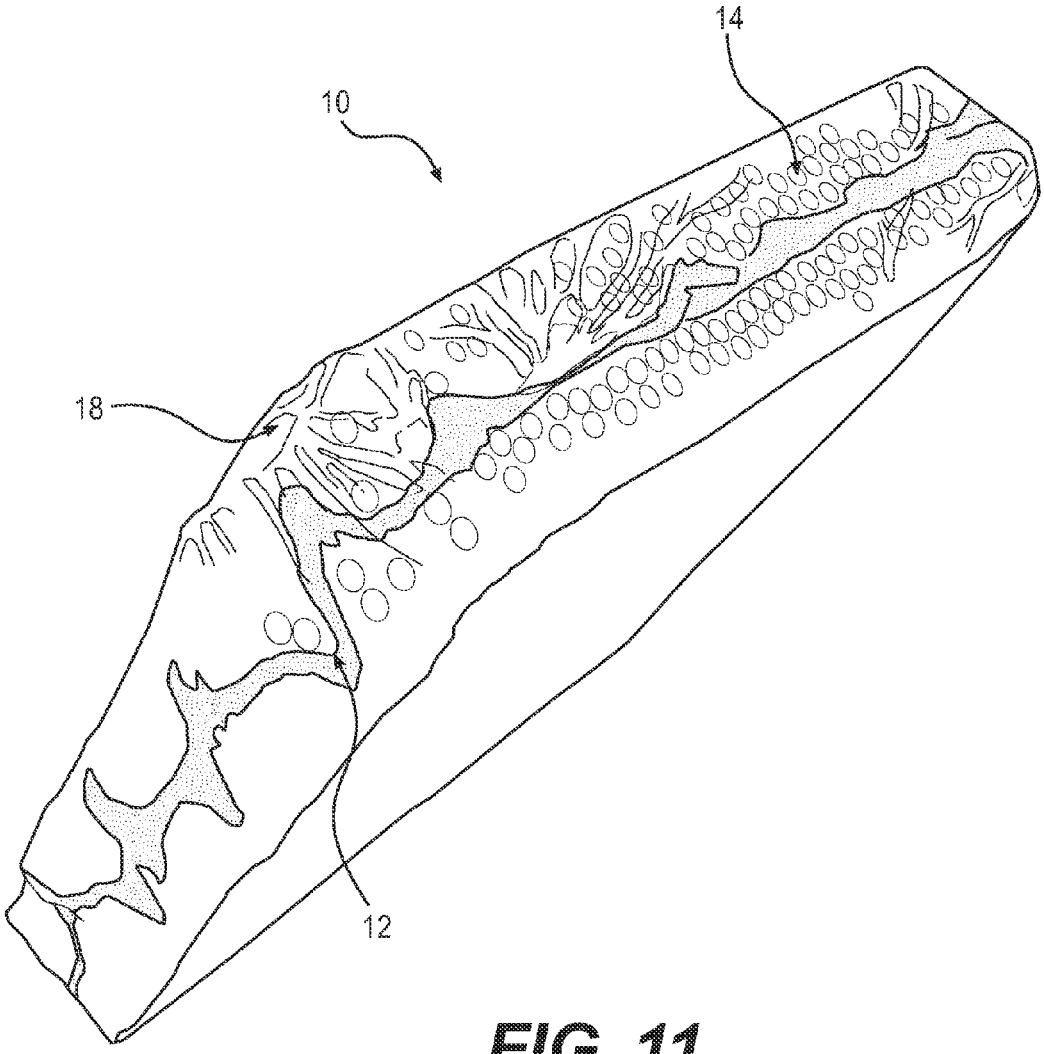
FIG. 11 is an illustration of a side perspective view of an embodiment of ballistic panel.
Figure 12A:
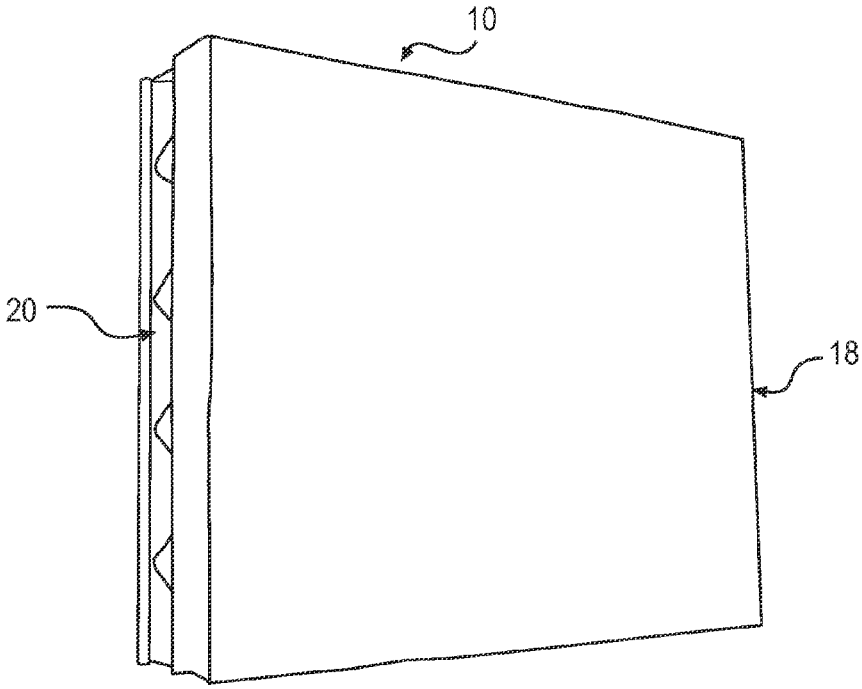
FIGS. 12A-12B are diagrams illustrating a perspective view of application of outer layer of an embodiment ballistic panel.
Figure 12B:
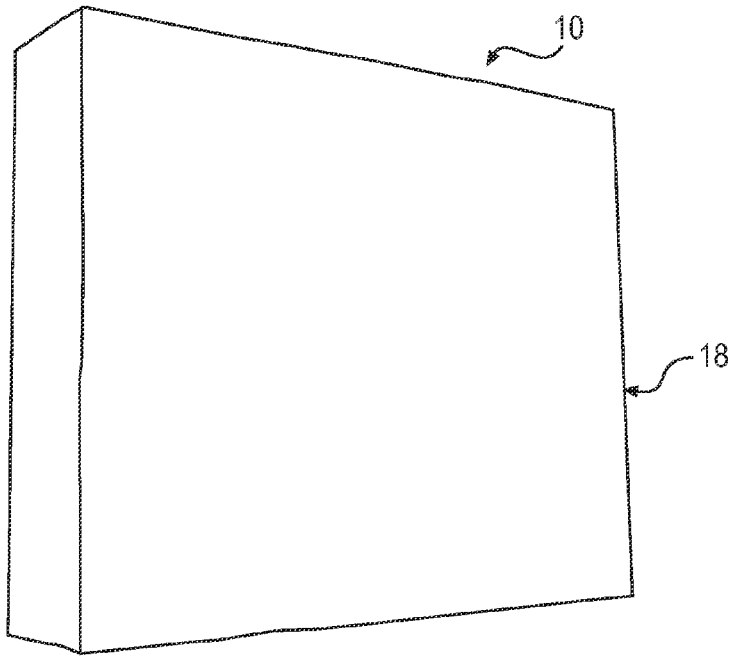

Applying 48 outer coating 18 may include applying a self-healing polymer onto the bonded ceramic layer 14. For example, outer coating 18 may be sprayed, dipped or cast. For example, in an embodiment, a truck bed liner (e.g., Rhinocast™) is sprayed on. Likewise, in an embodiment, outer coating 18 is applied 48 using two-component chemical processing system that includes pouring a polyurethane into a mold that becomes tack free in seconds. With reference now to FIG. 11, shown is an embodiment of ballistic panel 10 coated with a clear outer coating 18. With reference now to FIGS. 12A-12B, shown is an embodiment of ballistic panel 10 being coated with opaque outer coating 18. Backing 20 attached to ballistic panel 10 may be seen in FIG. 12A. FIG. 12B illustrates completed ballistic panel 10.

Method 40 of making ballistic panel 10 may also include attaching backing 20. Backing 20 may be attached to ballistic panel 10 using known means. For example, backing 20 may be attached to ballistic panel 10 with adhesives, straps, bolts or other attaching devices. The straps, bolts or other attaching devices may be bonded to ballistic panel 10 as part of bonding 46 and/or applying 48. For example, ends of bolts could be inserted into ceramic layer 16 and bonding media 16 may be poured into ceramic layer 16, bonding the bolt ends to ceramic layer 16. Outer coating 18 may then be applied 48 around and/or onto the protruding bolts.

FIGS. 8-12B graphically illustrate an embodiment of method 40 of making ballistic panel 10. As noted above, shown in FIG. 8 is an exemplary core 12. Core 12 may be formed 42 as described above. As discussed above and shown in FIG. 8, core includes protrusions 22 and cavities between protrusions 22, referred to as nodes 24. A ceramic layer 14 is then added 44, as shown in FIG. 9. In the embodiment shown, ceramic layer 14 is ceramic spheres 28. Ceramic spheres 28 fill in nodes 24, node cells 26 and node-less cells 32 (if any) in core 12, as shown, at least until only the ends of protrusions 22 are uncovered.

After ceramic layer 14 is added, ceramic layer 14 is bonded 46 (e.g., a bonding media 16 is applied), as illustrated in FIG. 10. As discussed above, bonding media 16 may be a casting urethane. The casting urethane bonds ceramic spheres 28 to each other to restrict movement and provide high density. In the embodiment shown in FIG. 10 bonding media 16 is applied so that it completely covers ceramic layer 14 and protrusions 22.

After bonding media 16 is applied, backing 20 may be bonded to the partially constructed ballistic panel 10, as illustrated in FIG. 12A. Backing 20 may be made from a variety of materials, including steel or other metals, wood, composite materials or ceramics. Backing 20 may be used to provide mounting or attaching mechanisms to ballistic panel 10, e.g., such as the strapping embodiments discussed above with reference to FIGS. 3-5. Backing 20 also provides additional force-absorbing properties when ballistic panel 10 is free-standing or not mounted on a material with sufficient force-absorbing properties.

Outer coating 18 is then applied 48 to ballistic panel 10, as illustrated in FIGS. 12A-12B. As discussed above, outer coating 18 may be a polymer layer. Outer coating 18 is designed to hold ballistic panel 10 together and provide self-healing characteristics. Outer coating 18 may cover the entire ballistic panel 10, as seen in FIG. 12B, or only a portion of ballistic panel 10 (e.g., just the front side). If a backing 20 is added, as shown in FIG. 12A, outer coating 18 may cover it as well.

Physics and observation may be used to explain how ballistic panel 10 works. Through calculating the momentum (energy=mass×velocity$^2$÷the coefficient) of different caliber bullets and physical testing, it was discovered that at the same distance two bullets with the same momentum penetrate differently. The bullet with smaller mass and higher velocity always penetrated further then a bullet with lower velocity and greater mass. Consequently, affecting the velocity of the bullet appeared to be important.

Through analysis, it was determined that a mass that acted more like a dense fluid would be more effective than layering materials on top of one another and new constrictions were made and tried.

Isaac Newton's first law of motion is often stated "An object at rest tends to stay at rest and an object in motion tends to stay in motion with the same speed and in the same direction unless acted upon by an unbalanced force." This means if the direction of an object in motion is changed, the speed of the object may be affected. Likewise, the more times the object changes direction the more the speed will be affected. It appears that this is what happens when a bullet hits ceramic spheres inside ballistic panel. The hardness, strength and the collective mass and density of ceramic layer is much greater then the bullet. Consequently, when the bullet enters ballistic panel, ceramic layer forces it to change direction. Within a microsecond ballistic panel has affected the velocity of the bullet by redirecting its path.

Isaac Newton's Third Law is formally stated as "For every action, there is an equal and opposite reaction." A force is a push or pull upon an object which results from its interaction with another object. Forces result from interactions. Some forces are the result of contact interactions (normal, frictional, tensional and applied forces are example of contact forces). According to Newton, whenever objects A (ceramic spheres) and B (bullet) interact with each other, they exert force upon each other. Therefore, the result is frictional force to one degree or another. The frictional force acts to slow down and re-direct the bullet.

This frictional force also produces intense heat. This heat appears to break the bullet apart. By breaking apart the bullet, the bullet's surface area is increased. Increasing the surface also increases the amount of contact interaction between objects A and B. Once the outer layer is stripped from the bullet, the intense heat appears to melt the softer lead interior, further reducing the overall mass of the bullet and breaking it apart. Core 12 appears to contain, absorb and dissipate any resulting force, including forces transferred from the bullet to ceramic layer 14.

The following describes further physics that explain how ballistic panel 10 works. A moving bullet that is about to hit an armor plate has a certain amount of kinetic energy. The job of the armor is to absorb this energy before the bullet penetrates the armor. In physical terms, in order for the armor to stop a bullet, frictional forces between the armor and the bullet must do work on the bullet whose magnitude equals the kinetic energy of the bullet. From elementary physics:

work=force*(distance traveled by the bullet)

The more work the armor can do on the bullet, the more kinetic energy it can absorb. Clearly, work can be increased if you can increase the frictional force, or increase the distance the bullet travels, or both. Obviously the distance can be increased simply by making the armor thicker.

Figure 37:
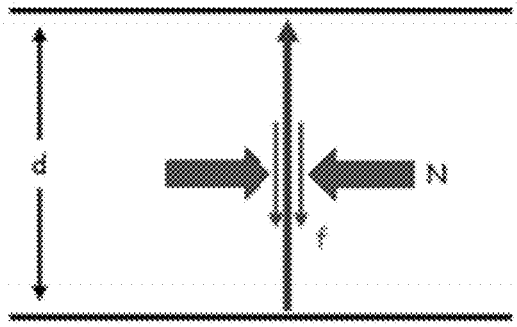
FIG. 37 illustrates a bullet entering a piece of armor.

FIG. 37 illustrates the situation where a bullet enters a piece of conventional armor. It is assumed that the bullet goes straight, and is brought to a complete halt after traveling a distance "d", which is the thickness of the armor. The thin arrow pointing up is the path of the bullet; the thick arrows labeled "N" represent the force of the armor against the case of bullet. Note that these are perpendicular ("normal") to the casing of the bullet. The short, thin arrows pointing down are the force of friction. Recall that the normal force is what gives rise to the friction force, the magnitudes of these forces being related by the coefficient of friction "μ" between the two materials: f=μN. Since the magnitude of the work done on the bullet by the frictional force is the same as the original kinetic energy of the bullet, a simple equation can be set up to find the thickness "d" that is needed to prevent penetration:

$$fd = \frac{1}{2}mv^2 \rightarrow d = \frac{mv^2}{2f} \quad |\text{"}m\text{"} = \text{mass of the bullet}|$$

Alternatively, the equation on the left can be solved for the maximum velocity of a bullet that could be stopped by a thickness "d" of the armor:

$$v = \sqrt{\frac{2fd}{m}}$$

or, the equation can be solved for the biggest mass that could be stopped by that thickness:

$$m = \frac{2df}{v^2}$$

In either case, the formulas show that if either "d" or "f" is made larger a faster bullet of a given mass can be stopped, or a heavier bullet traveling at a given speed can be stopped.

Now imagine that the armor could change the direction of the bullet immediately after the bullet pierces the outside.

Figure 38:
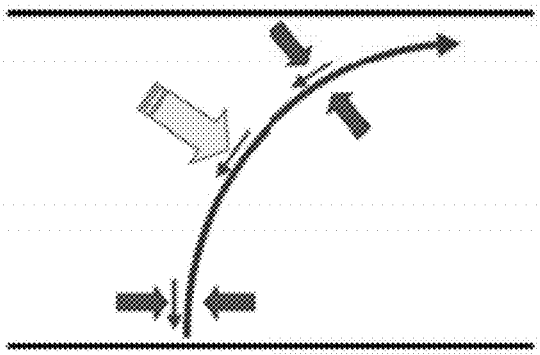
FIG. 38 illustrates that an armor changes the direction of a bullet immediately after the bullet pierces the outside of the armor.

FIG. 38 shows a simplified situation: the bullet follows the arc of a circle whose radius is the thickness of the armor. Clearly, the distance that the bullet travels along the arc is greater than the thickness (about 1.57 times greater in this simplified case). Thus, forcing the bullet to change its direction is accomplishes the goal of increasing "d".

As before, the normal forces give rise to the friction forces. However, because the bullet is now traveling in a circular path, we need to consider the effect of the centripetal force (indicated by the large arrow). Centripetal force is always present for circular motion, and is directed to the center of the circle. From the diagram, we can see that this extra force is also perpendicular to the bullet's direction. Thus, there is another source of frictional force: "f" has been increased.

In the case of ballistic panel 10, there may be multiple changes of directions affected on the bullet by ceramic layer 14. Each change of direction may cause a further frictional force to be exerted on the bullet, helping to slow it down further.

The following is an exemplary description of how an embodiment of ballistic panel 10 works. A high-velocity bullet approaches ballistic panel 10 and penetrates outer coating 18 of ballistic panel 10. At impact, bullet's path is perpendicular to ballistic panel 10. The bullet impacts ceramic spheres 28 that make up ceramic layer 14 in this embodiment. Bonding media 16 reduces the displacement of ceramic spheres 28 away from the bullet. Some of ceramic spheres 28 break up on impact. Ceramic spheres 28 begin to grind the bullet as the bullet on impact. As described above, a significant frictional force is generated due to these impacts.

Outer coating 18 seals up behind the bullet as the bullet completely penetrates outer coating 18. As explained above, this is due to the elastic nature of outer coating 18. This self-healing helps to contain ceramic spheres 28, enabling ballistic panel 10 to withstand multiple hits to the same area.

The frictional force generated by the impacts of the bullet with ceramic spheres 28 generates extreme heat. The heat and the frictional force act on the bullet to break apart the jacket of the bullet, exposing the softer, lead inner layer of the bullet. As a result of these forces, the path of the bullet may no longer be perpendicular to ballistic panel 10. In other words, forces exerted on the bullet may change its direction.

The continuing frictional forces being exerted on the bullet generate greater and greater heat. This heat melts the softer, lead inner layer of the bullet. As the bullet penetrates further into ballistic panel 10, it may continue to change direction and to further dissipate as the lead is turned molten. Core 12 appears to contain the affects of the bullet within the affected node cell 26 of core 12. Force is transferred to core 12 from ceramic layer 14. This force transfer further dissipates the force of the bullet, as the force is communicated along the structure (protrusions 22) of core 12, to ceramic layer 14 on the non-impact side of ballistic panel 10, and to backing 20 or the material on which ballistic panel 10 is mounted. The remnants of the bullet may come to rest in node cell 26 of core 12. These remnants and the broken apart ceramic spheres 28 are contained within node cell 26 by bonding media 16 and the self-healed outer coating 18.

Figure 13A:
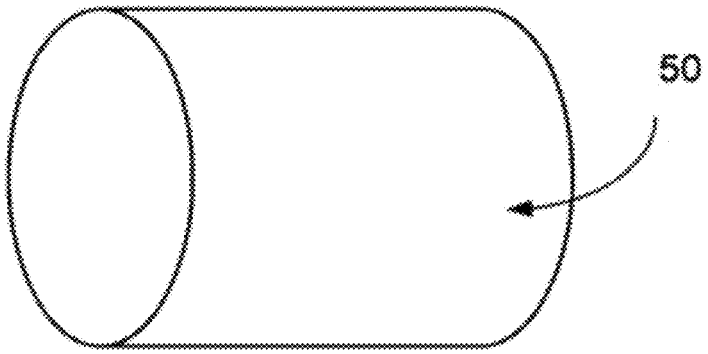
FIGS. 13A-13C are diagrams illustrating an embodiment of ceramic layer and corresponding core of ballistic panel.
Figure 13B:
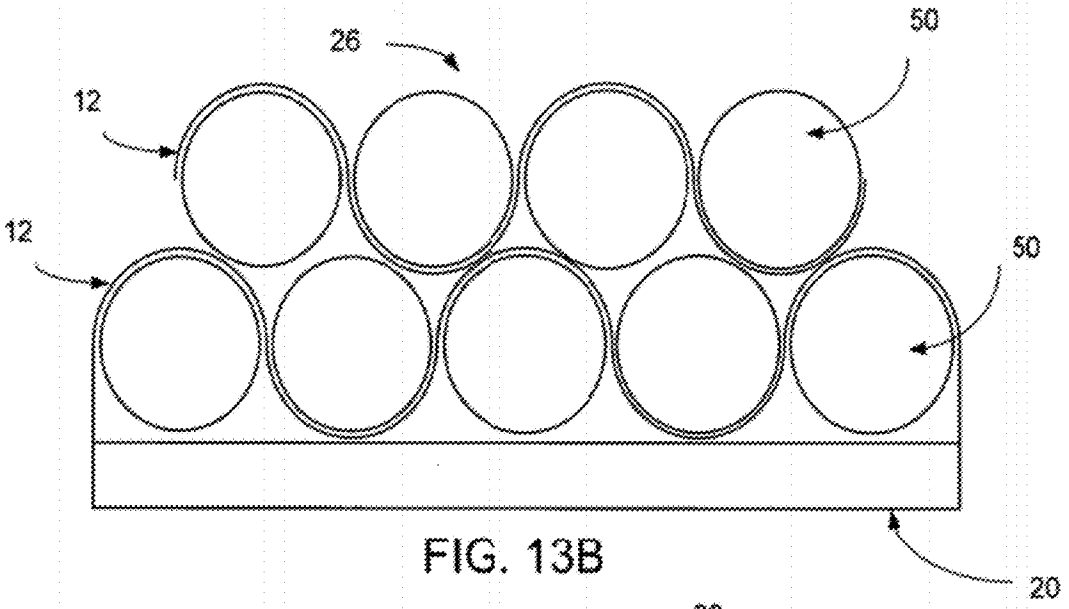
Figure 13C:
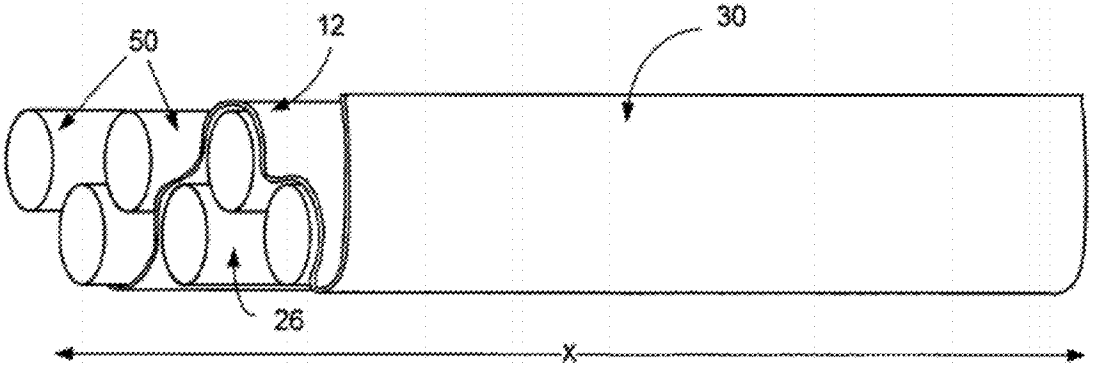

As discussed above, ballistic panel 10 may comprise a variety of size and shape cores 12 and ceramic layers 14. Similarly, ceramic layer 14 may include a variety of size and shape ceramic shapes (ceramic components). With reference now to FIGS. 13A-13C, shown are alternative embodiments of ceramic layer 14 and core 12. FIG. 13A illustrates a cylinder-shaped ceramic component or ceramic cylinder 50. When used with certain cores 12, ceramic cylinders 50 enable more efficient stacking and packing of ceramic layer 14, with minimal wasted space. As noted above, ceramic layer 14 is not limited to particular ceramic shapes, but may be a variety of shapes chosen to best fit applications of ballistic panel 10.

FIGS. 13B and 13C illustrate cores 12 designed to be used with ceramic cylinders 50. As noted above, core 12 is not limited to specific tetrahedron- and octahedron-like shapes or specific octet-truss shapes. Core 12 may be modified to work with ceramic cylinders 50 and other non-spherical ceramic shapes. Core 12 should be designed so that it distributes force well, provides substantial structural strength when incorporated in ballistic panel 10, and contains ceramic layer 14 and affects of ballistic projectiles and explosive forces incident on ballistic panel 10. In other words, core 12 shape may be modified so long as ballistic panel 10 incorporating core 12 performs as described herein.

With specific reference now to FIG. 13B, shown is a cross-section view of stacked layers of ceramic cylinders 50 and two corresponding cores 12 configured to be used with ceramic cylinders 50. As shown, core 12 is shaped so that a grinding layer of one ceramic cylinder 50 diameter fits within each core 12 row 26 (with a plurality of ceramic cylinders 50 positioned end-to-end in the row 26). Each ceramic cylinder 50 may tightly fit or pack within node 24 of core 12. Alternatively, core 12 may be shaped so that a plurality of ceramic cylinders 50 may fit within each node cell 26. FIG. 13B illustrates how ceramic cylinders 50 and corresponding cores 12 may be used to stack multiple cores 12 and ceramic layers 14 within one ballistic panel 10. This stacking provides significant flexibility and increased applications for the end use ballistic panel 10. Also shown is backing 20. Outer layer 18 may be applied to the combination of cores 12, ceramic layers 14 and backing 20 shown in FIG. 13 to create a single ballistic panel 10. Ballistic panel 10 may also comprise multiple ceramic layers 14 stacked with a single core 12.

With specific reference now to FIG. 13C, shown is a partial perspective cross-section view illustrating a single layer of core 12 and ceramic cylinders 50. In the embodiment shown, multiple ceramic cylinders 50 pack snugly within node cell 26 of core 12. Each ceramic cylinder 50, and hence node cell 26, may extend the full length of core 12 in the shown direction X. Alternatively, core 12 may be configured to include multiple node cells 26 in the direction X. In other words, core 12 may shaped in an octet-truss like shape accepting ceramic cylinders 50. In this alternative embodiment, ceramic cylinders 50 would not extend in the direction X the length of core 12, but would rather only extend in the direction X a length sufficient to fit nodes 24 and node cells 26. As shown in FIG. 13C, core 12 also forms casting walls 30. Only a portion of core 12 is shown here.

Not only is core 12 not limited to specific tetrahedron- and octahedron-like shapes or specific octet-truss shapes, but core 12 is not limited to a rigid form either. Packing of nodes 24 and node cells 26 of core 12 closer together permits a greater flexibility of core 12. For example, if node-less cells 32 are eliminated from core 12, nodes 24 and node cells 26 are packed closer together. This closer node cell 26 packing enables core 12 to be flexible and bendable (more flexible materials for core 12 may be chosen to increase flexibility and bendability). The embodiments of core 12 shown in FIGS. 13B-13C for use with ceramic cylinders 50 may be more flexible and bendable because of closer packed node cells 26 and an absence of node-less cells 32.

A flexible and bendable core 12, in turn, permits ballistic panel 10 to be configured and molded as rounded or curved shapes. For example, ballistic panel 10 may be configured as a cylinder or even a cone-like shape. Ballistic panel 10 may be molded to fit around curved surfaces, such as curved vehicle panels or other curved structures. Enabling ballistic panel 10 to be rounded and curved increases possible applications of ballistic panel 10 many-fold. The following is a description of one such novel application utilizing a rounded and curved ballistic panel 10.

Figure 14A:
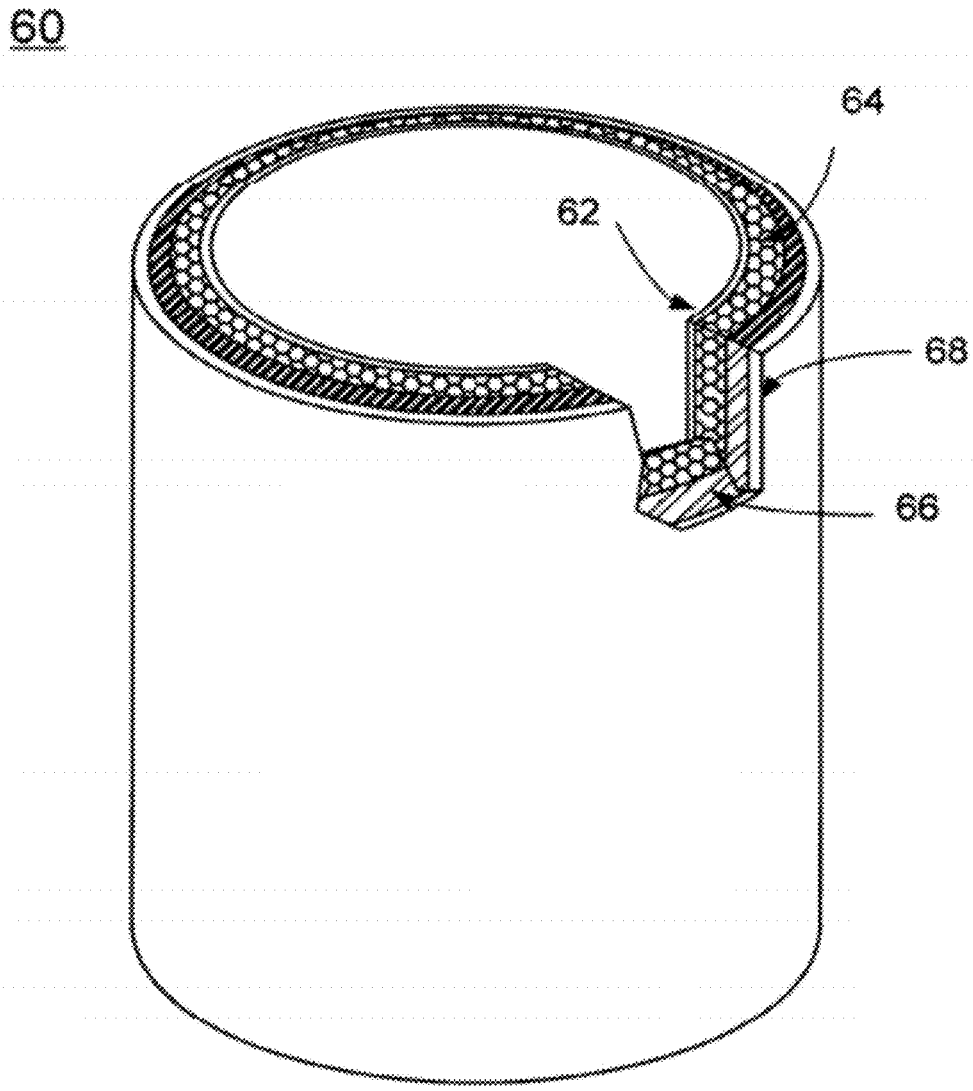
FIGS. 14A-14B are diagrams illustrating an embodiment of a secure can including ballistic panel.
Figure 14B:
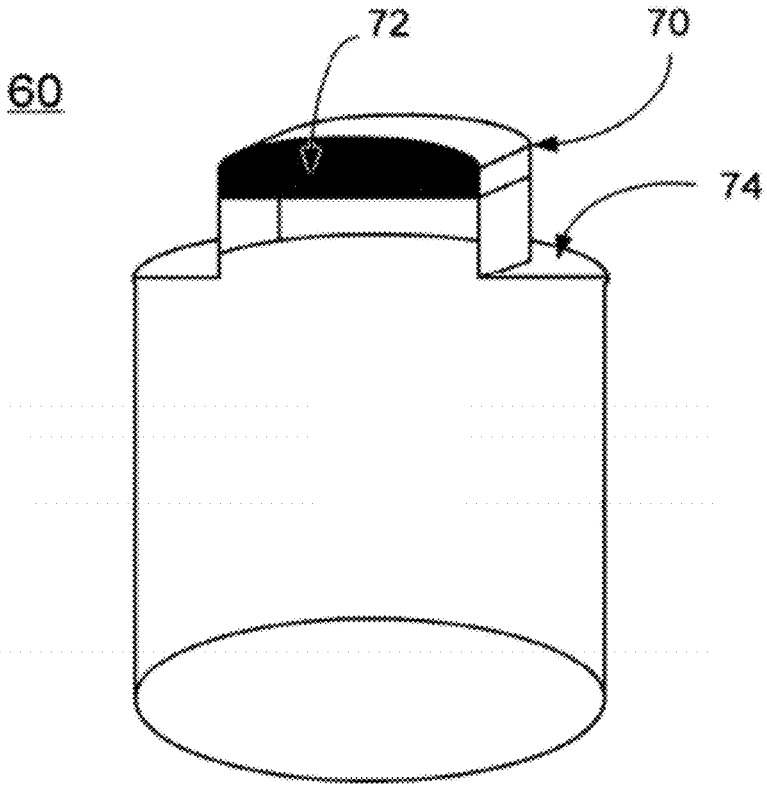

With reference now to FIGS. 14A-14B, shown are cross-sectional views of secure can 60, which may incorporate a curved ballistic panel(s) 10. Protecting public locations has become an international problem. Explosive devices placed in public trash receptacles are a major public safety threat. Officials have tried removing public trash cans or replacing them with bulky concrete structures but this has caused other issues such as trash being left on the street or difficulty in removing trash from the bulky concrete receptacle (in some cases a crane is needed).

Secure can 60 can be used in any public place as an effective containment device. Secure can 60 looks like an ordinary trash can and can be easily emptied. However, if a bomb is placed in secure can 60, the ballistic panel 10 and core 12 technology minimizes the effects of any explosion, absorbing the resulting force. Secure can 60 is designed specifically for blast suppression, trapping fragments and reducing overall heat and dust fallout. As an option, secure can 60 may include a Nuclear-Biochemical-Chemical ("NBC") decontaminate stored in its lid and/or walls that would be released at the point of detonation. NBC decontaminate may be a liquid, powder, or other solid decontaminate formulated to decontaminate nuclear, biological and/or chemical agents released by an explosion. NBC decontaminates are known to those of skill in the art; one decontaminate is chlorine dioxide. The energy from a blast would launch the decontaminate.

With references to FIG. 14A, shown is partial cross-sectional perspective view of secure can 60. The view shows a cross-section of the walls of secure can 60. As shown, secure can 60 walls comprises inner liner 62, curved ballistic panel 64, an optional NBC decontaminate layer 66, and outer layer 68. Secure can 60 preferably also comprises lid (see FIG. 14B) and trim ring (see FIG. 14B). The base or foot of secure can 60 may also comprise inner liner 62, ballistic panel 64, an optional NBC decontaminate layer 66 and an outer layer 68. The base may be formed as part of the walls or separately and later attached to walls.

Inner liner 62 may be made out of polyethylene or other similar and appropriate material. Curved ballistic panel 64 may include one or more tetrahedron-shaped core(s) 12 in any shape, bent or flexed in a cylinder and ceramic layer 14 or other filler (e.g., sand or ceramic spheres 28). Curved ballistic panel 64 may include a single core 12 that extends the full height of secure can 60 all the way around circumference of secure can 60. Alternatively, curved ballistic panel 64 may include multiple cores 12, extending around circumference of secure can 60, stacked vertically on top of one another to match height of secure can 60 or multiple cylindrical cores 12 that only extend part way around circumference of secure can 60. Core 12 may be made out of ABS plastic. Core 12 may be filled in with ceramic layer 14, as described herein, or with another readily available filler such as sand. In FIG. 14A, core 12 is filled in with ceramic layer 14. Outer layer 66 may be made out of polyethylene or other similar and appropriate material. NBC decontaminate layer, if included, may include a NBC decontaminate that is placed between curved ballistic panel 64 and outer layer 68. NBC decontaminate layer may be a liquid, powder, or other solid decontaminate formulated to decontaminate nuclear, biological or chemical agents released by an explosion.

After assembly, inner liner 62, curved ballistic panel 64, NBC decontaminate 66, and outer layer 68 may be coated with an elastomeric, expandable, polyurethane, solvent free 100% solids polymer layer (e.g., a Rhinocast™ truck bed liner product) similar to outer coating 18 described above. This polymer layer can be successfully sprayed on in an even layer and provides ideal results. Other materials may be used that provide the same or similar performance, such as other two component chemical processing systems that include pouring a polyurethane into a mold that becomes tack free in seconds. Trim ring covers the top of inner liner 62/outer layer 68 so they are not visible and may be made out of ABS plastic.

With reference now to FIG. 14B, shown is a partial cross-sectional view of secure can 60. This view shows only a cross-section of lid 70, not a cross-section of receptacle portion of secure can. Shown is lid 70 on top of secure can 60. Lid 70 is placed on top of secure can 60 (on top of trim ring 74) and may be made out of polyethylene and can incorporate additional features. For example, lid 70 may include NBC decontaminate layer 72. As mentioned above, NBC decontaminate layer may be a liquid, powder, or other solid decontaminate formulated to decontaminate nuclear, biological or chemical agents released by an explosion. Secure can 60 is preferably configured to direct explosive blast upwards through lid 70. NBC decontaminate layer 72 may be activated by explosive blast directed upward through lid 70 and may decontaminate and NBC materials contained in blast. Lid 70 may also include ballistic panel (not shown) to further contain and reduce affects of blast.

Lid 70 with NBC decontaminate layer 72 is a unique combination of features itself. Lid 70 may be incorporated into other secure trash cans and receptacles other than secure can 60. In other words, lid 70 may also be used with trash cans that use means other than ballistic panel 10 to contain an explosive blast (e.g., concrete, steel, etc.). Since most secure trash cans and receptacles are configured to shape explosive blasts upward, lid 70 may be quite useful in decontaminating any NBC elements in such blasts.

As discussed above, ballistic panel 10 may be used in a variety of applications. Among the many possible applications is the use of ballistic panels 10 as building blocks or as components of building blocks or other structural components used in constructing structures. Ballistic panel 10 technology may be adapted for building structures, protecting government facilities, airports and important landmarks. Such applications may incorporate ballistic panels 10 configured as described above with core 12, ceramic layer 14, bonding media 16, and outer coating 18. Other applications may incorporate ballistic panels 10 that comprise core 12 alone with some filler (e.g., sand, other ceramic media, fine-particle clay, etc.) that is easily applied in the "field" (e.g., in a war zone, security zone, rapid-deployment area, etc.) by, e.g., soldiers or security personnel. Such applications may provide for adding outer coating 18 in the field as well.

Figure 15A:
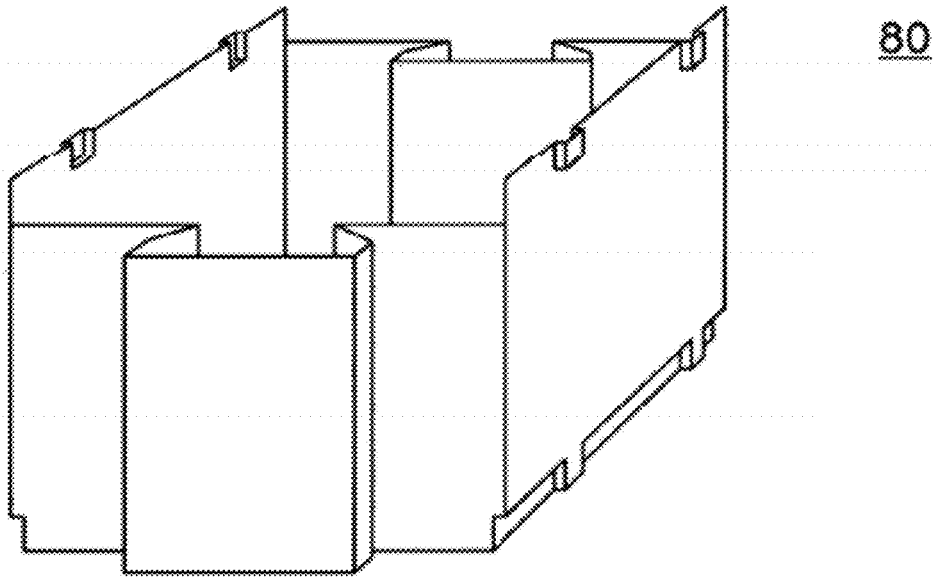
FIGS. 15A-15D are diagrams illustrating an embodiment of building blocks included ballistic panel.

With reference now to FIGS. 15A-15D, shown are embodiments of such a structural application of ballistic panel 10. FIG. 15A shows a perspective view of building block 80 in which ballistic panels 10 are inserted. Building blocks 80 may be used for permanent structures, but are particularly useful for utilizing ballistic panel 10 technology to provide soldiers, and others in the field, with protective barriers for increased survivability. Building blocks 80 are durable, interlocking and easy to assemble. Building blocks 80 are lightweight, allowing for rapid deployment. Embodiments of building blocks 80 are constructed from ¼" ABS plastic in the shape of an interlocking box, as shown in FIG. 15A. Other materials and shapes may be used for building blocks 80.

Figure 15B:
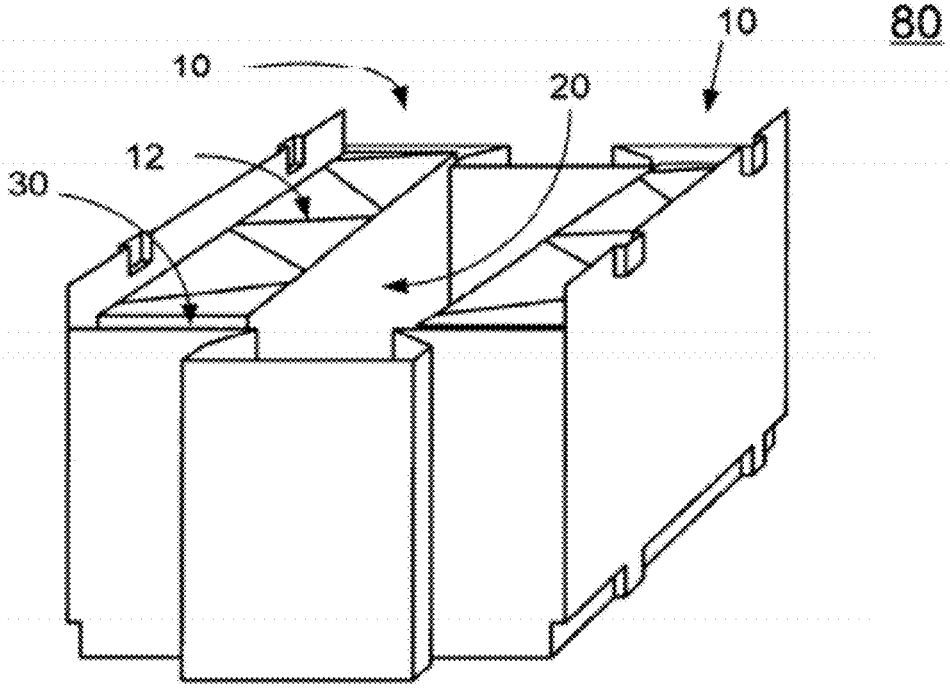

With reference now to FIG. 15B, shown is building block 80 with two ballistic panels 10 inserted therein. In the embodiment shown, two ballistic panels 10 are inserted into building block 80, with space for additional ballistic panel 10 in the middle of building block 80. Ballistic panels 10 shown here comprise three-dimensional tetrahedron cores 12. Cores 12 may be formed from ABS plastic or other material. Cores 12 may be enclosed by two backings 20 (or covers), one on each side of core 12, and casting walls 30 on ends of core 12 which are not visible in FIG. 15B (i.e., facing building block 80 walls). Backings 20 (or covers) and casting walls 30 may be formed as part of core 12 or formed separately and attached to core 12 (e.g., bonded to core 12) or simply inserted into building block 80 next to core 12. If formed separately, backing 20 may be constructed from steel plate, aluminum, or other material. Alternatively, cores 12 alone may be inserted into building block 80. The top of cores 12 are preferably left open and exposed, as shown in FIG. 15B, so that a filler may fill in the ballistic panels 10, filling in node cells 26 of core 12.

Figure 15C:
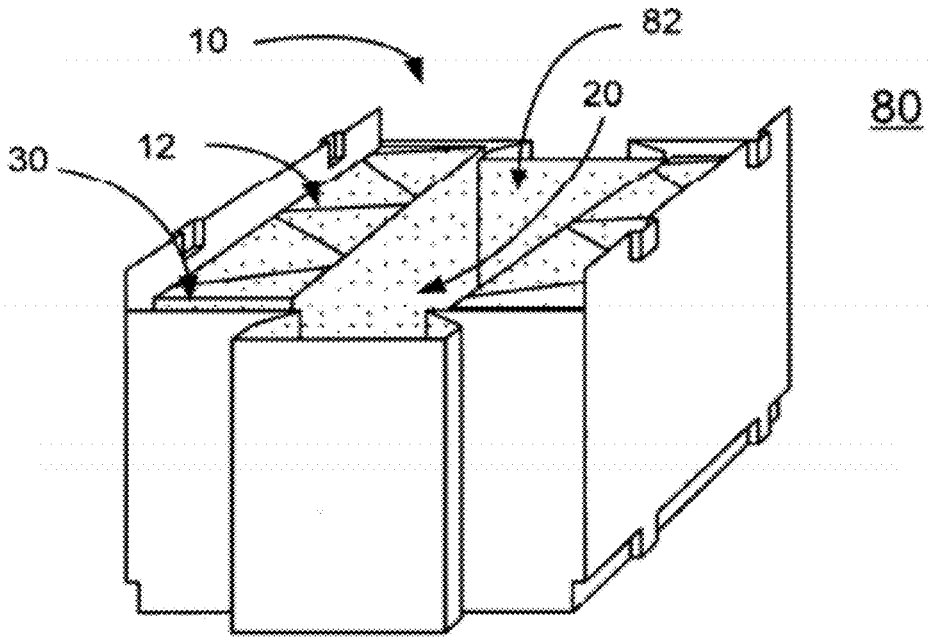

After ballistic panels 10 (e.g., cores 12) are inserted into building block 80, filler 82 is added to ballistic panels 10 and building block 80. Filler 82 may be sand or other ceramic media. With reference now to FIG. 15C, shown is building block 80, with two ballistic panels 10 inserted therein, filled with filler 82. Filler 82 may be poured into ballistic panels 10 and building block 80 through known means, such as simply shoveling sand into the building block 80. Preferably, filler 82 fills the entire building block 80, completely filling all node cells 26 in core 12 and spaces between inserted ballistic panels 10. The exposed top of building block 80 (i.e., top of ballistic panels 10 and filler 82) may be coated with an elastomeric, expandable, polyurethane, solvent free 100% solids polymer layer (e.g., a Rhinocast™ truck bed liner product) similar to outer coating 18. This polymer layer can be successfully sprayed on in an even layer and provides ideal results. Other materials may be used that provide the same or similar performance, such as other two component chemical processing systems that include pouring a polyurethane into a mold that becomes tack free in seconds.

Figure 15D:
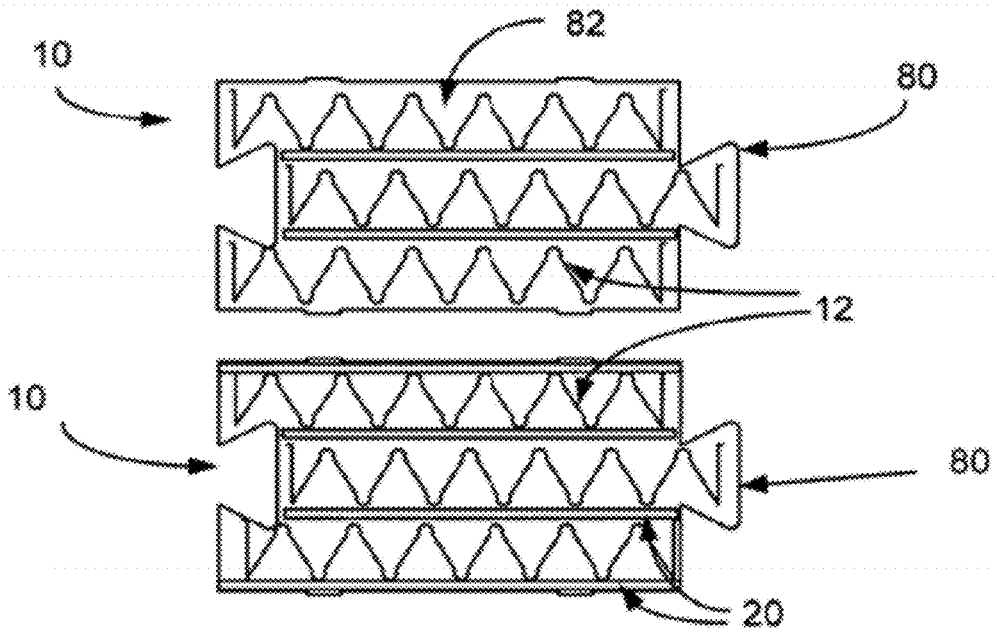

With reference now to FIG. 15D, shown is a top, cross-sectional view of building blocks 80, each fully assembled with three ballistic panels 10 and Filler 82. Assembled as such, building blocks 80 with ballistic panels 10 and filled with filler 82 provide lightweight, interlocking blocks for building defensive structures, such as defensive bunkers in combat, that can be easily and quickly assembled. As illustrated, all that is needed to assemble these blocks is building blocks 80, ballistic panels 10 (e.g., just core 12), and readily available filler 82 such as sand. Assembled as such, building blocks 80 provide superior protection against small arms fire, IED threats and high velocity projectiles. Building blocks 80 with ballistic panels 10 and filler 82 operate similarly to ballistic panels 10 described above. For example, filler 82 creates friction for projectiles, heating up and grinding down projectile, and core 12 absorbs and translates force from projectiles, eventually containing projectile effects within node cell 28.

Building blocks 80 and ballistic panels 10 designed for use therewith may be sold or provided separately or as a kit. Provided as a kit, an end user simply needs to add readily available filler and assemble, and building blocks 80 may be used to construct a protective structure.

Yet another application of ballistic panel 10 may use ballistic panels 10 illustrated and described above with reference to FIGS. 1A-2D. For example, rectangular (or other quadrilateral) shaped ballistic panels 10 may be combined to form a multi-panel, portable ballistic shield. Such a ballistic shield provides an effective barrier against gun-fire and fragments from explosive devices. The multi-panel, portable ballistic shield may be used as a portable fighting wall for use by military and security forces. For example, a sniper may set up a two-panel ballistic shield from which he can snipe behind, protected from shrapnel and small-arms fire. Such a ballistic shield may be used for blast suppression.

Such a ballistic shield may be constructed from two or more ballistic panels 10 that are connected together with hinges, Velcro, or other similarly hinged or pivoting/flexible connection on each ballistic panel 10. So connected, ballistic panels 10 comprising the ballistic shield may be positioned at angles to one another so that the ballistic shield may stand upright. For example, two ballistic panels 10 of a ballistic shield may stood up on end and be angled at a 45 degree angle to one another, providing support to each other. The more ballistic panels 10 included in the ballistic shield, the better able to ballistic shield is to stand upright. The ballistic shield may also include attachable braces or supports that can be attached to the ballistic panels, further bracing and supporting the ballistic shield when it is stood upright.

Preferably, the hinges, Velcro or other connections may be easily disconnected so that ballistic panels 10 comprising ballistic shield may be easily taken apart. This enables the ballistic shield to be easily disassembled. Disassembled as such, ballistic panels 10 comprising the ballistic shield may be stacked and easily stored, e.g., in a trunk of a car. Furthermore, a single ballistic panel 10 may be detached from the ballistic shield and used as a portable, personal shield. For example, if military or security personnel had to go from a prone fighting position behind a ballistic shield to on-foot pursuit of a target, he or she could detach one ballistic panel 10 from ballistic shield and carry it as a personal shield. As such, ballistic panels 10 of ballistic shield may include straps or strapping 40, as described above with reference to FIGS. 3-5B.

Many other applications of ballistic panel 10 are apparent to one of skill from the description herein. For example, ballistic panels 10 may be incorporated into wood or steel frame walls. Ballistic panels 10 may be incorporated as backing behind decorative façades, e.g., providing protection from blasts and small-arms fire where there would otherwise be known. Core 12 may be incorporated separately into many useful applications and structures, as described herein. Ballistic panels 10 may be easily assembled on site from cores 12 and readily available materials such as sand. The ballistic panel 10 technology described herein provides combination of protection and useful application not seen in any other protective technology.

Figure 16:
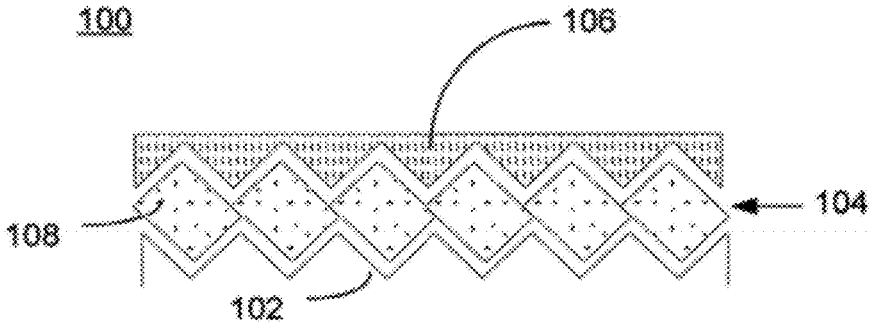
FIG. 16 is a diagram illustrating an exploded, cross-sectional view of an embodiment of a ballistic panel with cylinder-shaped grinding media.

With reference now to FIG. 16 shown is an exploded view of another embodiment of ballistic panel 100. Ballistic panel 100 includes core 102, grinding layer 104 and bonding layer 106. Core 102, grinding layer 104 and bonding layer 106 are shown with gaps in between each layer for illustrative purposes only. In reality, these gaps do not exist and, indeed, bonding layer 106 is intermingled with grinding layer 104 and in contact with core 102 (see below).

Grinding media in grinding layer 104 in ballistic panel 100 shown are ceramic cylinders 108. For example, grinding media may be/1;2" alumina (aluminum oxide) cylinders. The grinding layer 104 acts as described above, causing frictional and resistive forces to be asserted against ballistic round, projectiles, fragments, etc. impacting on ballistic panel 100 and penetrating through bonding layer 106. It is thought that grinding layer 104 grinds such ballistic round, projectiles, fragments, etc., dissipating them and helping to dissipate their momentum. Ceramic cylinders 108 are preferably positioned side-by-side, upright at an angle in adjacent rows of core 102, tilted as shown. In affect, grinding media nest in core 102. FIG. 16 is a cross-section showing core 102 with six rows filled with six rows of ceramic cylinders 108. A core 102 may have more than six rows, depending on size of ballistic panel 100 desired, size of grinding media and other factors apparent to one of ordinary skill in the art. Moreover, each row of core 102 may be filled with more than one row of grinding media (e.g., more than one row of ceramic cylinders 108). In other words, the rows in core 102 may each be large enough to accommodate more than a one grinding media thick row. Ceramic cylinders 108 could be stacked on two thick, or more, on top of each other and side-by-side within each row of core 102. Each row of ceramic cylinders 108, or other grinding media, could be offset so as to maximize packing density.

Other configurations and layouts of grinding layer 104 may be apparent to one of ordinary skill. For example, ceramic cylinders 108 may be positioned on their sides (horizontally) rather than upright as shown. The ceramic cylinders 108 are preferably tightly packed into core 102. Adjacent rows of ceramic cylinders 108 in ballistic panel 100 may be aligned with each other or offset so that the intersections formed by adjacent ceramic cylinders 108 in adjacent rows do not align. An additional grinding layer 104 may also be applied to bottom of core 102 shown.

Bonding layer 106 may be a self-healing polymer, such as outer coating described above. For example, bonding layer 106 may be an elastomeric, expandable, polyurethane, solvent free 100% solids polymer layer (e.g., Rhinocast™). Indeed, bonding layer 106 is, in affect, analogous to a combined bonding media and outer layer described above, e.g., with reference to FIG. 1. In effect, bonding layer 106 acts as bonding media and outer layer or coating for ballistic panel 100. In an alternative embodiment, outer layer may be provided as a separate material from bonding layer 106. Bonding layer 106 preferably totally encapsulates grinding layer 104, bonding grinding layer together and to core 102. Bonding layer 106 fills in between ceramic cylinders 108 of grinding layer 104, in tiny gaps and spaces between cylinders 108 and between cylinders 108 and core 102, coming into contact with core 102. In this manner, bonding layer 106 fills in all gaps and spaces in grinding layer 104 and between grinding layer 104 and core 102 (e.g., between ceramic cylinders 108 and between ceramic cylinders 108 and core 102). This in affect keeps ceramic cylinders 108 in place and properly oriented and helps to contain damage to grinding layer 104 from impacts. Above grinding layer 104, bonding layer 106 preferably has a measurable thickness, as shown, in order to be able effectively "heal" from impacts. This thickness is analogous to outer layers described above. In fact, bonding layer 106 acts Bonding layer 106 may also be applied to bottom of core 102, encapsulating core 102 as well.

With continued reference to FIG. 16, as with cores described above, core 102 acts as a three-dimensional, structural truss or space frame for ballistic panel 100. As a space frame for ballistic panel 100, core 102 acts to help absorb and distribute impacts from rounds, shrapnel, explosives, etc. A space frame is a truss-like, lightweight rigid structure often constructed from interlocking struts in a geometric pattern. Space frames are often used to accomplish long spans with few supports. They derive their strength from the inherent rigidity of their frame; flexing loads (bending moments) are transmitted as tension and compression loads along the length of each strut. Space frames may be a variety of geometric shapes. By absorbing and distributing force of impacts, core 102 helps ballistic panel 100 to contain ballistic rounds, shrapnel and the explosive force, dissipating the forces impacting on ballistic panel 100. In the embodiment shown, core 102 has a space frame design that includes adjacent, parallel, angled rows for positioning adjacent, parallel rows of tightly-packed grinding media at an angle. This angle is away from a perpendicular to the outer surface of ballistic panel 100. If ballistic panel 100 is facing a threat, most impacts will impact with ballistic panel 100 at this perpendicular. By being positioned at an angle away from this perpendicular, the grinding media (e.g., ceramic cylinders 108) re-direct the round, shrapnel, etc., thereby increasing the ability of ballistic panel 100 to contain the round, shrapnel, etc. This truss design also enables dense packing of the grinding media, increasing the density of grinding layer 104 and the amount of grinding media in ballistic panel 100. Each ceramic cylinder 108 positioned as such in the adjacent rows of core 102 forms a node of the core 102, similar to nodes described above. By itself, core 102 may look like a tray with a number of adjacent, tilted rows on which ceramic cylinders 108, or other grinding media, are placed.

Figure 17:
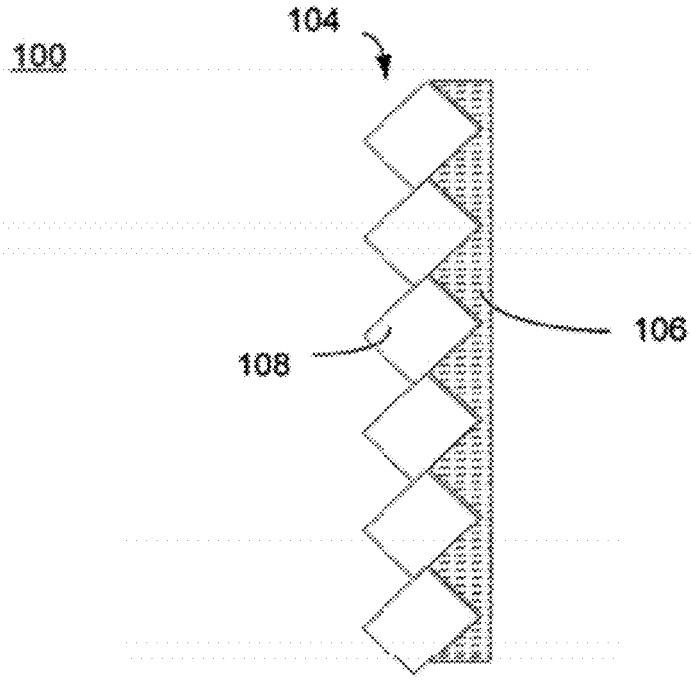
FIG. 17 is a diagram illustrating a cross-sectional view of a flex-design embodiment of ballistic panel.

After ceramic cylinders 108 are positioned in core 102, bonding layer 106 is poured or otherwise cast onto grinding layer 104. To provide a flexible ballistic panel, core 102 may be removed before bonding layer 106 completely sets. Alternatively., a casting tray coated so that bonding layer 106 would not adhere and configured like core 102 may be used to position and hold grinding media in place when bonding layer 106 was poured or cast. When bonding layer 106 set, grinding layer 104 and bonding layer 106 would be removed from casting tray. With reference now to FIG. 17, shown is flexible ballistic panel 110 that may be manufactured as such. Flexible ballistic panel 110 includes only bonding layer 106 and grinding layer 104. Although not shown here, some of polymer, or other material used for bonding layer 106, may be situated in gaps and spaces between ceramic cylinders 108 and where gaps and spaces existed between grinding layer 104 and core 102 (or casting tray). When applied to ballistic panel 110, bonding media fills in these gaps and spaces, increasing the bonding effect of bonding layer 106. FIG. 17 shows flex ballistic panel 100 with casting tray (or core 102) removed. Flexible ballistic panel 110 may be used in applications in which a flexible ballistic panel is needed.

Figure 18:
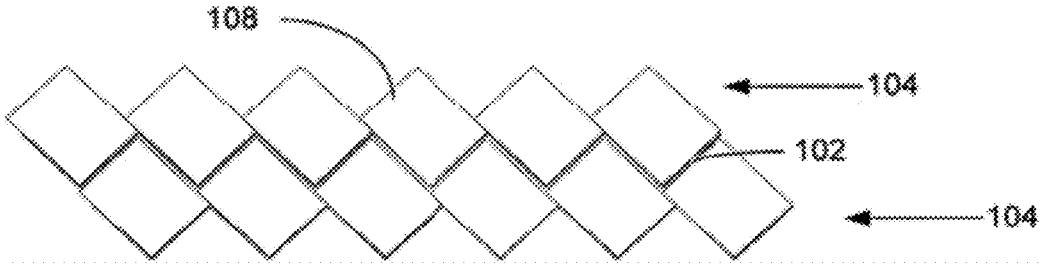
FIG. 18 is a diagram illustrating a cross-sectional view of embodiment of ballistic panel with interlocking and stacking cores with cylinder-shaped grinding media.

With reference now to FIG. 18, shown is an illustration of stacked grinding layers 104 surrounding one core 102. Because of the orientation of the grinding media (in this embodiment, ceramic cylinders 108) and core 102 space frame design, layers of core(s) 102 and grinding layers 104 may be stacked one on top of another in an interlocking manner, as shown. The ceramic cylinders 108 fit within nodes of the core 102 truss design. In the embodiment shown, one core 102 is surrounded by two grinding layers 104. However, additional cores 102 and grinding layers 104 may be added. This enables ballistic panels 100, 120 with multiple layers of rigid and secure protection to be provided. As many such layers as is needed or desired for a particular application or implementation could be provided. Bonding layers (not shown) could be added to secure and enclose a ballistic panel with stacked grinding layers 104 and core(s) 102.

Figure 19:
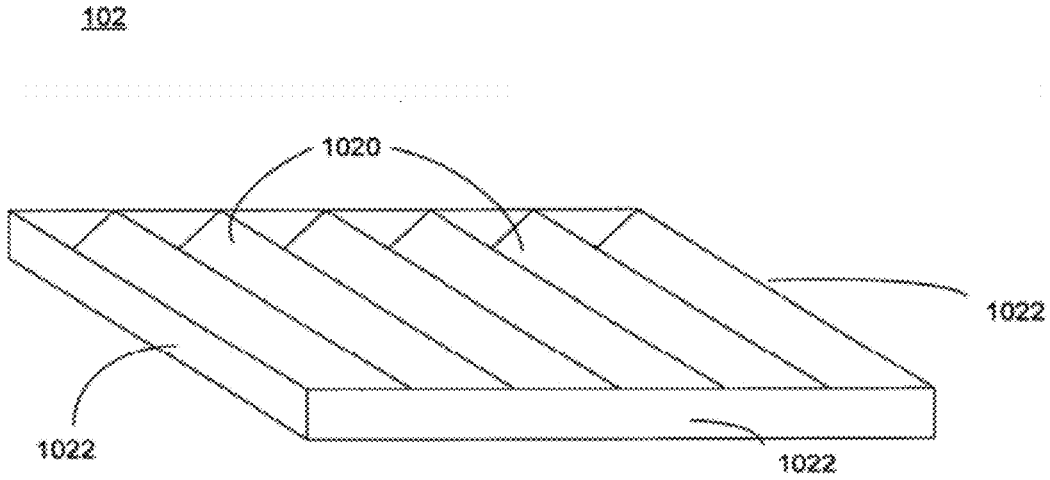
FIG. 19 is a diagram of an embodiment of a core.

With reference now to FIG. 19, shown is a perspective view of an embodiment of core 102. As shown, core 102 has a structural truss or space frame-like design with angled, parallel, adjacent rows 1020 for holding and orienting grinding media. Each row 1020 acts as a node or cell in structural truss or space frame design of core 102, with each grinding media placed in core 102 acting in conjunction with row 1020 in which it is placed as a sub-cell or sub-node of each row 1020. In this embodiment, core 102 has the appearance of a tray on which grinding media are placed. Core 102 truss design orients and holds grinding media at an angle for re-directing ballistic rounds and densely packing the grinding media. It is thought that by orienting the grinding media as such, core 102 decreases the chance that ballistic rounds will strike the grinding media head-on and increases the chance that the rounds will impact with multiple grinding media, thereby increasing the grinding affect of the grinding media. The core 102 space frame/truss design also enables the dense packing of cylinder shaped grinding media (e.g., ceramic cylinders 108), cubic shaped grinding media, hexagonal shaped grinding media or other shaped grinding media. The core 102 space frame/structural truss design also provides structural strength to the ballistic panel, helping to absorb and distribute forces that impact on the ballistic panel. The width and length of rows 1020 are determined by the size of the grinding media (e.g., diameter of ceramic cylinders 108), the number of grinding media to be placed in each row 1020 (e.g., number of grinding media side-by-side in each row 1020 and number of rows or number of grinding media placed on top of one another in each row 1020, and the size of the desired ballistic panel. Core 102 also includes walls 1022 that define the boundaries of ballistic panel and further help to contain, in conjunction with bonding layer 106, grinding media in ballistic panel.

Figure 20A:
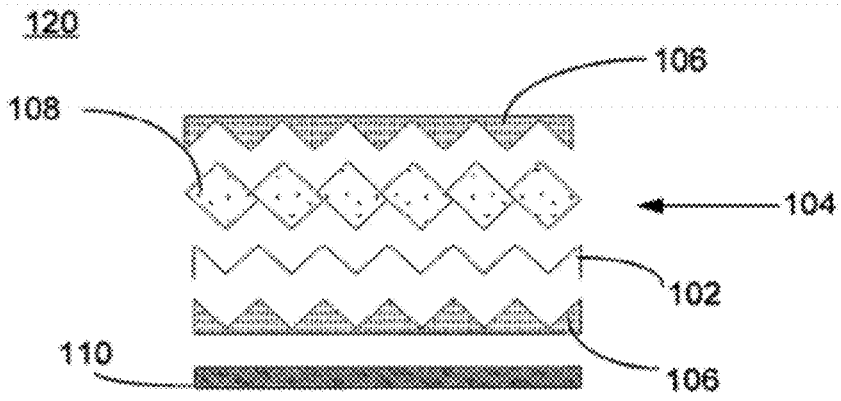
FIGS. 20A to 20C are diagrams illustrating exploded and non-exploded cross-sectional views of embodiment of ballistic panel with cylinder-shaped grinding media, multiple poly layers and backing.
Figure 20B:
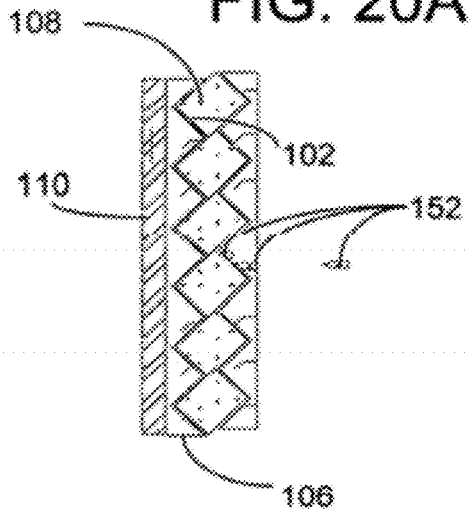
Figure 20C:
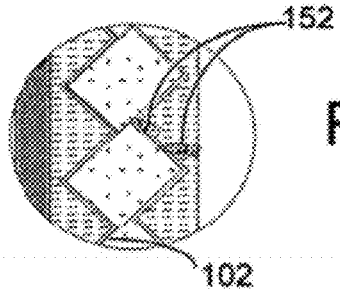

With reference now to FIGS. 20A-20C, shown is another embodiment of ballistic panel 120. With reference to FIG. 20A, shown is an exploded view of a ballistic panel 120 that includes core 102, grinding layer 104, bonding layer 106 and backing 130. Grinding layer 104 includes cylinder-shaped grinding media 108. Core's 102 truss design orients and holds grinding media at an angle for re-directing ballistic rounds and densely packing cylinder-shaped grinding media 108. Cylinder-shaped grinding media 108 fit within parallel, adjacent rows of truss design, thereby defining nodes of core 102. Cylinder-shaped grinding media 108 may be ceramic or from other materials providing similar grinding properties. Bonding layer 106 may act as both self-healing outer coating and bonding layer to bond grinding layer 104 in position. As such, bonding layer 106 may be a self-healing polymer as described above.

In the embodiment shown, ballistic panel 120 includes one grinding layer 104 on top of core 102 and bonding layers 106 is applied directly to grinding layer 104 and to bottom or back of core 102. In this embodiment, ballistic panel 120 will be installed with grinding layer 104 facing threat. An alternative embodiment would also include a grinding layer 104 on bottom or back of core 102.

With continued reference to FIG. 20A, a backing 130 is then secured to backside of ballistic panel 120 to provide increased force absorption and other benefits described above. Indeed, backing 130 in combination with core 102 provides an even stronger space frame for ballistic panel 120; core 102 acts as triangular struts and backing horizontal bottom struts of frame. Backing 130 may be secured to bonding layer 106 applied to back of core 102 by placing in on bonding layer 106 before bonding layer 106 sets or cures. Alternatively, fasteners such as bolts may be placed in bonding layer 106 while it sets or cures and then backing 130 secured to bolts with nuts. One of skill in the art can substitute any variety of suitable fasteners to secure backing 130 to ballistic panel 120. Backing 130 may be any of a variety of materials, as described above. For example, backing 130 may be steel, sheet metal, aluminum, ceramic, composite materials, plastic, wood, etc. Backing with 6061 aluminum plate or AR500 steel plate may be used. The backing 130 may simply be the structural material of the building, vehicle, etc. to which the ballistic panel 120 is attached.

With reference now to FIGS. 20B-20C shown is assembled ballistic panel 120 being impacted by a ballistic, armor piercing round 152. Ballistic panel 120 shown includes core 102 surrounded by grinding layer 104 and two bonding layers 106 and backed by backing 130 attached to bonding layer 106 on non-threat side. Round 152 pierces bonding layer 106 on threat side and impacts with grinding layer 104. Because of nature of grinding layer 104 and orientation of ceramic cylinders 108, round 152 is deflected and ground by grinding layer 106. The forces from the round 152 are distributed, dissipated and/or absorbed by core 102 and/or backing 130.

Figure 21:
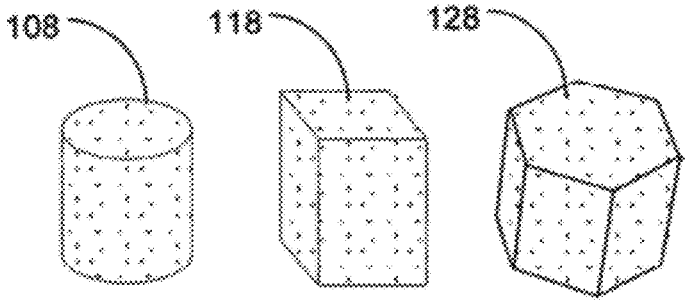
FIG. 21 is a diagram illustrating exemplary grinding media.

With reference now to FIG. 21, shown is cylinder-shaped grinding media, ceramic cylinder 108, cube-shaped grinding media, ceramic cube 118, and three-dimensional hexagon-shaped grinding media, ceramic hexagon 128. As mentioned above, grinding media in grinding layer 106 may be cylinder-shaped or cube-shaped. Cube shaped grinding media, such as ceramic cube 118, generally provides tighter packing with fewer gaps between the grinding media than cylinder shaped grinding media. However, tighter packed cube shaped grinding media comes with trade-off of additional weight versus cylinder shaped grinding media. Depending on the stopping power needed for a ballistic panel, cylinder shaped grinding media may provide sufficient density and stopping power with less weight. Ceramic hexagons 128 may also be used. As shown in FIG. 21, ceramic hexagons 128 are three-dimensional ceramic hexagonal columns. Ceramic hexagons 128 may pack denser and tighter then ceramic cylinders 108, while still providing spacing that enables bonding media to flow between grinding media, more so then ceramic cubes 118. Moreover, those of ordinary skill in the art will recognize that other materials or shapes may be used. The application and implementation of ballistic panel will help determine which grinding media is used.

Figure 22B:
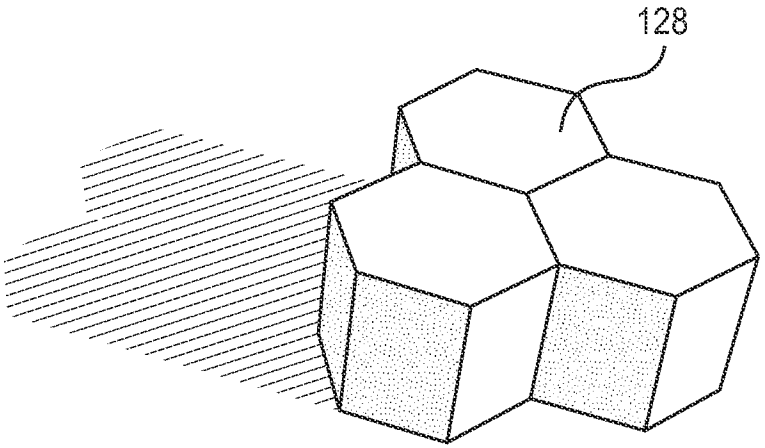
FIGS. 22A to 22B are diagrams illustrating exemplary hexagonal grinding media.
Figure 22A:
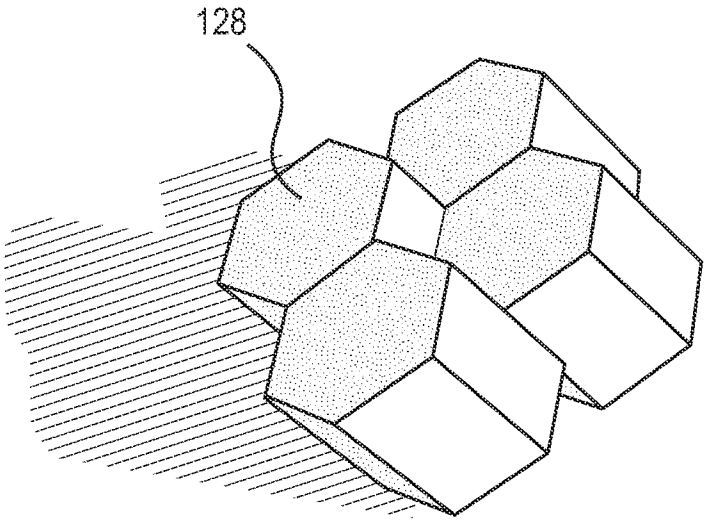

With reference now to FIGS. 22A and 22B, shown are views or depictions of two different schemes showing how ceramic hexagons 128 may be packed together to fill core 102 in ballistic panel. In FIG. 22A, shown are four ceramic hexagons 128 as they would be positioned in adjacent rows of core 102. As can be seen here, the two ceramic hexagons 128 in one row are offset from two ceramic hexagons 128 in the adjacent row. In this offset manner, ceramic hexagons 128 fit together more closely then if the adjacent rows of ceramic hexagons were not offset. By offsetting adjacent rows of ceramic hexagons 128, the packing scheme shown greater packing density than if adjacent rows were not offset (e.g., ceramic hexagons 128 in each row were directly aligned). It is noted that the adjacent rows of ceramic hexagons 128 are shown tilted with one row higher then the other. This is how the adjacent rows of ceramic hexagons 128 would appear when positioned in core 102 shown in FIG. 19.

In FIG. 22B, three ceramic hexagons 128 are shown grouped together. This illustrates ceramic hexagons 128 may be packed in rows more than one ceramic hexagon 128 wide. In FIG. 22A, the adjacent rows are one ceramic hexagon 128 wide. Packed as shown in FIG. 22B, rows in core 102 may be two or more ceramic hexagons 128 wide. In order to accommodate such packing, rows of core 102 would have to be wider or ceramic hexagons 128 made smaller. The packing scheme shown in FIG. 22B may also be used to provide a flat grinding layer, e.g., which is used without core 102, in addition to grinding layer in core 102, or with a flat tray. It is also noted that different sized ceramic hexagons 128 could be used together to provide different packing schemes. One of ordinary skill in the art would recognize that the above may be applied as well to ceramic cylinders, cubes, spheres and other grinding media, and that may different packing schemes, sizes, shapes and other variations similar to those described herein may be used both with ceramic hexagons, cylinders, cubes, spheres and other grinding media.

Figure 23C:
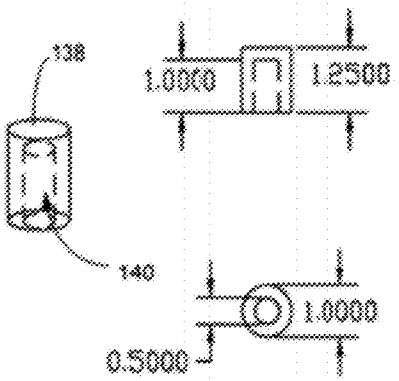
FIGS. 23A to 23C are diagrams illustrating exemplary hollow grinding media.
Figure 23B:
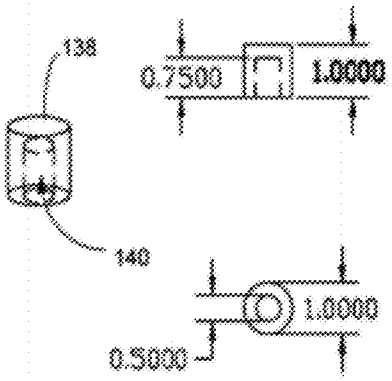
Figure 23A:
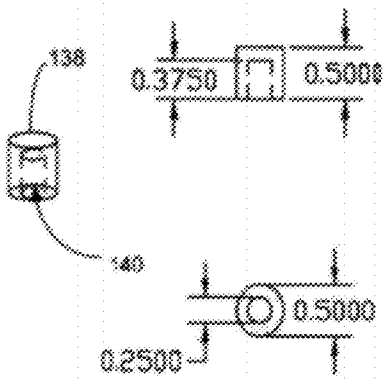

With reference now to FIGS. 23A-23C, shown is an alternative embodiment of cylinder shaped grinding media, hollow ceramic cylinder 138. The alternative embodiment shown includes a blind hole, hole 140 defined in ceramic cylinder 138. In the embodiment shown, hole 140 is extends partially through ceramic cylinder 138 with an open end on one end of ceramic cylinder 138. FIGS. 23A-23C illustrate three different size ceramic cylinders 138 with hole 140. In other embodiments the hole may extend all the way through ceramic cylinder 138 or may be closed on both ends, forming an enclosed cavity in ceramic cylinder 138.

The dimensions of ceramic cylinder 138 and hole 140 may be varied depending on a number of factors involved in the application, including without limitation the desired packing density, the size of the core, the desired weight, size and thickness of the ballistic panel, the expected threats, etc. One of ordinary skill in the art would recognize that the size of ceramic cylinder 138, and indeed other grinding media described herein, may be varied based on these and other factors. With reference to FIG. 23A, ceramic cylinder 138 shown has height and diameter of 0.5 inch. Hole 140 is 0.25 inch in diameter and has a height of 0.375 inch. In FIG. 23B, ceramic cylinder 138 has height and diameter of 1 inch and hole 140 has a diameter of 0.5 inch and a height of 0.75 inch. In FIG. 23C, ceramic cylinder 138 has a height of 1.25 inches and a diameter of 1 inch and hole 140 has a diameter of 0.5 inch and a height of 1 inch. As is apparent from this illustration, the ceramic cylinder 138 and hole 140 are not limited to a particular size.

With continued reference to FIGS. 23A-23C, hollow ceramic cylinders 138 provide numerous advantages and features for ballistic panels. Hollow ceramic cylinders 138 can simply be used in place of ceramic cylinders in ballistic panels described above (e.g., ceramic cylinders 108 used with ballistic panel 100, 120 shown in FIG. 16). Hollow ceramic cylinders 138 offer a number of advantages over ceramic cylinders described above. For example, ceramic cylinders 138 have decreased weight and increased surface area versus solid ceramic cylinders of same size by virtue of hole 140. The increased surface area provides a greater bonding surface area for bonding layer 106; bonding media can flow into hole 140, increasing the bonding affect on ceramic cylinders 138. The increased bonding can better hold ceramic cylinders 138 in place and increase the durability of ballistic panel (e.g., when ceramic cylinders 138 are impacted by rounds and partially break apart, bonding layer 106 holds piece close together). At the same time, by being hollowed out while remaining same size, ceramic cylinders 138 can densely and tightly pack ballistic panel, providing similar stopping power at a reduced weight. Reducing the weight of grinding layer reduces the weight of ballistic panel, which offers a significant advantage for ballistic panel applications.

Hollow ceramic cylinders 138 may be installed into ballistic panel with hole 140 facing threat-wards or towards core. Each alternative provides different advantages, as is apparent here. In one alternative embodiment of ballistic panel using hollow ceramic cylinders 138, core (e.g., similar to core 102) is formed with protrusions that match hole 140. With such protrusions, core can better distribute, absorb and dissipate force impacting on ceramic cylinders 138. By being placed into holes 140, the protrusions increase the "communication" between grinding layer and core (e.g., increase the contacting surface area of grinding layer and core). Such increased communication increases the force that can be distributed from grinding layer to core. Protrusions in rows of core 102, for example, also make installation of ceramic cylinders 138 easier, as ceramic cylinders 138 may be simply dropped or placed on protrusions.

With continued reference to FIGS. 23A-23C, hole 140 also enable other material, besides bonding media, to be placed or deposited inside ceramic cylinders 138. For example, aluminum or other metals, plastic, composites, etc. could be poured or otherwise deposited into hole 140. Such materials would act, for example, to distribute force (e.g., to core). Like protrusions, such material placed in holes 140 increase the "communication" between grinding layer and core (if holes 140 face core). Material that works similarly to ceramic material of ceramic cylinders 138 or that enhances or complements ceramic material could also placed in holes 140. Material could be deposited in holes 140, e.g., by being poured in liquid form, die cast, etc.

Moreover, holes 140 could be used to provide a reactive armor feature for ballistic panels with hollow ceramic cylinders 138. Ballistic panels described above would be characterized as passive or non-reactive armor; i.e., ballistic panels described above seek to stop rounds or other impacts passively, simply by being in the way. Reactive armor reacts to the round or other impact by reacting to the round or other impact. As such, explosive material, such as plastic explosive, could be deposited inside holes 140. Ceramic cylinders 138 filled with such explosive material would explode when impacted, e.g., by a round, fragment or super-heated jet (e.g., as with a shape-charge). The purpose of the explosion (the reaction) would be to deflect or interrupt the path of the round, fragment or super-heated jet. The explosive material and ceramic cylinders 138 would be installed in such a way that the resulting explosion would be directed in a desired direction (e.g., out from ballistic panel or across path of impact.

Figure 24B:
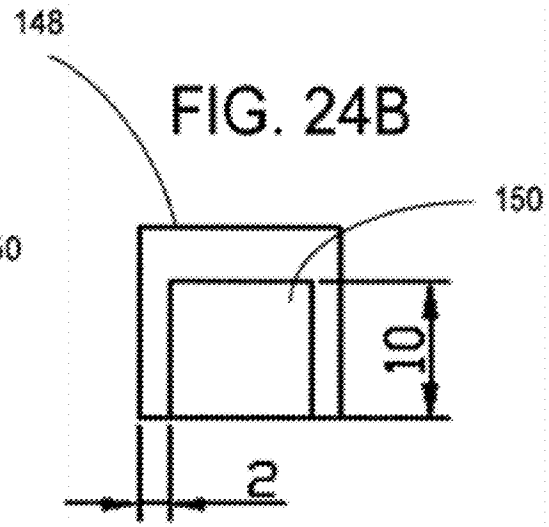
FIGS. 24A to 24C are diagrams illustrating exemplary hollow grinding media.
Figure 24A:
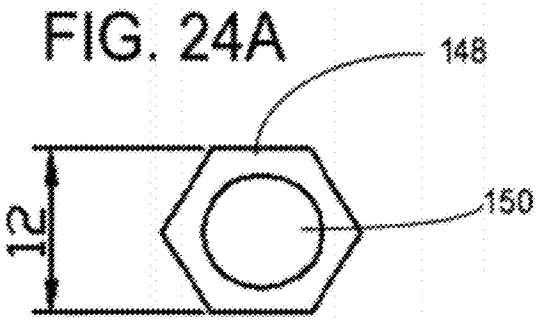
Figure 24C:
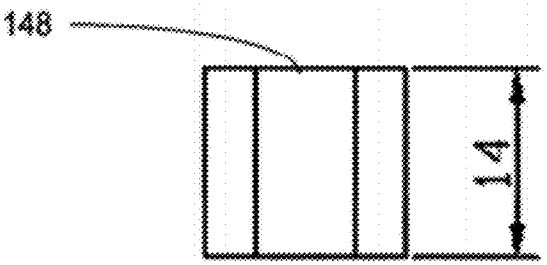

As noted above, different shaped grinding media may be used. Consequently, hollow ceramic cubes, hexagons or spheres, for example, may be used. With reference now to FIGS. 24A-C shown is hollow ceramic hexagon 148. Hollow ceramic hexagon 148 includes blind hole 150, which is similar in nature to blind hole 140 in ceramic cylinder described above. Hole 150 extends partially through hollow ceramic hexagon 148 with an open end on one end of hollow ceramic hexagon 148. In other embodiments the hole may extend all the way through hollow ceramic hexagon 148 or may be closed on both ends, forming an enclosed cavity in hollow ceramic hexagon 148.

The dimensions of hollow ceramic hexagon 148 and hole 150 may be varied depending on a number of factors involved in the application, including without limitation the desired packing density, the size of the core, the desired weight, size and thickness of the ballistic panel, the expected threats, etc. One of ordinary skill in the art would recognize that the size of hollow ceramic hexagon 1488, and indeed other grinding media described herein, may be varied based on these and other factors. With reference to FIGS. 24A-C, hollow ceramic hexagon 148 shown has height of 14 mm and a width of 12 mm (across width shown in FIG. 24A). Hole 150 has a height of 10 mm and a diameter of 10 mm (cross-section shown in FIG. 24B is across widest portion of hexagon 148, not width shown in FIG. 24A As above with ceramic cylinder 138 and hole 140, hollow ceramic hexagon 148 and hole 150 are not limited to a particular size. Hollow ceramic hexagon 148 may be used in similar fashion as hollow ceramic cylinder 138 and hole 150 may be similarly filled with material, fit on protrusions from core, etc., as hole 140.

One of ordinary skill in the art will recognize that the embodiments described herein offer a great deal of flexibility in implementation and design. For example, as described herein, additional materials may be combined with embodiments of ballistic panel described herein to increase the effectiveness of the embodiment and/or to enable the embodiment to protect against additional threats. Virtually any material that is used in armor systems and others not normally used in armor systems, may be combined with ballistic panels described herein.

Figure 25:
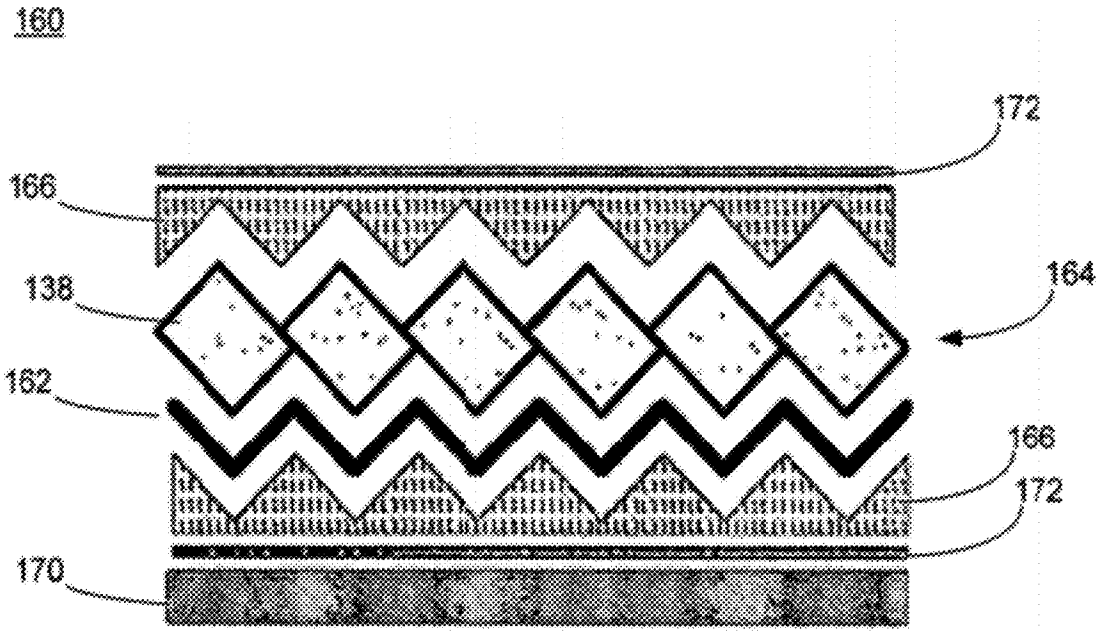
FIG. 25 is a diagram illustrating an exploded, cross-sectional view of an embodiment of an armor system including a ballistic panel with wire mesh.

For example, with reference now to FIG. 25, shown is an armor system comprised of an embodiment of ballistic panel 160 featuring layers of wire mesh 172. Ballistic panel 160 includes core 162, grinding layer 164, bonding layer 166 and backing 170, which all may be as described above with respect to other embodiments of ballistic panel. For example, core 162 may be like core 102 as shown in FIG. 19 with parallel rows tilted to position grinding media at an angle to incoming threats. Grinding layer 164 may be comprised of ceramic cylinders 168, similar to ceramic cylinders 108 or 138 described above. Alternatively, different shaped or material grinding media, such as ceramic cubes 118, ceramic hexagons 128, 148, etc. may be used. Bonding layer 166 may be comprised of self-healing polyurethane, such as Rhinocast, similar to bonding layer 106 described above. In the embodiment shown, bonding layer 166 is installed both on threat side of ballistic panel 160, bonding grinding media together and grinding layer 164 to core 162, and on non-threat side of ballistic panel 160. Backing 170 may be steel plate, aluminum, ceramic plate, wood, etc., similar to backings described above.

Wire mesh layers 172 may be placed around ballistic panel 160 or interspersed between various layers. In the embodiment shown in FIG. 25, wire mesh 172 is installed on threat side of ballistic panel 160 and on non-threat side, positioned between bonding layer 166 on back side of core 162 and backing 170. Wire mesh 172 may be pressed into bonding layer 166 prior to bonding layer 166 curing or setting. Indeed, bonding layer 166 may be (1) applied to threat side of ballistic panel 160 and wire mesh 172 pressed into drying bonding layer 166 and (2) applied to non-threat side of ballistic panel 160 and wire mesh 172 and backing 170 pressed into drying bonding layer 166 so that bonding layer 166 adheres to wire mesh 172 and, through wire mesh 172, to backing 170. Wire mesh 172 acts to contain ballistic panel 160 material after ballistic panel 160 has been impacted by rounds, fragments, explosive force, etc. Wire mesh 172 also helps to trap and contain fragments, both from the impacting round, fragment, etc., but also from ballistic panel 160 itself, reducing resulting injury and damage. Wire mesh 172 used is preferably a high-strength wire mesh that also helps deflect incoming rounds, increasing the stopping power of ballistic panel 160. Furthermore, wire mesh 172 is ductile and does not easily deform when impacted; wire mesh often returns or rebounds to its original shape when impacted. Also, these characteristics of wire mesh 172 enable wire mesh 172 to absorb shock from explosions, like self-healing polyurethane used in bonding and outer layers, instead of radiating the shock like steel plate. These characteristics and advantages of wire mesh 172 help to increase the durability and re-usability of ballistic panel 160.

As noted above, various armor systems may be assembled by combining or stacking multiple ballistic panels. While weighing more, a combined ballistic panel system may be able to stop even greater threats then a single ballistic panel. Indeed, embodiments of ballistic panels geared towards stopping different threats and with different strengths may be combined to provide a comprehensive armor system with very substantial stopping and protective ability.

Figure 26:
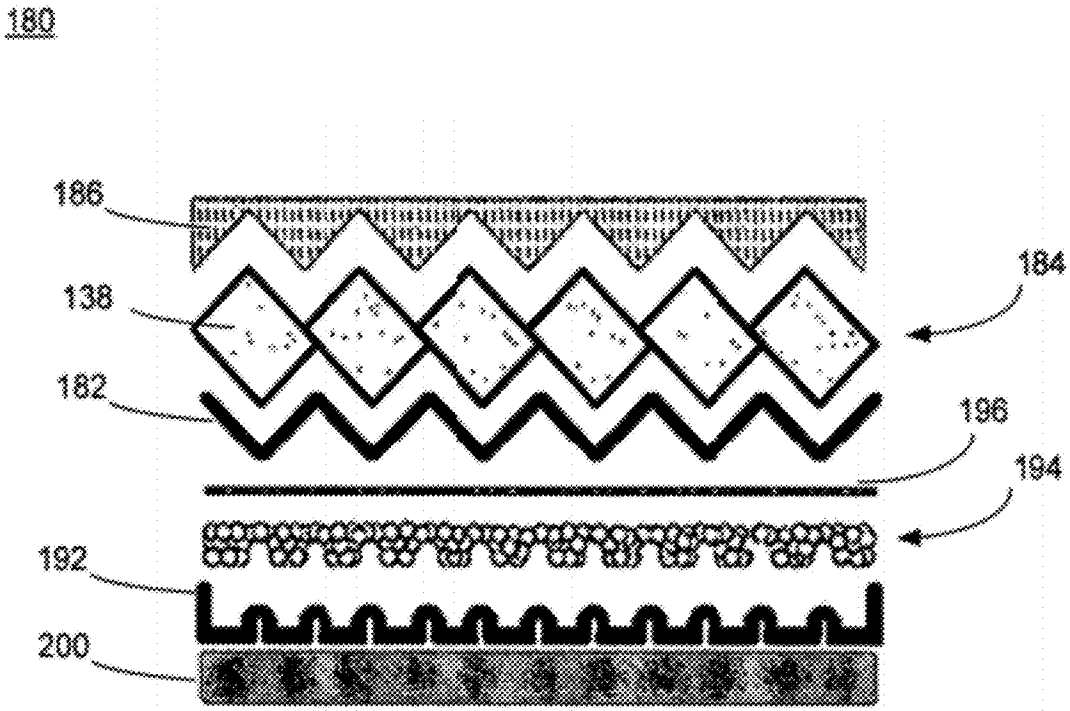
FIG. 26 is a diagram an exploded, cross-sectional view of an embodiment of an armor system including multiple ballistic panels.

With reference now to FIG. 26, shown is an exploded view of an armor system 180 that includes multiple ballistic panels. Armor system 180 may include an embodiment of ballistic panel with ceramic cylinders, such as ballistic panel 102 with ceramic cylinders 108 or 138 shown in FIG. 16, stacked on top of an embodiment of ballistic panel with ceramic spheres, similar to ballistic panel 10 with ceramic spheres 28 shown in FIG. 1. Armor system 180 shown includes outer bonding layer 186, first grinding layer 184, first core 182, additional inner bonding layer 196, seconding grinding layer 194, second core 192 and backing 190. Bonding layers 186, 196 may be self-healing polyurethane (e.g., Rhinocast), such as bonding layer 106 described above. Outer bonding layer 186 provide threat-side outer layer as well as bonding for first grinding layer 184 and first core 182. First grinding layer 184 may include ceramic cylinders similar to ceramic cylinders 108 or 138 described above. Alternatively, different shaped or material grinding media, such as ceramic cubes 118, ceramic hexagons 128, 148, etc. may be used. In the embodiment shown here, grinding layer 184 is ½" alumina cylinders.

First core 182 may be similar to core 102 described above (see FIG. 19) with parallel, tilted rows for holding grinding media. First core 182 may be made from plastic, or other materials. Inner bonding layer 196 may bond second grinding layer 194 to first core 182 and second core 192. Inner bonding layer 196 is illustrated as a relatively thinner layer then outer bonding layer 186. Alternatively, inner bonding layer 196 may fill in back-side of first core 182, similar to bonding layer 166 in FIG. 25.

With continued reference to FIG. 26, second grinding layer 194 may include ceramic spheres similar to ceramic spheres 28 shown in FIG. 1. For example, grinding media in second grinding layer 194 may be 6 mm alumina spheres. Second grinding layer 194 may be bonded together and to second core 192 with inner bonding layer 196. Alternatively, second grinding layer 196 could be bonded together with separate bonding media, similar to bonding media 16 described above. Second core 192 may be similar core 12 described above (e.g., a three-dimensional matrix approximating an octet truss). Backing 190 may be bonded to second core 192 as described herein (e.g., with a third bonding layer or other adhesive means). In the embodiment shown, backing is 3/16" 6061 aluminum plate. Alternative materials, such as steel, armor plate, ceramic plate, etc., may be used. For example, AR500 steel plate may be used. Steel plate offers greater protection and stopping power than aluminum plate, but at the expense of greater weight. It is noted that while outer ballistic panel portion shown in FIG. 26 is akin to ballistic panel 100, 120 and inner ballistic panel portion is akin to ballistic panel 10, the ballistic panels in armor system 180 may be alternated. Moreover, additional layers, e.g., additional ballistic panels, may be added to armor system 180.

Figure 27:
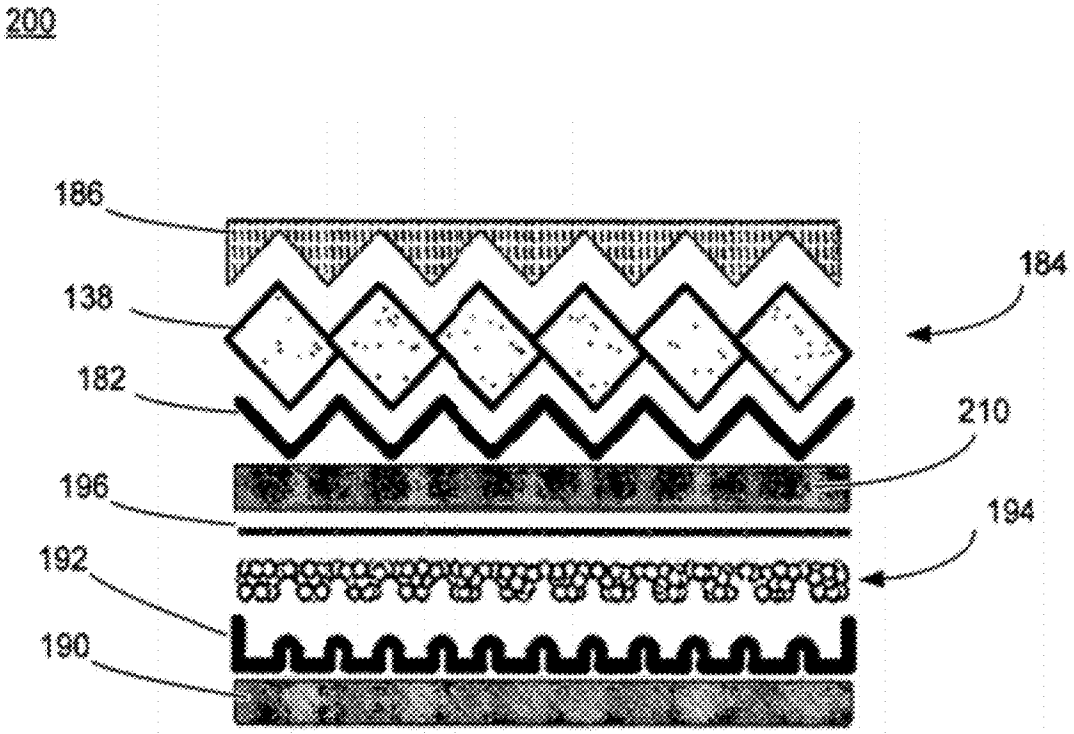
FIG. 27 is a diagram an exploded, cross-sectional view of an embodiment of an armor system including multiple ballistic panels.

With reference now to FIG. 27, shown is an exploded view of another embodiment of an armor system 200 that includes multiple ballistic panels. Armor system 200 shown also includes outer bonding layer 186, first grinding layer 184, first core 182, additional inner bonding layer 196, seconding grinding layer 194, second core 192 and backing 190, which may be the same or similar to components of armor system 180 described above. Additionally, armor system 200 includes second or intermediate backing 210 that is located between outer ballistic panel and inner ballistic panel portions of armor system 200. Backing 210 provides backing for outer ballistic panel and is situated adjacent to first core 182. Second or inner bonding layer 196 is situated between intermediate backing 210 and second grinding layer 196. An additional bonding layer may be placed between intermediate backing 210 and first core 182. Embodiment of intermediate backing 210 shown is 3/16" 6061 aluminum plate. Alternative materials, such as steel, armor plate, ceramic plate, etc., may be used. For example, AR500 steel plate may be used. It is also noted that while outer ballistic panel portion shown in FIG. 27 is akin to ballistic panel 100, 120 and inner ballistic panel portion is akin to ballistic panel 10, the ballistic panels in armor system 200 may be alternated. Moreover, additional layers, e.g., additional ballistic panels, may be added to armor system 200.

Figure 28:
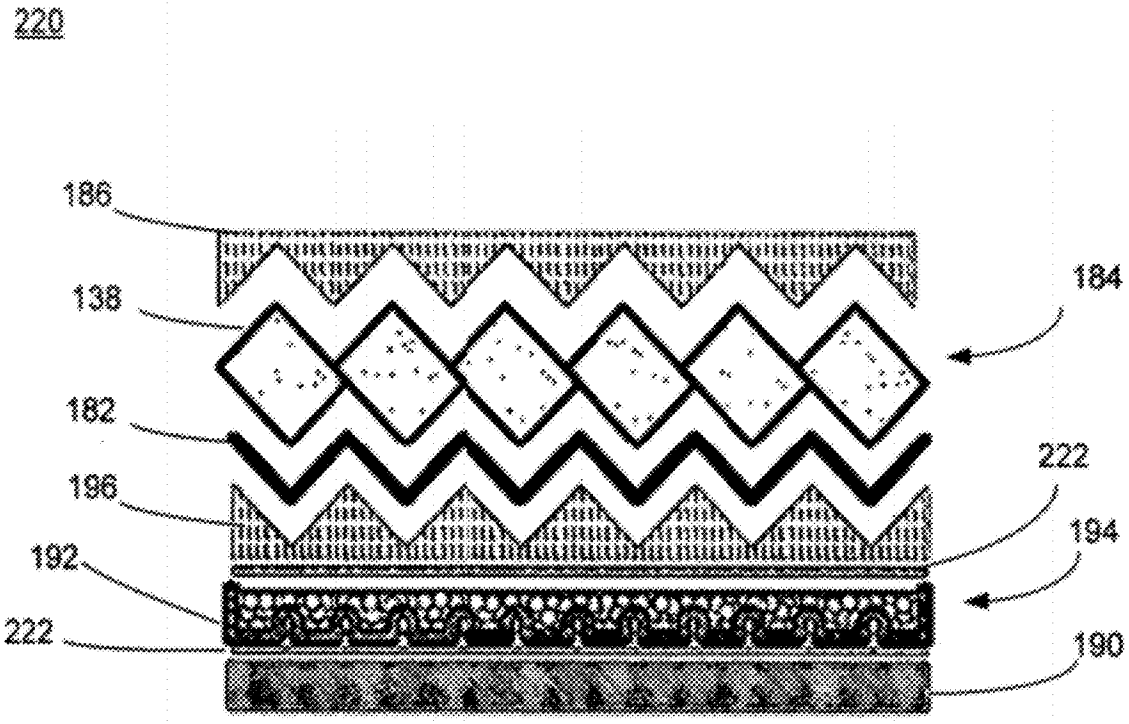
FIG. 28 is a diagram an exploded, cross-sectional view of an embodiment of an armor system including multiple ballistic panels.

With reference now to FIG. 28, shown is an exploded view of another embodiment of an armor system 220 that includes multiple ballistic panels. Armor system 220 shown also includes outer bonding layer 186, first grinding layer 184, first core 182, additional inner bonding layer 196, seconding grinding layer 194, second core 192 and backing 190, which may be the same or similar to components of armor system 180 described above. Additionally, armor system 220 includes two layers of wire mesh 222 surrounding second or inner ballistic panel portion of armor system 220. Wire mesh 222 may serve similar purposes as wire mesh layers 172 described above. Wire mesh 222 is located between inner bonding layer 196 and second grinding layer 194. Inner bonding layer 196 is shown here as filling in underside of first core 182. Wire mesh 222 may be installed as described above, e.g., applied to inner bonding layer 196 while inner bonding layer 196 is still curing. Armor system 220 may also include wire mesh layers surrounding first or upper ballistic panel portion of armor system 220. It is noted that while outer ballistic panel portion shown in FIG. 28 is akin to ballistic panel 100, 120 and inner ballistic panel portion is akin to ballistic panel 10, the ballistic panels in armor system 220 may be alternated. Moreover, additional layers, e.g., additional ballistic panels, may be added to armor system 220.

For the most part, the ballistic panel embodiments described herein, and the armor systems using these embodiments, are "passive" armor. However, many threats cannot be easily stopped using passive armor alone. Indeed, many threats are more easily stopped using reactive armor or a combination of reactive armor and passive armor. For example, rocket-propelled grenades (RPGs), explosively formed penetrators (EFPs), linear shape charges (LSCs) and other shape charges are more easily and successfully stopped using at least some reactive armor.

RPGs, EFPs, LSCs and other shaped charges typically form a high-speed jet of molten metal that can punch through most forms of armor. A typical device consists of a solid cylinder of explosive with a metal-lined conical hollow in one end and a central detonator, array of detonators, or detonation wave guide at the other end. The enormous pressure generated by the detonation of the explosive drives the liner contained within the hollow cavity inward to collapse upon its central axis. The resulting collision forms and projects a high-velocity jet of metal forward along the axis. Most of the jet material originates from the innermost layer of the liner, about 10% to 20% of its thickness. The remaining liner material forms a slower-moving slug of material, which is sometimes called a "carrot."

Because of variations along the liner in its collapse velocity, the jet so formed has a varying velocity along its length, decreasing from the front. This variation in velocity stretches the jet and eventually leads to its break-up into particles. In time, the particles tend to lose their alignment, which reduces the depth of penetration at long standoffs. Also, at the apex of the cone, which forms the very front of the jet, the liner does not have time to be fully accelerated before it forms its part of the jet. This affect results in a small part of the molten jet being projected at a lower velocity than jet formed behind it. As a result, the initial parts of the jet coalesce to form a pronounced wider tip portion.

Most of the jet formed moves at hypersonic speed, e.g., the tip at 7 to 14 km/s, the jet tail at a lower velocity (1 to 3 km/s), and the slug at a still lower velocity (less than 1 km/s). The exact velocities are dependent on the charge's configuration and confinement, explosive type, materials used, and the explosive-initiation mode. At typical velocities, the penetration process generates such enormous pressures that it may be considered hydrodynamic; to a good approximation, the jet and armor may be treated as incompressible fluids, with their material strengths ignored.

The molten jet so formed punches through armor, causing significant damage and injury once through. Moreover, the remaining slug from the shape charge follows through the hole formed and adds to the carnage. Interrupting the formation of the molten jet has been found to be a key component of effectively stopping shape charges.

Figure 29:
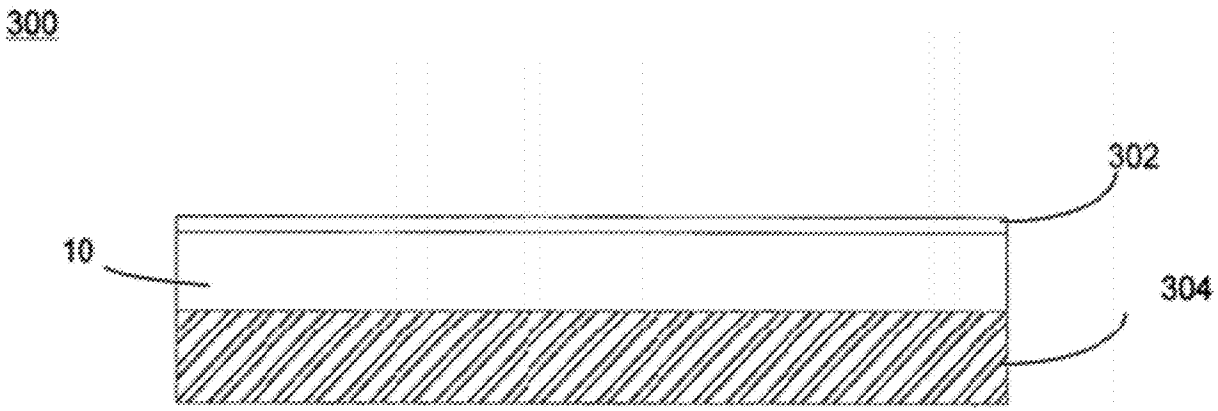
FIG. 29 is a diagram a cross-sectional view of an embodiment of an armor system including a ballistic panel and a reactive armor component.

As illustrated and described herein, embodiments of ballistic panels described herein may be combined with each other and with other materials to form comprehensive armor systems. With reference now to FIG. 29, shown is a view of an embodiment of such a comprehensive armor system 300 that includes reactive and passive features. As illustrated, armor system 300 includes a ballistic panel, e.g., ballistic panel 10 from FIG. 1, backing 304 and a layer of explosive, e.g., sheet plastic explosive 302. When armor system 300 is assembled, each layer may be bonded, fastened or otherwise affixed together. Although armor system 300 shown includes ballistic panel 10, armor system 300 may include other embodiments of ballistic panels described herein, e.g., ballistic panel 120 shown in FIG. 20. Ballistic panels may be completely enclosed by self-healing polyurethane (e.g., outer coating 18 or bonding layer 106). Additional ballistic panels may also be used. Although armor system 300 is shown with layers facing in one direction, additional layers facing in the same and/or different directions may be added. Backing 304 may be AR500 steel plate (e.g., 2" thick). The relative thicknesses of ballistic panel 10 and backing 304 shown in FIG. 29 may be indicative of the actual thicknesses of each layer (e.g., ballistic panel 10 in FIG. 29 may be approximately two inches thick also); however, each layer may be varied in thickness and is not limited by the illustration here.

Sheet plastic explosive 302 provides a reactive armor component for armor system 300. When a projectile impacts sheet plastic explosive 302, the explosive 302 reacts and explodes, affecting round. The explosion may help change the path of projectile, enhancing deflective affects of grinding media in ballistic panel 10. More importantly, however, the explosion ideally interrupts or otherwise affects the formation of the molten jet that is formed by RPGs, EFPs, LSCs and other shape charges. By interrupting or affecting the jet, the explosion reduces or stops the penetrating affect of the shape charge and its molten jet. Because the formation of the molten jet is interrupted or otherwise affected, the molten jet may not fully form, and ballistic panel 10 may stop the molten jet and the remaining slug from the RPGs, EFPs, LSCs and other shape charge.

Figure 30:
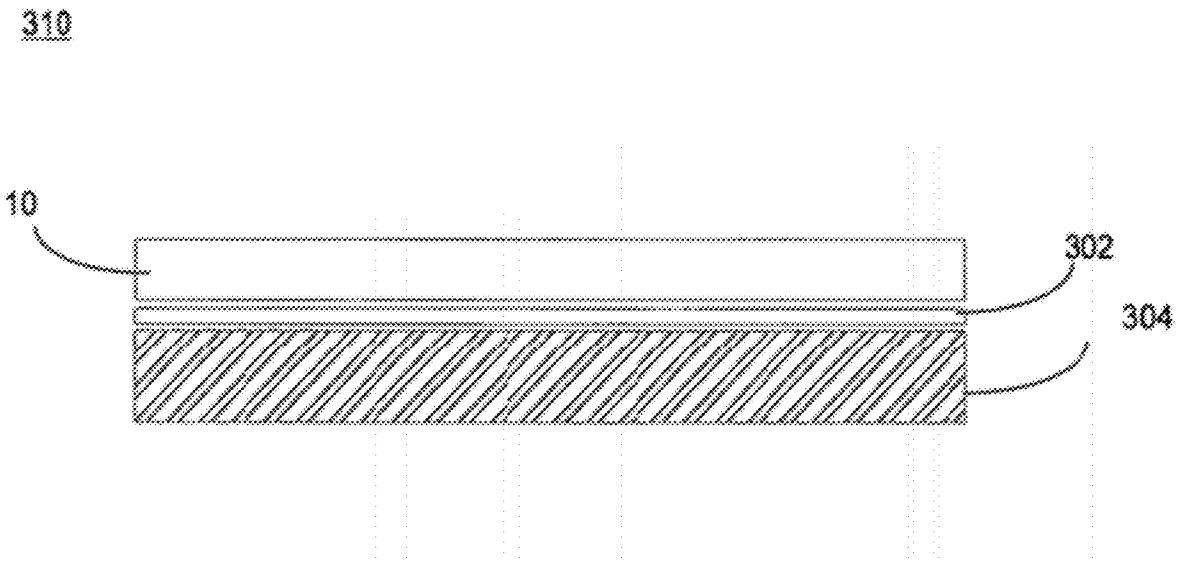
FIG. 30 is a diagram a cross-sectional, exploded view of an embodiment of an armor system including a ballistic panel and a reactive armor component.

With reference now to FIG. 30, shown is an exploded view of another embodiment of an armor system 310 that includes reactive and passive features. As illustrated, armor system 310 includes a ballistic panel, e.g., ballistic panel 10 from FIG. 1, backing 304 and a layer of explosive, e.g., sheet plastic explosive 302. Armor system 310 is similar to armor system 300 shown in FIG. 29; however, in armor system 310 the sheet plastic explosive 302 and ballistic panel 10 are flipped so that ballistic panel 10 is closer to threat and projectiles (e.g., RPGs, EFPs, LSCs and other shape charges) impact ballistic panel 10 first. As with other comprehensive armor systems described herein, armor system 310 performs well at intercepting RPGs, EFPs, LSCs and other shape charges because of combined reactive and passive features.

Figure 31:
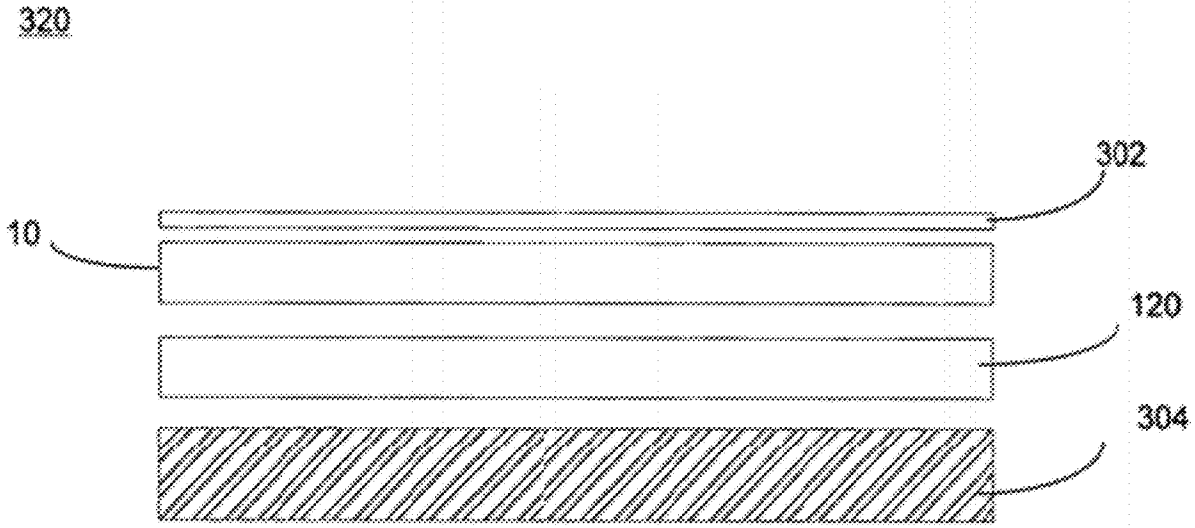
FIG. 31 is a diagram a cross-sectional, exploded view of an embodiment of an armor system including multiple ballistic panels and a reactive armor component.

With reference now to FIG. 31, shown is an exploded view of another embodiment of an armor system 320 that includes reactive and passive features. As illustrated, armor system 320 includes two ballistic panels, e.g., ballistic panel 10 from FIG. 1 and ballistic panel 120 from FIG. 20, backing 304 and a layer of explosive, e.g., sheet plastic explosive 302. Armor system 320 is similar to armor systems described above; however, in armor system 320 an additional ballistic panel 120 has been added beneath ballistic panel 10. Ballistic panel 120 may include ceramic cylinders 108, hollow ceramic cylinders 138 or other grinding media described herein. Moreover, core 122 of ballistic panel 120 may include protrusions for holding hollow ceramic cylinders 138 (or other hollow grinding media) in place. As with other comprehensive armor systems described herein, armor system 320 performs well at intercepting RPGs, EFPs, LSCs and other shape charges because of combined reactive and passive features.

Figure 32:
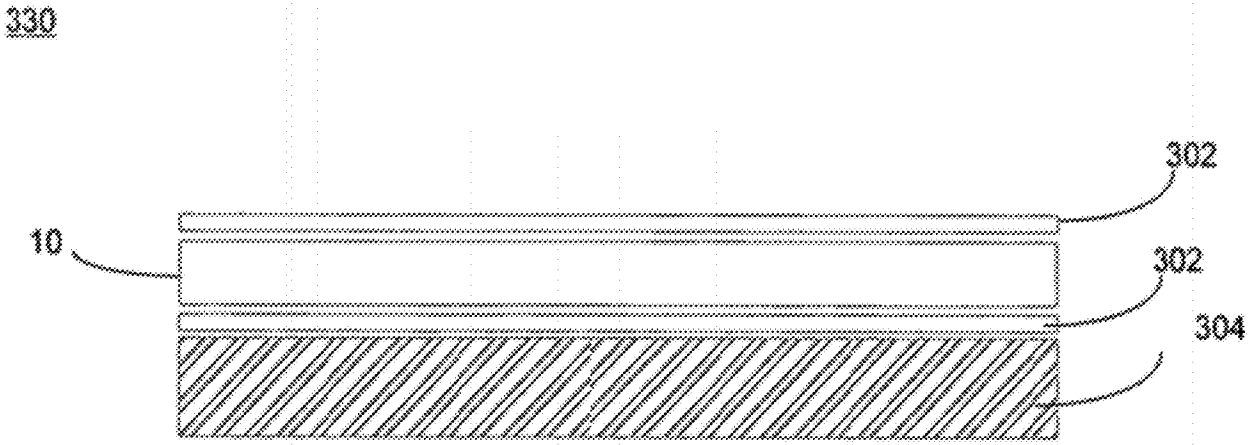
FIG. 32 is a diagram a cross-sectional, exploded view of an embodiment of an armor system including a ballistic panel and reactive armor components.

With reference now to FIG. 32, shown is an exploded view of another embodiment of an armor system 330 that includes reactive and passive features. As illustrated, armor system 330 includes a ballistic panel, e.g., ballistic panel 10 from FIG. 1 (or ballistic panel 120 from FIG. 20), backing 304 and two layers of explosive, e.g., sheet plastic explosives 302. Armor system 330 is similar to armor systems described above; however, in armor system 330 an additional sheet plastic explosive 302 layer has been added beneath ballistic panel 10. As with other comprehensive armor systems described herein, armor system 330 performs well at intercepting RPGs, EFPs, LSCs and other shape charges because of combined reactive and passive features.

Figure 33:
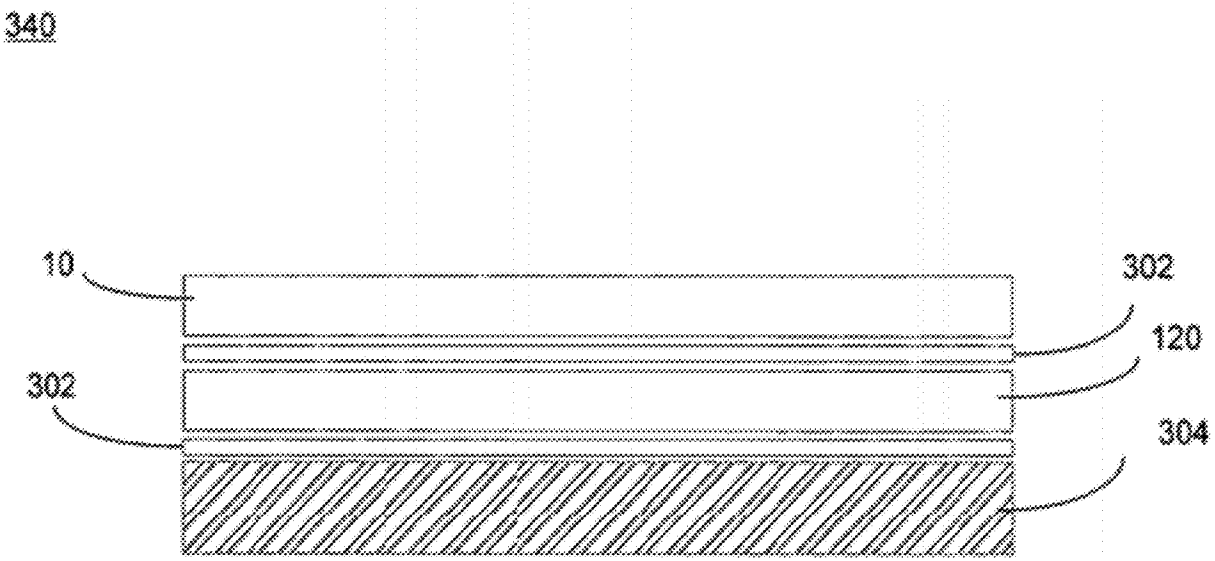
FIG. 33 is a diagram a cross-sectional, exploded view of an embodiment of an armor system including multiple ballistic panels and reactive armor components.

With reference now to FIG. 33, shown is an exploded view of another embodiment of an armor system 340 that includes reactive and passive features. As illustrated, armor system 340 includes two ballistic panels, e.g., ballistic panel 10 from FIG. 1 and ballistic panel 120 from FIG. 20, backing 304 and two layers of explosive, e.g., sheet plastic explosives 302.

Armor system 340 is similar to armor systems described above; however, in armor system 340, a sheet plastic explosive 302 layer is located beneath ballistic panel 10, instead of on top of ballistic panel 10, and ballistic panel 120, with an additional sheet plastic explosive 302 layer beneath ballistic panel 120, are added beneath ballistic panel 10. This illustrates another of the various combinations of ballistic panels and sheet plastic explosives can be combined in comprehensive armor systems. For example, ballistic panels may be alternated. Ballistic panel 120 may include ceramic cylinders 108, hollow ceramic cylinders 138 or other grinding media described herein. Moreover, core 122 of ballistic panel 120 may include protrusions for holding hollow ceramic cylinders 138 (or other hollow grinding media) in place. As with other comprehensive armor systems described herein, armor system 340 performs well at intercepting RPGs, EFPs, LSCs and other shape charges because of combined reactive and passive features.

Figure 34:
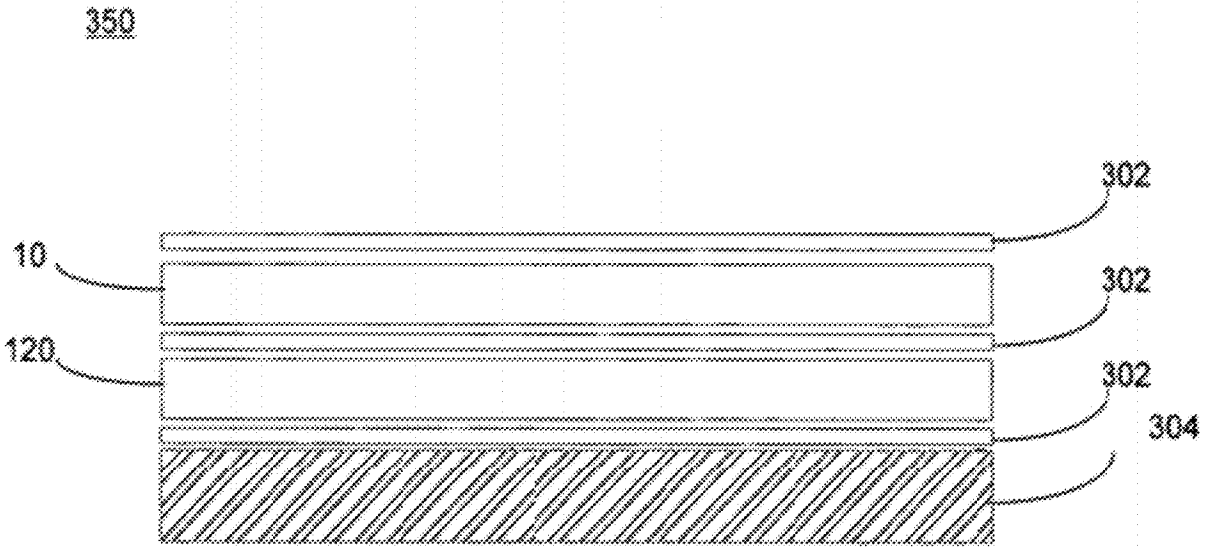
FIG. 34 is a diagram a cross-sectional, exploded view of an embodiment of an armor system including multiple ballistic panels and reactive armor components.

With reference now to FIG. 34, shown is an exploded view of another embodiment of an armor system 350 that includes reactive and passive features. As illustrated, armor system 350 includes two ballistic panels, e.g., ballistic panel 10 from FIG. 1 and ballistic panel 120 from FIG. 20, backing 304 and three layers of explosive, e.g., sheet plastic explosives 302. Armor system 350 is similar to armor systems described above; however, in armor system 350, sheet plastic explosive 302 layers are located above and beneath ballistic panel 10 and ballistic panel 120, with an additional sheet plastic explosive 302 layer beneath ballistic panel 120, are added beneath ballistic panel 10. This illustrates another of the various combinations of ballistic panels and sheet plastic explosives can be combined in comprehensive armor systems. For example, ballistic panels may be alternated. Ballistic panel 120 may include ceramic cylinders 108, hollow ceramic cylinders 138 or other grinding media described herein. Moreover, core 122 of ballistic panel 120 may include protrusions for holding hollow ceramic cylinders 138 (or other hollow grinding media) in place. As with other comprehensive armor systems described herein, armor system 350 performs well at intercepting RPGs, EFPs, LSCs and other shape charges because of combined reactive and passive features.

Figure 35:
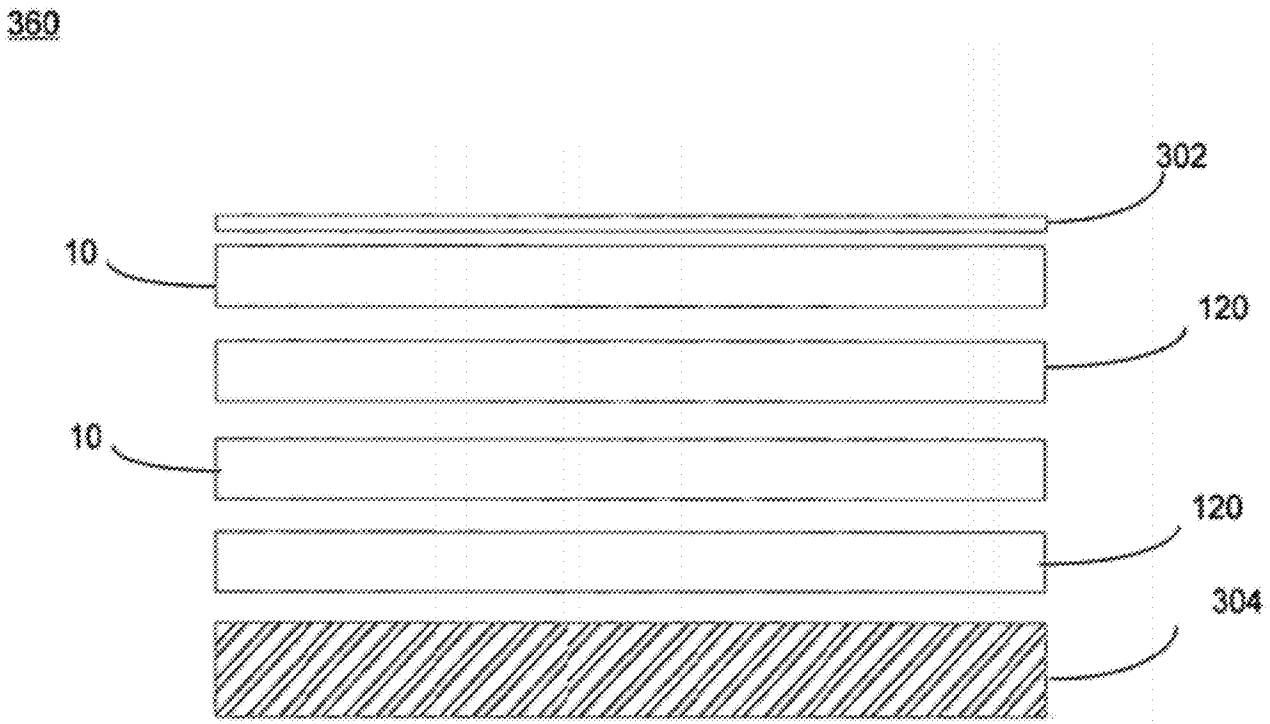
FIG. 35 is a diagram a cross-sectional, exploded view of an embodiment of an armor system including multiple ballistic panels and a reactive armor component.

With reference now to FIG. 35, shown is an exploded view of another embodiment of an armor system 360 that includes reactive and passive features. Armor system 360 includes multiple layers of ballistic panels topped with a layer of sheet plastic explosive 302 and backed by backing 304. Ballistic panels shown may be any of the embodiments of ballistic panels described herein. Ballistic panels may be completely enclosed by self-healing polyurethane (e.g., outer coating 18 or bonding layer 106). In the embodiment of armor system 360 shown ballistic panels akin to ballistic panel 10 shown in FIG. 1 and ballistic panel 120, shown in FIG. 20 are alternated as shown. Different layering schemes and combinations of ballistic panels may be used. For example, ballistic panels may be alternated. Additional or fewer ballistic panels may be used. Ballistic panel 120 may include ceramic cylinders 108, hollow ceramic cylinders 138 or other grinding media described herein. Moreover, core 122 of ballistic panel 120 may include protrusions for holding hollow ceramic cylinders 138 (or other hollow grinding media) in place. As with other comprehensive armor systems described herein, armor system 360 performs well at intercepting RPGs, EFPs, LSCs and other shape charges because of combined reactive and passive features.

Figure 36:
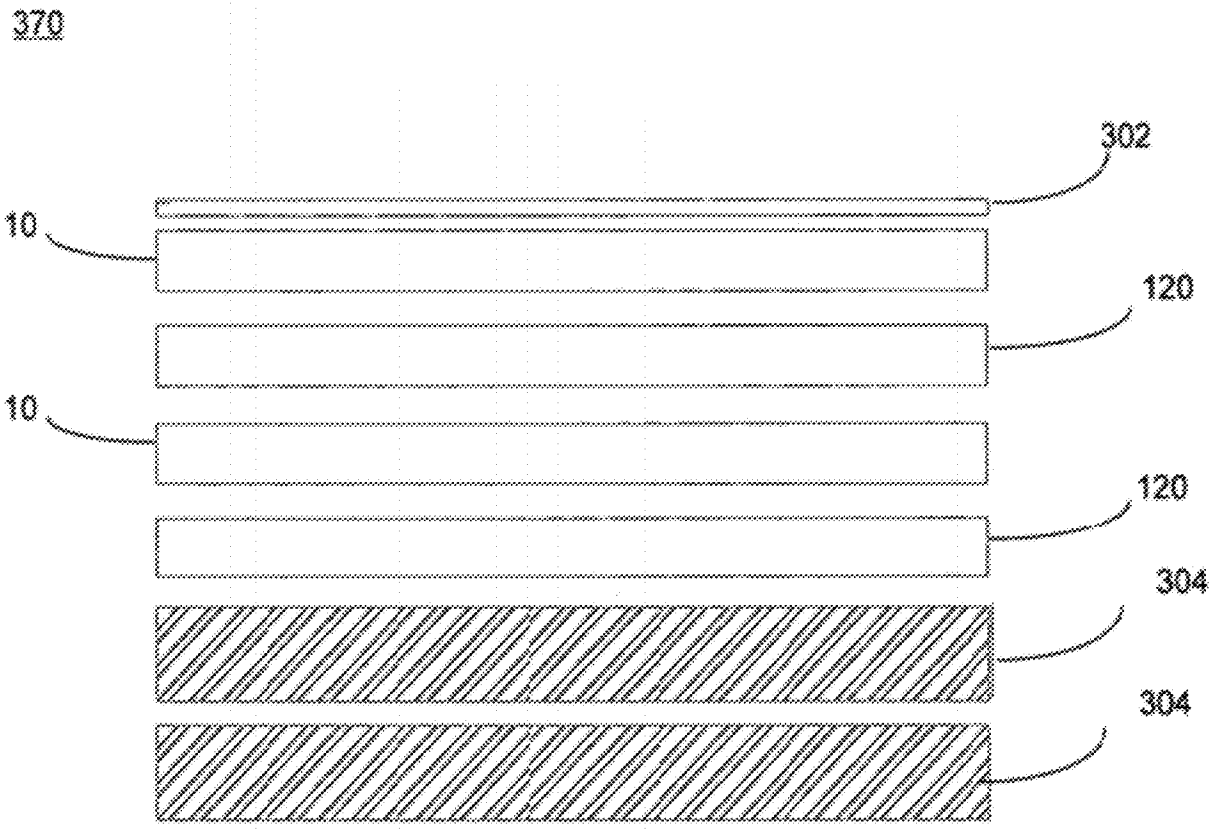
FIG. 36 is a diagram a cross-sectional, exploded view of an embodiment of an armor system including multiple ballistic panels, a reactive armor component and multiple backings.

With reference now to FIG. 36, shown is an exploded view of another embodiment of an armor system 360 that includes reactive and passive features. Armor system 370 includes multiple layers of ballistic panels topped with a layer of sheet plastic explosive 302 and backed by two backing 304 layers. Ballistic panels shown may be any of the embodiments of ballistic panels described herein. Ballistic panels may be completely enclosed by self-healing polyurethane (e.g., outer coating 18 or bonding layer 106). In the embodiment of armor system 370 shown ballistic panels akin to ballistic panel 10 shown in FIG. 1 and ballistic panel 120, shown in FIG. 20 are alternated as shown. Different layering schemes and combinations of ballistic panels may be used. For example, ballistic panels may be alternated. Additional or fewer ballistic panels may be used. Ballistic panel 120 may include ceramic cylinders 108, hollow ceramic cylinders 138 or other grinding media described herein. Moreover, core 122 of ballistic panel 120 may include protrusions for holding hollow ceramic cylinders 138 (or other hollow grinding media) in place. As with other comprehensive armor systems described herein, armor system 370 performs well at intercepting RPGs, EFPs, LSCs and other shape charges because of combined reactive and passive features.

The terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise indicated.

The invention claimed is:

1. An apparatus for providing protection from ballistic rounds, projectiles, fragments and explosives, comprising:

a grinding portion comprising a plurality of media and positioned on at least one side of the apparatus facing towards potential threats, in which the grinding portion affects rounds, projectiles, fragments, super-heated jet or other materials impacting the apparatus, helping to dissipate the impacting material and its momentum, wherein the media are positioned side-by-side, at an angle in adjacent rows, and lined up in parallel rows, and wherein adjacent rows of the grinding media are offset so that intersections formed by adjacent media in adjacent rows do not align;

a bonding portion that bonds the grinding portion together and provides an outer coating to the apparatus on a side of the apparatus facing potential threats and through which rounds, projectiles, fragments or other materials impact and penetrate the apparatus; and an explosive portion within the apparatus on a side facing potential threats for providing a reactive armor component for the apparatus.

2. The apparatus of claim 1 wherein the media are ceramic cylinders.

3. The apparatus of claim 1 wherein the media are ceramic cubes.

4. The apparatus of claim 1 wherein the media are ceramic hexagons.

5. The apparatus of claim 1 further comprising a core that is shaped and configured as a structural truss of the apparatus, in which the core includes a plurality of parallel, adjacent rows and the core distributes and dissipates force impacting on the apparatus wherein the rows of the core are tilted so that the media are oriented at an angle away from perpendicular to the side of the apparatus facing towards potential threats.

6. The apparatus of claim 5 wherein the core acts like a tray with a number of adjacent, tilted rows on which the media are placed.

7. The apparatus of claim 1 wherein the media are hollow.

8. The apparatus of claim 7 further comprising a core that is shaped and configured as a structural truss of the apparatus, in which the core includes a plurality of parallel, adjacent rows and the core distributes and dissipates force impacting on the apparatus wherein the core includes protrusions on which the hollow ceramic grinding media fit.

9. The apparatus of claim 1 wherein the bonding portion is a self-healing polymer.

10. The apparatus of claim 1 further comprising a core that is shaped and configured as a structural truss of the apparatus, in which the core includes a plurality of parallel, adjacent rows and the core distributes and dissipates force impacting on the apparatus wherein the core is plastic.

11. The apparatus of claim 1 further comprising a backing that is attached to the apparatus on a side facing away from potential threats, in which the backing acts to further absorb and dissipate force impacting on the apparatus.

12. The apparatus of claim 1 further comprising a core that is shaped and configured as a structural truss of the apparatus, in which the core includes a plurality of parallel, adjacent rows and the core distributes and dissipates force impacting on the apparatus in which the bonding portion is located on both sides of the core and provides an outer coating to the apparatus on a side facing away from potential threats.

13. The apparatus of claim 1 wherein the bonding portion fills in tiny gaps and spaces between the media.

14. The apparatus of claim 1 further comprising a core that is shaped and configured as a structural truss of the apparatus, in which the core includes a plurality of parallel, adjacent rows and the core distributes and dissipates force impacting on the apparatus wherein after the ceramic grinding media are positioned in the core, the bonding portion is poured or cast onto the grinding portion.

15. The apparatus of claim 1 further comprising a core that is shaped and configured as a structural truss of the apparatus, in which the core includes a plurality of parallel, adjacent rows and the core distributes and dissipates force impacting on the apparatus wherein multiple layers of the core and the grinding portion are stacked one on top of another in an interlocking manner.

16. The apparatus of claim 1, wherein the explosive portion contains explosives that react and explode when a projectile or super-heated jet impacts the explosive portion to disrupt a path of the projectile or super-heated jet, and to enhance deflective effects of the plurality of media in the grinding portion.

* * * * *